US012747900B2

(12) United States Patent
Goldfarbmuren et al.

(10) Patent No.: US 12,747,900 B2
(45) **Date of Patent: *Sep. 29, 2026**

(54) ICE MAKING METHODS, SYSTEMS, AND DEVICES

(71) Applicant: Rebound Technologies, Inc., Commerce City, CO (US)

(72) Inventors: Russell Goldfarbmuren, Denver, CO (US); Luke Erickson, Denver, CO (US); Murali Anumolu, Denver, CO (US); Eric Irwin, Denver, CO (US); Chance Lord, Lakewood, CO (US); Joshua Nelson, West Lafayette, IN (US)

(73) Assignee: Rebound Technologies, Inc., Commerce City, CO (US)

( * ) Notice: Subject to any disclaimer, the term of this patent is extended or adjusted under 35 U.S.C. 154(b) by 319 days.

This patent is subject to a terminal disclaimer.

(21) Appl. No.: 18/408,962

(22) Filed: Jan. 10, 2024

(65) Prior Publication Data

US 2024/0263858 A1 Aug. 8, 2024

Related U.S. Application Data

(63) Continuation-in-part of application No. 17/942,297, filed on Sep. 12, 2022, now Pat. No. 11,913,701, (Continued)

(51) Int. Cl.

| | |
|---|---|
| ***F25C 1/12*** | (2006.01) |
| ***F25C 1/04*** | (2018.01) |
| ***F25C 5/187*** | (2018.01) |

(52) U.S. Cl.

CPC ..... *F25C 1/12* (2013.01); *F25C 1/04* (2013.01); *F25C 5/187* (2013.01)

(58) Field of Classification Search

CPC ..... F25C 2301/002; F25C 1/00; F25C 1/16; F25C 2400/02; F25C 3/02; F25C 5/02

See application file for complete search history.

(56) References Cited

U.S. PATENT DOCUMENTS

| | | | |
|---|---|---|---|
| 3,650,121 | A | 3/1972 | Kimpel |
| 3,869,870 | A | 3/1975 | Kuehner |

(Continued)

FOREIGN PATENT DOCUMENTS

| | | | |
|---|---|---|---|
| CN | 1542391 | A | 11/2004 |
| CN | 106796072 | A | 5/2017 |

(Continued)

OTHER PUBLICATIONS

International Search Report and Written Opinion, Int'l Appl. No. PCT/US19/68588, Mar. 25, 2020, USPTO—ISA.

(Continued)

*Primary Examiner* — Filip Zec

(74) *Attorney, Agent, or Firm* — Wilson Patent Law, LLC

(57) ABSTRACT

Ice making methods, systems, and devices are provided in accordance with various embodiments. For example, methods, systems, and devices for producing harvestable ice on cold plates are provided in accordance with various embodiments. Methods, systems, and devices for harvesting ice on cold surfaces are also provided in accordance with various embodiments. Methods, systems, and devices for cold oleophilic surfaces that produce harvestable ice are also provided in accordance with various embodiments. Methods, systems, and devices for ice maker fault detection and recovery are also provided in accordance with various embodiments. Methods, systems, and devices for ice maker startup are also provided in accordance with various embodiments.

19 Claims, 28 Drawing Sheets

Related U.S. Application Data which is a continuation of application No. 16/966,542, filed as application No. PCT/US2019/068588 on Dec. 26, 2019, now Pat. No. 11,441,830.

(60) Provisional application No. 63/438,029, filed on Jan. 10, 2023, provisional application No. 63/438,032, filed on Jan. 10, 2023, provisional application No. 63/438,103, filed on Jan. 10, 2023, provisional application No. 63/438,105, filed on Jan. 10, 2023, provisional application No. 63/438,037, filed on Jan. 10, 2023, provisional application No. 62/784,865, filed on Dec. 26, 2018.

(56) References Cited

U.S. PATENT DOCUMENTS

| | | | | |
|---|---|---|---|---|
| 3,906,742 | A | 9/1975 | Newton | |
| 4,907,415 | A | 3/1990 | Stewart | |
| 4,953,360 | A | 9/1990 | Rzechula | |
| 5,218,828 | A | 6/1993 | Hino | |
| 5,858,957 | A | 1/1999 | Donoghue | |
| 6,119,467 | A | 9/2000 | Zusman | |
| 6,282,909 | B1 * | 9/2001 | Newman | F25C 1/12 62/158 |
| 6,581,393 | B2 * | 6/2003 | Newman | F25C 5/10 62/135 |
| 8,012,313 | B2 | 9/2011 | Carson | |
| 8,371,131 | B2 | 2/2013 | Zwieg | |
| 8,449,919 | B2 | 5/2013 | Shen | |
| 9,238,309 | B2 | 1/2016 | King | |
| 9,310,140 | B2 | 4/2016 | Muren | |
| 9,498,934 | B2 | 11/2016 | Paxson | |
| 10,220,351 | B2 | 3/2019 | Tuteja | |
| 10,253,451 | B1 | 4/2019 | Truong | |
| 10,391,506 | B2 | 8/2019 | Meuler | |
| 10,544,974 | B2 | 1/2020 | Goldfarbmuren | |
| 10,739,053 | B2 * | 8/2020 | Jimenez | F25C 1/04 |
| 11,236,935 | B2 | 2/2022 | Goldfarbmuren | |
| 11,293,992 | B2 * | 4/2022 | Ashourloo | H02M 3/07 |
| 11,318,813 | B2 * | 5/2022 | Allgaeuer | B60H 1/32284 |
| 11,441,830 | B2 | 9/2022 | Goldfarbmuren | |
| 11,913,701 | B2 | 2/2024 | Goldfarbmuren | |
| 2004/0167231 | A1 | 8/2004 | Kawagoe | |
| 2005/0191386 | A1 | 9/2005 | Adams | |
| 2013/0178568 | A1 | 7/2013 | Meuler | |
| 2014/0000857 | A1 | 1/2014 | King | |
| 2015/0175814 | A1 | 6/2015 | Aizenberg | |
| 2017/0167770 | A1 | 6/2017 | Hemrle | |
| 2019/0101315 | A1 | 4/2019 | Goldfarbmuren | |
| 2020/0231024 | A1 * | 7/2020 | Shrivastava | B60H 1/00978 |
| 2020/0263913 | A1 | 8/2020 | Goldfarbmuren | |
| 2021/0310715 | A1 | 10/2021 | Goldfarbmuren | |
| 2023/0121170 | A1 | 4/2023 | Goldfarbmuren | |

FOREIGN PATENT DOCUMENTS

| | | |
|---|---|---|
| EP | 0081913 | 6/1983 |
| FR | 2795810 | 5/2001 |
| JP | S61-168754 | 7/1986 |
| JP | S64-010076 | 1/1989 |
| JP | 04-313657 | 11/1992 |
| JP | H07-253262 | 10/1995 |
| JP | H10-185379 | 7/1998 |
| JP | H11-281214 | 10/1999 |
| WO | WO 87/07250 | 12/1987 |
| WO | WO 2019/046836 | 3/2019 |
| WO | WO 2020/139953 | 7/2020 |

OTHER PUBLICATIONS

Notice of Allowance, U.S. Appl. No. 16/119,661, Sep. 4, 2019, USPTO.

International Search Report and Written Opinion, Int'l Appl. No. PCT/US2018/049288, Dec. 26, 2018, ISA—USPTO.

First Office Action, Chinese Appl. No. 201880056526.8, Nov. 24, 2020, CNIPA.

Second Office Action, Chinese Appl. No. 201880056526.8, Aug. 11, 2021, CNIPA.

Third Office Action, Chinese Appl. No. 201880056526.8, Dec. 16, 2021, CNIPA.

Notification of Grant of Patent for Invention, Chinese Appl. No. 201880056526.8, Mar. 28, 2022, CNIPA.

Extended European Search Report and Search Opinion, European Appl. No. 18851112.5, May 4, 2021, EPO.

1st Examination Report, European Appl. No. 18551112.5, Dec. 5, 2023, EPO.

Notice of Intention to Grant, European Appl. No. 18851112.5, Jun. 5, 2024, EPO.

Notice of Intention to Grant, European Appl. No. 18851112.5, Oct. 16, 2024, EPO.

Notification of Reason(s) for Refusal, Japanese Appl. No. 2020-512576, Oct. 12, 2021, JPO.

Notification of Reason(s) for Refusal, Japanese Appl. No. 2020-512576, Jun. 21, 2022, JPO.

Decision to Grant a Patent, Japanese Appl. No. 2020-512576, Oct. 4, 2022, JPO.

Non-Final Office Action, U.S. Appl. No. 16/750,170, Apr. 5, 2021, USPTO.

Final Office Action, U.S. Appl. No. 16/750,170, Sep. 21, 2021, USPTO.

Notice of Allowance, U.S. Appl. No. 16/750,170, Dec. 13, 2021, USPTO.

Notice of Allowance, U.S. Appl. No. 16/750,170, Dec. 30, 2021, USPTO.

Non-Final Office Action, U.S. Appl. No. 16/966,542, Sep. 2, 2021, USPTO.

Final Office Action, U.S. Appl. No. 16/966,542, Feb. 25, 2022, USPTO.

Notice of Allowance, U.S. Appl. No. 16/966,542, May 6, 2022, USPTO.

Notice of Allowance, U.S. Appl. No. 16/966,542, Aug. 17, 2022, USPTO.

Non-Final Office Action, U.S. Appl. No. 17/942,297, Mar. 28, 2023, USPTO.

Notice of Allowance, U.S. Appl. No. 17/942,297, Oct. 13, 2023, USPTO.

* cited by examiner

ICE MAKING METHODS, SYSTEMS, AND DEVICES

CROSS-REFERENCES TO RELATED APPLICATIONS

This application is a non-provisional patent application claiming priority benefit of U.S. provisional patent application Ser. No. 63/438,029, filed on Jan. 10, 2023 and entitled "METHODS, SYSTEMS, AND DEVICES FOR PRODUCING HARVESTABLE ICE ON COLD PLATES," the entire disclosure of which is herein incorporated by reference for all purposes. This application is a non-provisional patent application claiming priority benefit of U.S. provisional patent application Ser. No. 63/438,032, filed on Jan. 10, 2023 and entitled "METHODS, SYSTEMS, AND DEVICES FOR HARVESTING ICE ON COLD SURFACES," the entire disclosure of which is herein incorporated by reference for all purposes. This application is a non-provisional patent application claiming priority benefit of U.S. provisional patent application Ser. No. 63/438,103, filed on Jan. 10, 2023 and entitled "METHODS, SYSTEMS, AND DEVICES FOR COLD OLEOPHILIC SURFACES THAT PRODUCE HARVESTABLE ICE," the entire disclosure of which is herein incorporated by reference for all purposes. This application is a non-provisional patent application claiming priority benefit of U.S. provisional patent application Ser. No. 63/438,105, filed on Jan. 10, 2023 and entitled "METHODS, SYSTEMS, AND DEVICES FOR ICE MAKER FAULT DETECTION AND RECOVERY," the entire disclosure of which is herein incorporated by reference for all purposes. This application is a non-provisional patent application claiming priority benefit of U.S. provisional patent application Ser. No. 63/438,037, filed on Jan. 10, 2023 and entitled "METHODS, SYSTEMS, AND DEVICES FOR ICE MAKER STARTUP," the entire disclosure of which is herein incorporated by reference for all purposes.

This application is a Continuation-in-Part of U.S. patent application Ser. No. 17/942,297, filed on Sep. 12, 2022 and entitled "SOLID PRODUCTION SYSTEMS, DEVICES, AND METHODS UTILIZING OLEOPHILIC SURFACES," which is Continuation of U.S. patent application Ser. No. 16/966,542, filed on Jul. 31, 2020 and entitled "SOLID PRODUCTION SYSTEMS, DEVICES, AND METHODS UTILIZING OLEOPHILIC SURFACES," now U.S. Pat. No. 11,441,830, issued Sep. 13, 2022, which is a National Stage Entry of International Appl. No. PCT/US19/68588, filed on Dec. 26, 2019 and entitled "SOLID PRODUCTION SYSTEMS, DEVICES, AND METHODS UTILIZING OLEOPHILIC SURFACES," which claims priority benefit of U.S. provisional patent application Ser. No. 62/784,865, filed on Dec. 26, 2018 and entitled "SOLID PRODUCTION UTILIZING OLEOPHILIC-COATED SURFACE," the entire disclosures of which are herein incorporated by reference for all purposes.

BACKGROUND

Different tools and techniques may generally be utilized for solidification and/or solid production, such as ice production, including drop forming, block freezing, flake freezing, and many other techniques.

There may be a need for new tools and techniques to address solidification and/or solid production, such as ice making.

SUMMARY

Ice making methods, systems, and devices are provided in accordance with various embodiments. For example, methods, systems, and devices for producing harvestable ice on cold plates are provided in accordance with various embodiments. Methods, systems, and devices for harvesting ice on cold surfaces are also provided in accordance with various embodiments. Methods, systems, and devices for cold oleophilic surfaces that produce harvestable ice are also provided in accordance with various embodiments. Methods, systems, and devices for ice maker fault detection and recovery are also provided in accordance with various embodiments. Methods, systems, and devices for ice maker startup are also provided in accordance with various embodiments.

For example, methods, systems, and devices for producing harvestable ice on cold plates are provided in accordance with various embodiments. Some embodiments include the creation of a distribution of water in a falling film over a cold plate for the creation of ice. Some embodiments allow for the manipulation of that falling film to produce an uneven flow of water such that the sheet of ice produced on the cold plate may have beneficial characteristics that allow it to be harvested.

Some embodiments include a system that may include: a heat exchanger configured such that a refrigerant flows into and out of the heat exchanger to cool a surface of the heat exchanger; and a liquid manifold that includes multiple apertures such that a liquid flows through the multiple apertures and down the surface of the heat exchanger to form an ice sheet on the surface of the heat exchanger from water in the liquid. In some embodiments, the liquid includes an emulsion. In some embodiments, the surface of the heat exchanger includes an oleophilic surface.

In some embodiments of the system, the multiple apertures of the liquid manifold are configured with multiple sizes. The multiple sizes may increase along a length of the liquid manifold or have non-uniform sizes along the length.

In some embodiments of the system, the multiple apertures of the liquid manifold are configured with multiple shapes. The multiple shapes may include at least a vertically biased shape or a horizontally biased shape.

In some embodiments of the system, the multiple apertures of the liquid manifold are configured with multiple spacings. The multiple spacings may include at least a first density and a second density such that the first density is less than the second density.

Some embodiments of the system include an inlet coupled with the liquid manifold such that the liquid flows at least along a first length of the liquid manifold from the inlet and along a second length of the liquid manifold from the inlet or from at least a first end of the liquid manifold or a second end of the liquid manifold. The liquid manifold may be configured such that at least one of the apertures from the multiple apertures along the first length of the liquid manifold is at a lower height than at least one of the other apertures from the multiple apertures along the first length of the liquid manifold. In some embodiments, at least the first length of the liquid manifold or the second length of the liquid manifold is angled down away from the inlet such that a height of the liquid manifold either increases or decreases along at least the first length of the liquid manifold or the second length of the liquid manifold. In some embodiments, at least the first length of the liquid manifold or the second length of the liquid manifold is horizontally oriented away from the inlet.

In some embodiments of the system, the refrigerant goes through a phase change within the heat exchanger.

In some embodiments of the system, the heat exchanger is configured such that the refrigerant flows into and out of the heat exchanger to cool another surface of the heat exchanger. The liquid manifold that includes the multiple apertures such that the liquid flows through the multiple apertures and down the surface of the heat exchanger to form the ice sheet on the surface of the heat exchanger from water in the liquid may be further configured such that at least a portion of the liquid that flows through the multiple apertures flows down another surface of the heat exchanger to form an ice sheet on the other surface of the heat exchanger from water in the liquid. Some embodiments include another liquid manifold that includes multiple apertures such that a liquid flows through the multiple apertures of the other liquid manifold and down the other surface of the heat exchanger to form an ice sheet on the other surface of the heat exchanger from water in the liquid.

Some embodiments include a method that may include: flowing a liquid to a manifold that includes multiple apertures; flowing the liquid out of the manifold through the multiple apertures; flowing the liquid down a surface of a heat exchanger from the liquid flowing out of the manifold through the multiple apertures; and forming an ice sheet on the surface of the heat exchanger from water in the liquid flowing down the heat exchanger. In some embodiments, flowing the liquid out of the manifold through the multiple apertures forms a non-uniform distribution of the liquid out of the manifold. In some embodiments, forming the ice sheet on the heat exchanger from water in the liquid flowing down the heat exchanger includes forming a uniform ice sheet on the surface of the heat exchanger.

In some embodiments of the method, the multiple apertures are configured with multiple sizes. The multiple sizes may increase along a length of the manifold.

In some embodiments of the method, the multiple apertures are configured with multiple shapes. The multiple shapes may include at least a vertically biased shape or a horizontally biased shape.

In some embodiments of the method, the multiple apertures are configured with multiple spacings. The multiple spacings may include at least a first density and a second density such that the first density is less than the second density.

Some embodiments of the method include an inlet coupled with the manifold such that the liquid flows at least along a first length of the manifold from the inlet and along a second length of the manifold from the inlet or from at least a first end of the manifold or a second end of the manifold. The manifold may be configured such that at least one of the apertures from the multiple apertures along the first length of the manifold is at a lower height than at least one of the other apertures from the multiple apertures along the first length of the manifold. In some embodiments, at least the first length of the manifold or the second length of the manifold is angled down away from the inlet. In some embodiments, at least the first length of the manifold or the second length of the manifold is horizontally oriented away from the inlet.

In some embodiments of the method, flowing the liquid out of the manifold through the multiple apertures includes flowing at least a portion of the liquid out of the manifold through the multiple apertures down another surface of the heat exchanger to form another sheet of ice on the other surface of the heat exchanger.

Some embodiments of the method include: flowing a liquid to another manifold that includes multiple apertures; flowing the liquid out of the other manifold through the multiple apertures; flowing the liquid down another surface of the heat exchanger from the liquid flowing out of the other manifold through the multiple apertures; and forming an ice sheet on the other surface of the heat exchanger from water in the liquid flowing down the other surface of the heat exchanger.

In some embodiments of the method, flowing the liquid down the surface of the heat exchanger forms a liquid film over the surface of the heat exchanger. Forming the ice sheet on the surface of the heat exchanger may include forming the ice sheet under the liquid film over the surface of the heat exchanger.

In some embodiments of the method, the liquid includes an emulsion. In some embodiments, the surface of the heat exchanger includes an oleophilic surface.

Some embodiments of the method include: curtailing the flow of the liquid down the surface of the heat exchanger after forming the ice sheet on the surface of the heat exchanger; subcooling the ice sheet on the surface of the heat exchanger after curtailing the flow of the liquid down the surface of the heat exchanger; and harvesting the ice sheet through the ice sheet, which is subcooled on the surface of the heat exchanger, falling away from the surface of the heat exchanger.

Methods, systems, and devices for harvesting ice on cold surfaces are also provided in accordance with various embodiments. Some embodiments pertain to the removal of ice from a cold surface with the assistance of a hydrodynamic force. For example, some embodiments are utilized with cold surfaces that may produce ice that peels or cleaves away from the surface to form a progressing gap between the ice and the surface. A fluid may then be applied into this gap to speed the process of ice removal. Integration, fluid selection, and system component layouts are discussed in more detail below.

Some embodiments include a system that may include: a heat exchanger configured such that a refrigerant flows into and out of the heat exchanger to cool a surface of the heat exchanger; and a fluid manifold that includes multiple apertures that inject a fluid through the multiple apertures between a surface of the heat exchanger and an ice sheet formed on the surface of the heat exchanger. Some embodiments include multiple nozzles through which the fluid flows to inject the fluid between the surface of the heat exchanger and the ice sheet formed on the surface of the heat exchanger.

In some embodiments of the system, the fluid manifold injects the fluid along a top, horizontal edge of the heat exchanger. In some embodiments, the fluid manifold injects the fluid tangential to the surface of the heat exchanger. In some embodiments, the fluid manifold is coupled with the top, horizontal edge of the heat exchanger. The multiple apertures may be formed as gaps between the fluid manifold and the heat exchanger.

Some embodiments of the system include an air compressor that pressurizes the fluid that the fluid manifold injects through the multiple apertures between the surface of the heat exchanger and the ice sheet formed on the surface of the heat exchanger.

Some embodiments include a liquid manifold that includes multiple apertures such that a liquid flows through the multiple apertures and down the surface of the heat exchanger to form the ice sheet on the heat exchanger from water in the liquid.

In some embodiments of the system, the surface of the heat exchanger includes an oleophilic surface. In some embodiments, the liquid includes an emulsion.

Some embodiments include a method that may include: forming an ice sheet on a surface of a heat exchanger; injecting a fluid between the surface of the heat exchanger and the ice sheet formed on the surface of the heat exchanger; and harvesting the ice sheet from the cold surface. In some embodiments, injecting the fluid between the surface of the heat exchanger and the ice sheet formed on the heat exchanger includes using a fluid manifold with multiple apertures to inject the fluid between the surface of the heat exchanger and the ice sheet formed on the surface of the heat exchanger. In some embodiments, injecting the fluid between the surface of the heat exchanger and the ice sheet formed on the surface of the heat exchanger includes using one or more nozzles. In some embodiments, the fluid manifold is coupled with a top, horizontal edge of the heat exchanger. The multiple apertures of the fluid manifold may be formed as gaps between the fluid manifold and the heat exchanger.

In some embodiments of the method, injecting the fluid between the surface of the heat exchanger and the ice sheet formed on the surface of the heat exchanger includes injecting the fluid along a top, horizontal edge of the heat exchanger.

Some embodiments of the method include utilizing an air compressor to pressurize the fluid injected between the surface of the heat exchanger and the ice sheet formed on the surface of the heat exchanger.

In some embodiments of the method, injecting the fluid between the surface of the heat exchanger and the ice sheet formed on the surface of the heat exchanger includes injecting the fluid tangential to the surface of the heat exchanger.

In some embodiments of the method, injecting the fluid between the surface of the heat exchanger and the ice sheet formed on the surface of the heat exchanger occurs with the ice sheet subcooled. In some embodiments, the subcooled ice sheet at least partially cleaves away from the heat exchanger prior to injecting the fluid between the surface of the heat exchanger and the ice sheet formed on the surface of the heat exchanger.

In some embodiments of the method, forming the ice sheet on the surface of the heat exchanger includes flowing a liquid down the surface of the heat exchanger. In some embodiments, the surface of the heat exchanger includes an oleophilic surface. In some embodiments, the liquid includes an emulsion. Some embodiments of the system include: curtailing the flow of the liquid down the surface of the heat exchanger; and subcooling the ice sheet formed on the surface of the heat exchanger with the flow of the liquid curtailed.

Methods, systems, and devices for cold oleophilic surfaces that produce harvestable ice are provided in accordance with various embodiments. Some embodiments pertain to the formation of ice plates on oleophilic surfaces with improved harvestability. The improved harvestability may be due to the higher degree of edge definition of the ice plate on the oleophilic surface. By controlling the features on the surface, the ice formed on the surface may be harvested more easily.

Some embodiments include a system that may include: a first metal sheet of a heat exchanger; a second metal sheet of the heat exchanger, wherein the first metal sheet of the heat exchanger is coupled with the second metal sheet of the heat exchanger; and one or more air gaps formed between the first metal sheet of the heat exchanger and the second metal sheet of the heat exchanger that run along at least a length of a base of the heat exchanger or a side of the heat exchanger. In some embodiments, the one or more air gaps extend to one or more edges of the first metal sheet of the heat exchanger and the second metal sheet of the heat exchanger to create one or more exterior openings between the first metal sheet of the heat exchanger and the second metal sheet of the heat exchanger. Some embodiments include one or more weld seals between the first metal sheet of the heat exchanger and the second metal sheet of the heat exchanger, wherein the one or more weld seals form one or more boundaries of the one or more air gaps.

Some embodiments of the system include multiple dimples formed with respect to the first metal sheet of the heat exchanger and the second metal sheet of the heat exchanger.

The multiple dimples formed with respect to the first metal sheet of the heat exchanger and the second metal sheet of the heat exchanger may include multiple weld points between the first metal sheet of the heat exchanger and the second metal sheet of the heat exchanger. The one or more air gaps formed between the first metal sheet of the heat exchanger and the second metal sheet of the heat exchanger may be devoid of dimples.

Some embodiments of the system include an inlet port that delivers a refrigerant to the heat exchanger and an outlet port that removes the refrigerant from the heat exchanger. Some embodiments include one or more shields coupled with at least the first metal sheet of the heat exchanger or the second metal sheet of the heat exchanger and positioned between at least the inlet port or the outlet port and the multiple dimples formed with respect to the first metal sheet of the heat exchanger and the second metal sheet of the heat exchanger. The one or more shields may include one or more plates coupled with at least the first metal sheet of the heat exchanger or the second metal sheet of the heat exchanger to form a V-shaped shield with respect to at least the inlet port of the heat exchanger or the outlet port of the heat exchanger. The V-shaped shield may include a convex V-shaped shield, a flat V-shaped shield, or a concave V-shaped shield, for example.

Some embodiments include a method that may include coupling a first metal sheet of a heat exchanger with a second metal sheet of a heat exchanger along a continuous length of the first metal sheet of the heat exchanger and a continuous length of the second metal sheet of the heat exchanger forming at border area between the continuous length of the first metal sheet and an edge of the first metal sheet and a border area between the continuous length of the second metal sheet and an edge of the second metal sheet. In some embodiments, one or more air gaps are formed between the border area between the continuous length of the first metal sheet and the edge of the first metal sheet and the border area between the continuous length of the second metal sheet and the edge of the second metal sheet. The one or more air gaps may run along at least a length of a base of the heat exchanger or a side of the heat exchanger. Some embodiments include coupling the first metal sheet of the heat exchanger with the second metal sheet of the heat exchanger at multiple discrete locations to form multiple dimples with respect to the first metal sheet of the heat exchanger and the second metal sheet of the heat exchanger. In some embodiments, the one or more air gaps formed between the first metal sheet of the heat exchanger and the second metal sheet of the heat exchanger are devoid of dimples.

Some embodiments of the method include coupling an inlet port with the heat exchanger that delivers a refrigerant to the heat exchanger and an outlet port that removes the refrigerant from the heat exchanger. Some embodiments include coupling one or more shields with at least the first metal sheet of the heat exchanger or the second metal sheet of the heat exchanger and positioned between at least the inlet port or the outlet port and the multiple dimples formed with respect to the first metal sheet of the heat exchanger and the second metal sheet of the heat exchanger. The one or more shields may include one or more plates coupled with at least the first metal sheet of the heat exchanger or the second metal sheet of the heat exchanger to form a V-shaped shield with respect to at least the inlet port of the heat exchanger or the outlet port of the heat exchanger. The V-shaped shield may include a convex V-shaped shield, a flat V-shaped shield, or a concave V-shaped shield, for example.

Methods, systems, and devices for ice maker fault detection and recovery are also provided in accordance with various embodiments. For example, some embodiments pertain to ice maker controls. Some embodiments relate to detecting faults in ice maker operation and recovering from those faults.

Some embodiments include a method that may include: flowing a liquid down a surface of a heat exchanger; forming ice on the surface of the heat exchanger from water in the liquid flowing down the surface of the heat exchanger; detecting a fault using a controller; curtailing the liquid flowing down the surface of the heat exchanger in response to detecting the fault using the controller; removing a refrigerant from the heat exchanger after curtailing the liquid flowing down the surface of the heat exchanger in response to detecting the fault using the controller; and/or flowing the liquid down the surface of the heat exchanger with the refrigerant removed from the heat exchanger.

Some embodiments of the method include heating the liquid that flows down the surface of the heat exchanger with the refrigerant removed from the heat exchanger. Heating the liquid that flows down the surface of the heat exchanger with the refrigerant removed from the heat exchanger may include heating the liquid in a tank from which a pump delivers the liquid to the surface of the heat exchanger. Some embodiments include heating the liquid that flows down the surface of the heat exchanger utilizing hot refrigerant inside the heat exchanger.

In some embodiments of the method, detecting the fault using the controller further includes measuring a suction pressure of the refrigerant from the heat exchanger, wherein the suction pressure indicates the fault.

Some embodiments of the method include: flowing the refrigerant to the heat exchanger after flowing the liquid to the heat exchanger with the refrigerant removed from the heat exchanger; and resuming the flow of the liquid down the surface of the heat exchanger to form an ice sheet on the surface of the heat exchanger.

In some embodiments of the method, flowing the liquid down the surface of the heat exchanger forms a liquid film over the heat exchanger. Forming the ice on the surface of the heat exchanger may include forming the ice under the liquid film over the heat exchanger.

In some embodiments of the method, the liquid includes an emulsion. In some embodiments, the surface of the heat exchanger includes an oleophilic surface.

Some embodiments of the method include: curtailing the flow of the liquid down the surface of the heat exchanger after forming the ice on the surface of the heat exchanger; subcooling the ice on the surface of the heat exchanger after curtailing the flow of the liquid down the surface of the heat exchanger; and harvesting the ice through the ice sheet, which is subcooled on the surface of the heat exchanger, falling away from the surface of the heat exchanger.

Methods, systems, and devices for ice maker startup are provided in accordance with various embodiments. Some embodiments provide ice maker controls. For example, some embodiments relate to the startup of an ice maker that uses an oleophilic cold surface from a warm state through normal operation.

Some embodiments include a method that may include: flowing a refrigerant to a heat exchanger; adjusting a compressor such that a pressure of the refrigerant flowing from the heat exchanger is above a pressure corresponding with a freezing point of water; flowing a liquid down the surface of the heat exchanger; curtailing the flow of the liquid down the surface of the heat exchanger; adjusting the compressor such that the pressure of the refrigerant flowing from the heat exchanger is below a pressure corresponding with the freezing point of water; flowing the liquid down the surface of the heat exchanger after adjusting the compressor such that the pressure of the refrigerant flowing from the heat exchanger is below the pressure corresponding with the freezing point of water; and/or forming an ice sheet on the heat exchanger from water in the liquid flowing down the surface of the heat exchanger.

Some embodiments of the method include: measuring a temperature of the liquid; and where curtailing the flow of the liquid down the surface of the heat exchanger is based on the measured temperature of the liquid. Some embodiments include: flowing the refrigerant through a surge drum to reach the heat exchanger; and flowing the refrigerant from the heat exchanger back to the surge drum. In some embodiments of the method, flowing the liquid down the surface of the heat exchanger forms a liquid film over the surface of the heat exchanger. In some embodiments, forming the ice sheet on the surface of the heat exchanger includes forming the ice sheet under the liquid film over the surface of the heat exchange.

In some embodiments of the method, the liquid includes an emulsion. In some embodiments, the surface of the heat exchanger includes an oleophilic surface.

Some embodiments of the method include: curtailing the flow of the liquid down the surface of the heat exchanger after forming the ice sheet on the surface of the heat exchanger; subcooling the ice sheet on the surface of the heat exchanger after curtailing the flow of the liquid down the surface of the heat exchanger; and harvesting the ice sheet through the ice sheet, which is subcooled on the surface of the heat exchanger, falling away from the surface of the heat exchanger.

Some embodiments include methods, systems, and/or devices as described in the specification and/or shown in the figures.

The foregoing has outlined rather broadly the features and technical advantages of embodiments according to the disclosure in order that the detailed description that follows may be better understood. Additional features and advantages will be described hereinafter. The conception and specific embodiments disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of different embodiments may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1A:
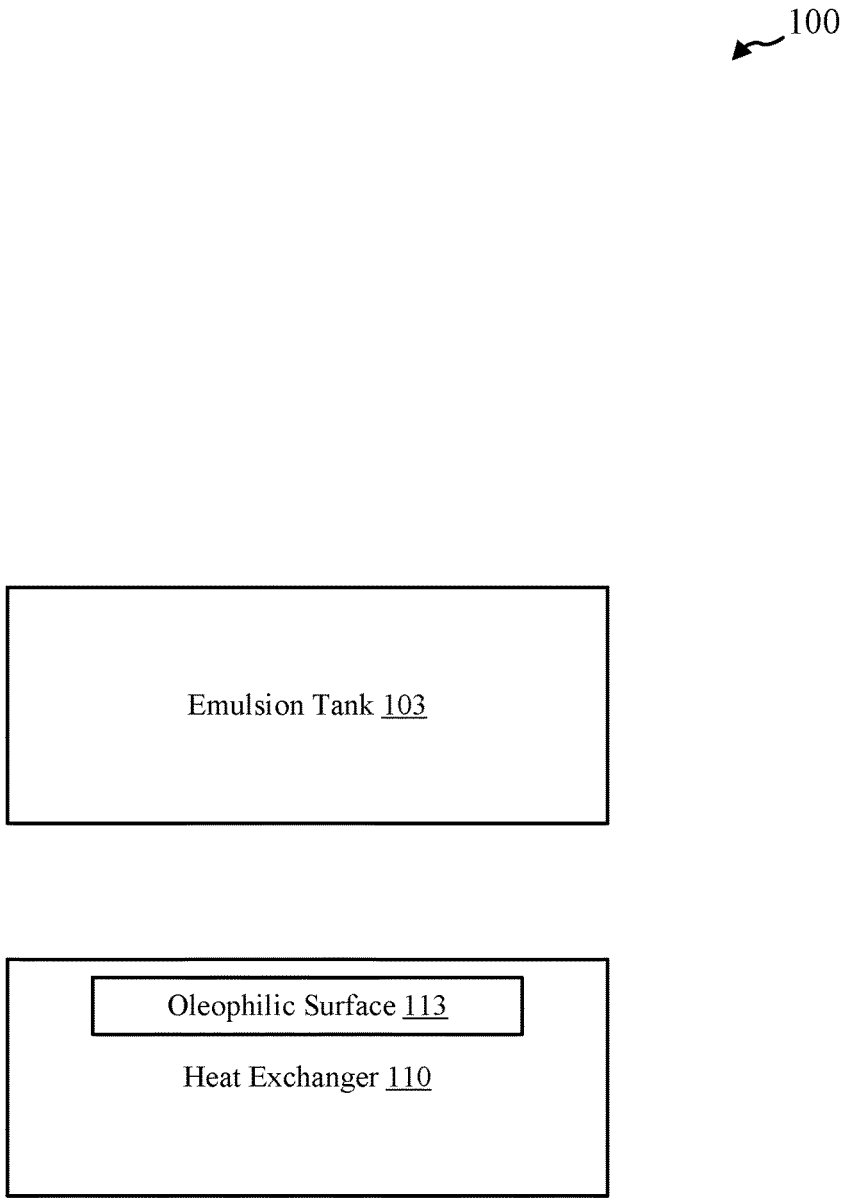
FIG. 1A shows a system and/or device in accordance with various embodiments.

This description provides embodiments, and is not intended to limit the scope, applicability, or configuration of the disclosure. Rather, the ensuing description will provide those skilled in the art with an enabling description for implementing embodiments of the disclosure. Various changes may be made in the function and arrangement of elements.

Thus, various embodiments may omit, substitute, or add various procedures or components as appropriate. For instance, it should be appreciated that the methods may be performed in an order different than that described, and that various stages may be added, omitted or combined. Also, aspects and elements described with respect to certain embodiments may be combined in various other embodiments. It should also be appreciated that the following systems, devices, and methods may individually or collectively be components of a larger system, wherein other procedures may take precedence over or otherwise modify their application.

Solid production systems, devices, and methods utilizing oleophilic surfaces in accordance with various embodiments are provided. For example, some embodiments utilize a self-forming solid-liquid hybrid oleophilic surface. Embodiments generally pertain to the field of refrigeration and heat pumping. Within that field, the embodiments generally apply to the creation of ice or other solids.

Some embodiments include a machine used for the production of ice from water, for example. Some embodiments utilize material combinations and deliberate controlled mixing of those materials to produce ice that can be harvested easily and efficiently.

Some embodiments include a water tank used to store fresh water. Some embodiments include an emulsion tank with a set of auxiliary components that may be utilized to create and pump an emulsion. This auxiliary equipment may include precise level suction headers, ejectors, pumps, mechanical mixers, and or hydrodynamic mixers. Some embodiments include a heat exchanger that may produce a cold surface for ice formation. This surface may include a permanent oleophilic coating that may produce a permanent affinity for oils and/or other non-polar materials. Some embodiments include piping that may allow for the connection of the other components such that ice may be formed from a flow of water and the overflow may be returned to the emulsion tank.

Some embodiments include a method of ice making, or solid making more generally, that may include the following. The emulsion tank may contain a set amount of oil and water. The level of this tank may be maintained by a water tank. As ice is formed from water in the emulsion tank, water may flow from the water tank to maintain the level in the emulsion tank. Emulsion may be formed by the emulsion tank and may be pumped to the cold surface of the heat exchanger. On the cold surface, a balance between two forces may form a thin layer of oil between the water and the oleophilic coating; the shear force of the falling film of emulsion may thin the oil layer, while the surface tension force of the oleophilic coating may grow the oil layer. These forces may balance each other such that a thin layer of oil may be formed. Ice may grow on this oil layer as the water cools and solidifies; this solidification process may break the emulsion and a pure water ice may be formed. Once the ice has grown sufficiently, the flow of water may be stopped; the ice may then be subcooled by the cold surface below its freezing point and the resulting thermal stress may cause the ice to fall off. The emulsion pump may be started again and the process may repeat.

Some embodiments include the creation of a distribution of water in a falling film over a cold plate for the creation of ice. Some embodiments allow for the manipulation of that falling film to produce an uneven flow of water such that the sheet of ice produced on the cold plate may have beneficial characteristics that allow it to be harvested. For example, some embodiments include a water header system that may provide for the application of a controlled film of liquid over a cold plate. The distribution and application of water onto the plate may create beneficial conditions to grow harvestable sheets of ice. Examples of such systems, devices, and/or methods are provided below with respect to FIG. 6. These examples may be integrated and/or otherwise provided with respect to the systems, devices, and/or methods described with respect to FIGS. 1-5. These examples may also be integrated and/or otherwise provided with respect to the systems, devices, and/or methods described with respect to FIGS. 7-9.

Some embodiments pertain to the removal of ice from a cold surface with the assistance of a hydrodynamic force. For example, some embodiments are utilized with cold surfaces that may produce ice that peels or cleaves away from the surface to form a progressing gap between the ice and the surface. A fluid may then be applied into this gap to speed the process of ice removal. Some embodiments include a fluid harvester for the rapid removal of ice from a cold surface with an oleophilic coating. This type of cold surface generally produces ice that cleaves or peels away from the surface as a cohesive plane of solid. This solid may create a gap between the surface and ice as it cleaves, creating an opportunity for fluid to be applied to assist the harvesting of the ice. Examples of such systems, devices, and/or methods are provided below with respect to FIG. 7. These examples may be integrated and/or otherwise provided with respect to the systems, devices, and/or methods described with respect to FIGS. 1-5. These examples may also be integrated and/or otherwise provided with respect to the systems, devices, and/or methods described with respect to FIGS. 6, 8, and/or 9.

Some embodiments pertain to the formation of ice plates on oleophilic surfaces with improved harvestability. The improved harvestability may be due to the higher degree of edge definition of the ice plate on the oleophilic surface. By controlling the features on the surface, the ice formed on the surface may be harvested more easily. Examples of such systems, devices, and/or methods are provided below with respect to FIG. 8. These examples may be integrated and/or otherwise provided with respect to the systems, devices, and/or methods described with respect to FIGS. 1-5. These examples may also be integrated and/or otherwise provided with respect to the systems, devices, and/or methods described with respect to FIGS. 6, 7, and/or 9.

Some embodiments relate to systems of ice making using oleophilic cold surfaces, tanks storing a water-oil emulsion, a water pump, and a subcooling based harvest technique produced by stopping the water flow over the plate. The controls of these systems may involve the monitoring of a refrigerant pressure at the suction side of the plate and/or surge drum and/or manipulating a vapor compression refrigeration system based on these measurements. Examples of such systems, devices, and/or methods are provided below with respect to FIG. 9. These examples may be integrated and/or otherwise provided with respect to the systems, devices, and/or methods described with respect to FIGS. 1-5. These examples may also be integrated and/or otherwise provided with respect to the systems, devices, and/or methods described with respect to FIGS. 6-8.

Some embodiments include a system of ice making using oleophilic cold surfaces, tanks storing a water-oil emulsion, a water pump, and a sub-cooling based harvest technique produced by stopping the water flow over the plate. The controls for these systems generally involve an electronic controller, pressure sensors, levels sensors, and/or temperature sensors across the water and refrigerant equipment. Examples of such systems, devices, and/or methods are provided below with respect to FIG. 9. These examples may be integrated and/or otherwise provided with respect to the systems, devices, and/or methods described with respect to FIGS. 1-5. These examples may also be integrated and/or otherwise provided with respect to the systems, devices, and/or methods described with respect to FIGS. 6-8.

Turning now to FIG. 1A, a system 100 in accordance with various embodiments is provided. System 100 may be referred to as an ice making system, or more generally, a solid making system. System 100 may include an emulsion tank 103 and a heat exchanger 110 with an oleophilic surface 113. System 100 may be utilized for ice making, or more generally, solid making. System 100 may be configured such that an emulsion from the emulsion tank 103 flows down the oleophilic surface 113 to form an oil layer on the oleophilic surface 113 and to form ice on the oil layer.

Some embodiments of system 100 include a pump that delivers the emulsion from the emulsion tank 103 to the oleophilic surface 113 of the heat exchanger 110. Some embodiments include a water tank coupled with the emulsion tank 103 to provide water to the emulsion tank 103. Some embodiments include a suction port positioned with respect to the emulsion tank 103 and the pump to remove water and oil from the emulsion tank 103 to form the emulsion delivered to the oleophilic surface 113 of the heat exchanger 110. The suction port may be at a defined height. Examples of suction port may include, but are not limited to, a wall port or a suction header. Some embodiments include an ejector positioned with respect to the emulsion tank 103 and the pump to mix water and oil from the emulsion tank 103 to form the emulsion delivered to the oleophilic surface 113 of the heat exchanger 110. Some embodiments include a mixer positioned with respect to the emulsion tank 103 and the pump to mix water and oil from the emulsion tank 103 to form the emulsion delivered to the oleophilic surface 113 of the heat exchanger 110.

Some embodiments of the system 100 include the emulsion. In some embodiments, the emulsion includes water and oil. In some embodiments, the oleophilic surface 113 of the heat exchanger 110 is vertically oriented such that the emulsion flows down the oleophilic surface 113 of the heat exchanger 110. In some embodiments, the oleophilic surface 113 of the heat exchanger 110 includes at least PTFE, FEP, Polyethylene, Nylon, Acetal, PVDF, Silicone, or an oleophilic plastic. The oleophilic surface 113 may form a coating of the heat exchanger 110. In some embodiments, the oil includes at least a hydrocarbon oil, a fluorocarbon oil, and a silicone oil.

Figure 1B:
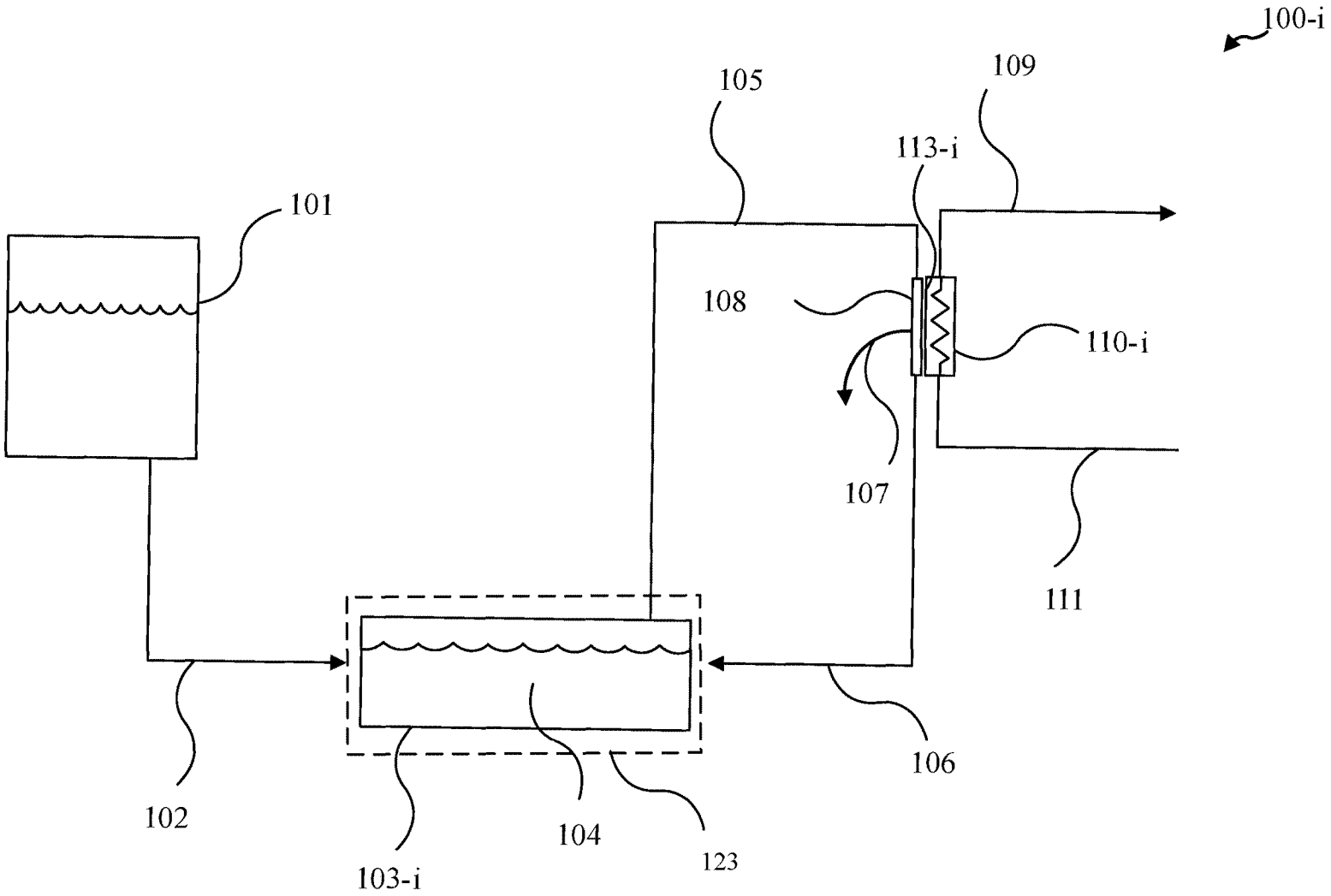
FIG. 1B shows a system and/or device in accordance with various embodiments.

FIG. 1B shows a system 100-*i* in accordance with various embodiments. System 100-*i* may be an example of system 100 of FIG. 1A. A tank 101 may feed an emulsion tank 103-*i* with water 102, which may include fresh water, for example. Emulsion tank 103-*i* may form part of an emulsion tank configuration 123, which may include one or more additional components that may facilitate the formation of emulsion 104. The emulsion tank 103-*i* may contain the emulsion 104 that may flow 105 to an evaporator 110-*i*, as an example of a heat exchanger, with an oleophilic surface 113-*i* where it may form ice 108, which may be pure ice. System 100-*i* may be configured such that emulsion 104 flows down the oleophilic surface 113-*i* to form an oil layer on the oleophilic surface 113-*i* and to form the ice 108 on the oil layer; the oil layer may be represented by the gap shown between the ice 108 and the oleophilic surface 113-*i*. The emulsion flow 106 that may not be separated and may not freeze may return to the emulsion tank 103-*i*. The ice 108 may be formed until it may be of a desired thickness and then may be harvested by falling off 107. The evaporator 110-*i* may be cooled by a supply of refrigerant 111, which may boil absorbing heat and may leave as a gas 109.

In some embodiments, the emulsion tank configuration 123 may include a pump that delivers the emulsion 104 from the emulsion tank 103-*i* to the oleophilic surface 113-*i* of the heat exchanger 110-*i*. Some embodiments of the emulsion tank configuration 123 include a suction port positioned with respect to the emulsion tank 103-*i* and the pump to remove water and oil from the emulsion tank 103-*i* to form the emulsion 105 delivered to the oleophilic surface 113-*i* of the heat exchanger 110-*i*. The suction port may be at a defined height. Examples of suction ports may include, but are not limited to, a wall port or a suction header. Some embodiments of the emulsion tank configuration 123 include an ejector positioned with respect to the emulsion tank 103-*i* and the pump to mix water and oil from the emulsion tank 103-*i* to form the emulsion 105 delivered to the oleophilic surface 113-*i* of the heat exchanger 110-*i*. Some embodiments of the emulsion tank configuration 123 include a mixer positioned with respect to the emulsion tank 103-*i* and the pump to mix water and oil from the emulsion tank 103-*i* to form the emulsion 105 delivered to the oleophilic surface 113-*i* of the heat exchanger 110-*i*.

In some embodiments, the emulsion tank 103-*i* may be positioned and/or configured such that the emulsion 105 is gravity fed to the oleophilic surface 113-*i*. In this configuration, a pump (which may be part of emulsion tank configuration 123) could be utilized to direct emulsion flow 106 back to emulsion tank 103-*i*.

As may be shown in system 100-*i*, the oleophilic surface 113-*i* of the heat exchanger 110-*i* may be vertically oriented such that the emulsion 105 flows down the oleophilic surface 113-*i* of the heat exchanger 110-*i*. In some embodiments, the oleophilic surface 113-*i* of the heat exchanger 110-*i* includes at least PTFE, FEP, Polyethylene, Nylon, Acetal, PVDF, Silicone, or another oleophilic plastic. The oleophilic surface 113-*i* may form a coating on the heat exchanger 110-*i*. In some embodiments, the oil of emulsion 105 includes at least a hydrocarbon oil, a fluorocarbon oil, and a silicone oil.

Figure 2A:
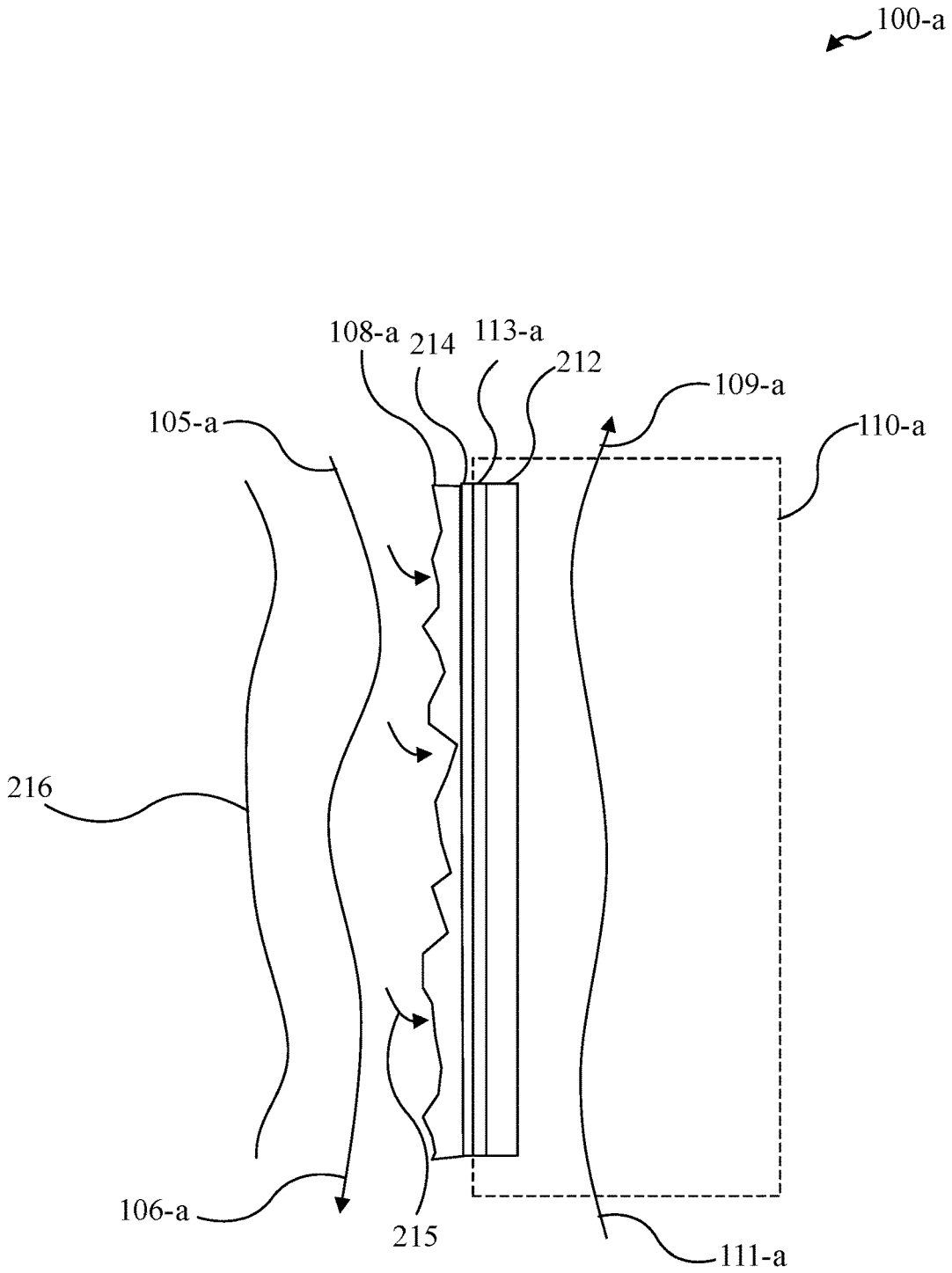
FIG. 2A show a system and/or device in accordance with various embodiments.

FIG. 2A shows a system 100-*a* that may be an example of aspects of system 100 of FIG. 1A and/or system 100-*i* of FIG. 1B. In particular, system 100-*a* may include an evaporator's cold surface during ice growth. An evaporator 110-*a* may have a refrigerant liquid 111-*a* flowing into it and leaving as a gas 109-*a*. A metal surface 212 of the evaporator 110-*a* may be coated in an oleophilic coating to form an oleophilic surface 113-*a*. When operating, this surface 212 and/or 113-*a* may create a surface energy condition that may cause a thin film of oil 214 to form on the surface 212 and/or 113-*a*. The surface tension/energy condition may cause this film to grow while the shear created by the falling film of emulsion 216 flowing into 105-*a* and falling off 106-*a* the surface 212 and/or 113-*a* may cause the film to shrink. The balance of these forces may control the thickness. As ice 108-*a* grows on the oil coated surface 212 and/or 113-*a*, it may pull water 215, which may be pure, out of the emulsion 216 as the oil may be precluded from the crystal structure of the ice 108-*a*.

Figure 2B:
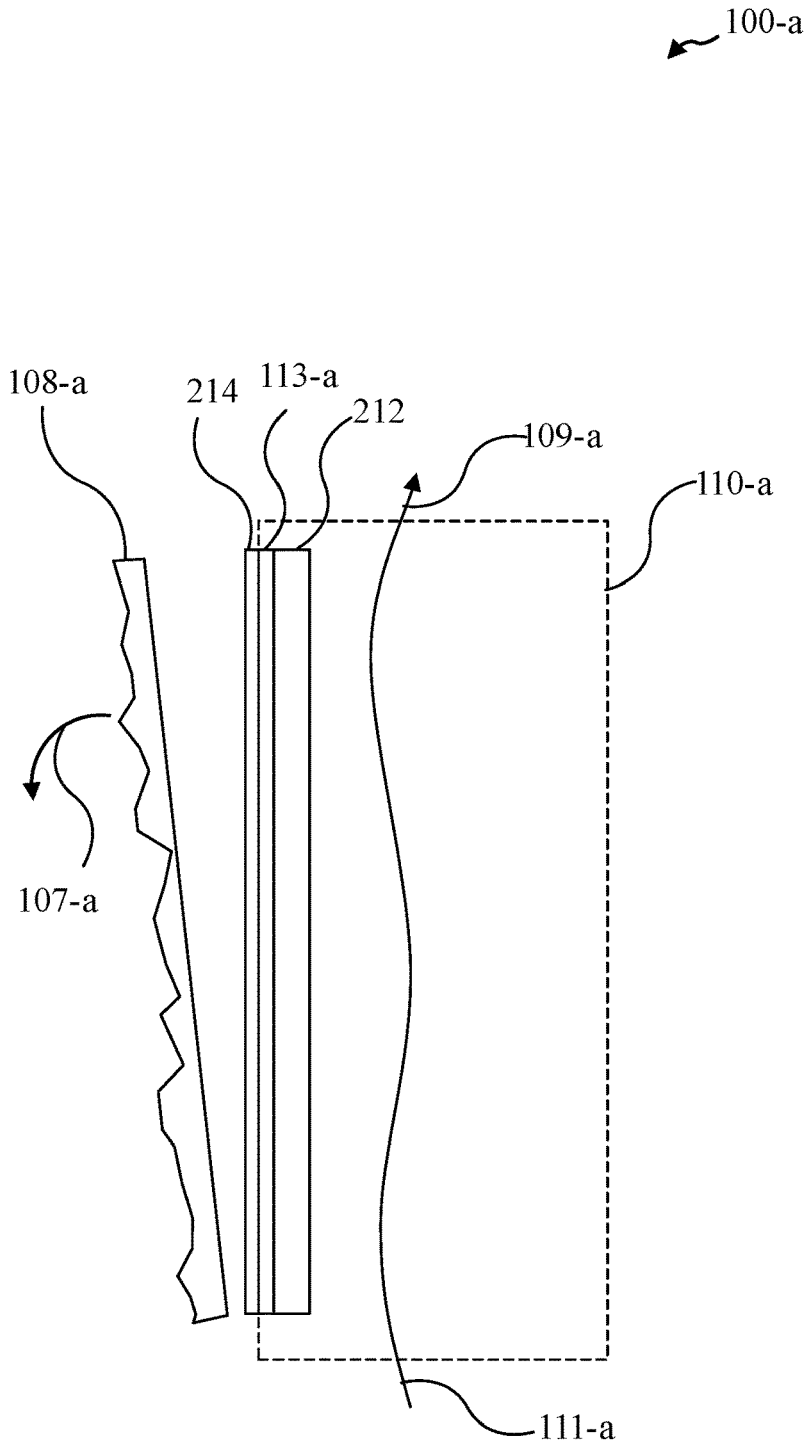
FIG. 2B shows a system and/or device in accordance with various embodiments.

FIG. 2B provides details of system 100-*a* that may reflect the evaporator's cold surface during ice harvest in accordance with various embodiments. The evaporator 110-*a* may have the refrigerant liquid 111-*a* flowing into it and leaving as gas 109-*a*. The metal surface 212 of the evaporator 110-*a* may include the oleophilic surface 113-*a*. To harvest the ice 108-*a*, the flow of emulsion may be curtailed while the flow of refrigerant continues. As the ice 108-*a*, which may start at 0° C. for example, may be cooled further (i.e., subcooled) to temperatures below 0° C., −10° C. for example, by the refrigerant 111-*a*, it may create thermal stress at the ice-oil interface that may cause the sheet of ice 108-*a* to fall away 107-*a* from the evaporator surface 212 and/or oleophilic surface 113-*a*. In some embodiments, surface 212 and oleophilic surface 113-*a* of evaporator 110-*a* are integrated to form an integrated surface that may not be distinguishable as two separate surfaces.

Figure 3A:
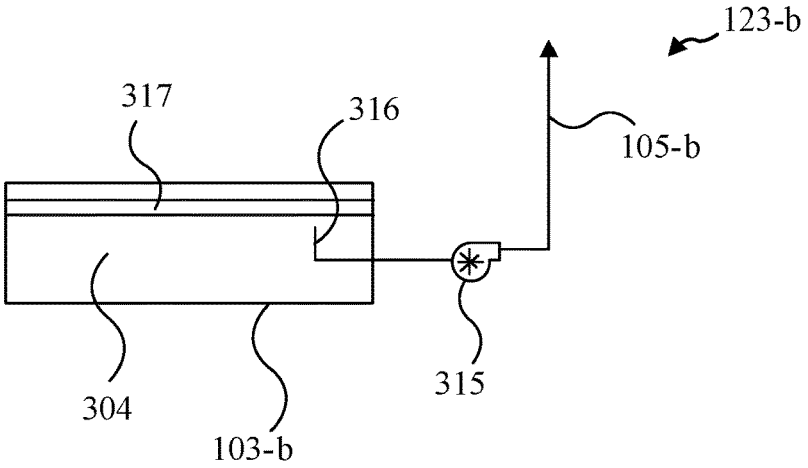
FIG. 3A shows aspects of a system and/or device in accordance with various embodiments.

Turning now to FIG. 3A, an emulsion tank configuration 123-*b* with an emulsion tank 103-*b* is provided in accordance with various embodiments. The tank 103-*b* may include two liquids: a light emulsion and/or water 304 and a layer of free lighter-than-water oil 317. A pump 315 may remove liquid from the tank 103-*b* via a suction port, such as suction header 316, with a precise height of liquid separating it from the free oil 317; some embodiments utilize a wall port or other suction ports. This height may be chosen by selecting a port diameter, overall flow rate, height of separation from free oil, and/or flow geometry such that the port inlet velocity and port inlet's flow profile may bring in a mixture of free oil 317 and light emulsion and/or water 304 to create a heavy emulsion 105-*b*, which may be sent to an evaporator or other heat exchanger (such as heat exchangers 110 of FIG. 1A, FIG. 1B, FIG. 2A, and/or FIG. 2B).

Figure 3B:
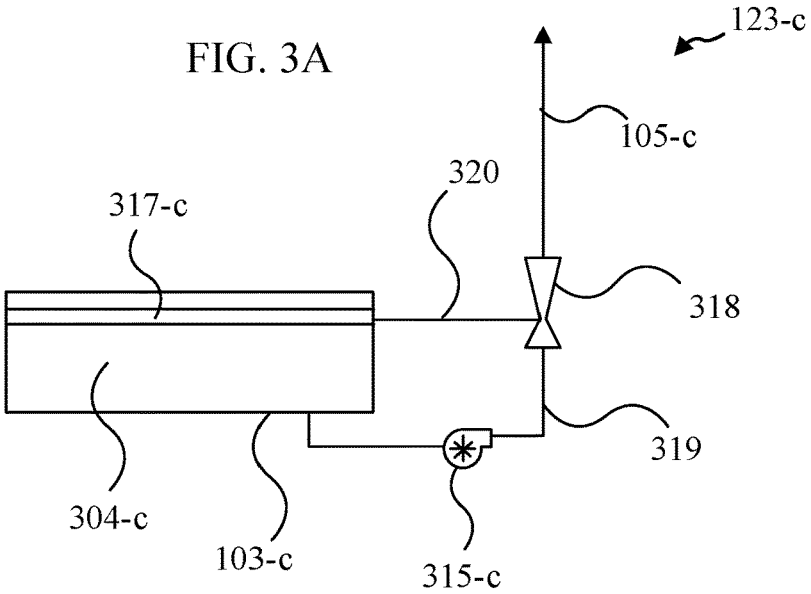
FIG. 3B shows aspects of a system and/or device in accordance with various embodiments.

FIG. 3B provides another emulsion tank configuration 123-*c* with an emulsion tank 103-*c* in accordance with various embodiments. The tank 103-*c* may include two liquids: a light emulsion and/or water 304-*c* and a layer of free lighter-than-water oil 317-*c*. A pump 315-*c* may remove liquid from the tank 103-*c* and may send it via a line 319 to an ejector 318, which may create suction on a line 320 that may be connected to the tank 103-*c* at a height that may allow it to suck in a significant amount of free oil. Inside the ejector 318, the two lines may mix and a heavy emulsion 105-*c* may be formed, which may be sent to an evaporator or other heat exchanger (such as heat exchangers 110 of FIG. 1A, FIG. 1B, FIG. 2A, and/or FIG. 2B).

Figure 3C:
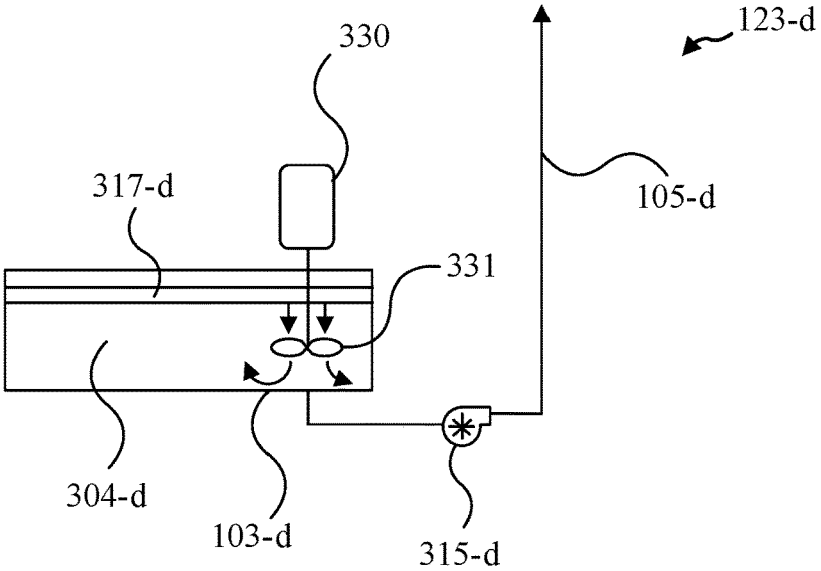
FIG. 3C shows aspects of a system and/or device in accordance with various embodiments.

FIG. 3C provides another emulsion tank configuration 123-*d* with an emulsion tank 103-*d* in accordance with various embodiments. The tank 103-*d* may include two liquids: a light emulsion and/or water 304-*d* and a layer of free lighter-than-water oil 317-*d*. A mechanical mixer 330 with a paddle 331 that may pull liquid down from the free oil layer 317-*d* may be positioned over the suction line of a pump 315-*d*, which removes liquid from the tank 103-*d*. The pump 315-*d* may suck both free oil 317-*d* and light emulsion and/or water 304-*d* and may form a heavy emulsion 105-*d*, which may be sent to an evaporator or other heat exchanger (such as heat exchangers 110 of FIG. 1A, FIG. 1B, FIG. 2A, and/or FIG. 2B).

In general, configurations 123-*b*, 123-*c*, and/or 123-*d* may include a lighter-than-water oil, such as hydrocarbon oil or silicone oil. Configurations 123-*b*, 123-*c*, and/or 123-*d* may be shown in an initial state with respect to the layers 304 and 317 shown, but may form a more mixed emulsion over time, such as emulsion 104 shown with respect to FIG. 1B, for example. Configurations 123-*b*, 123-*c*, and/or 123-*d* may be examples of aspects of system 100 of FIG. 1A and/or system 100-*i* of FIG. 1B and may be integrated with systems such as system 100-*a* of FIG. 2A and/or FIG. 2B.

Figure 4A:
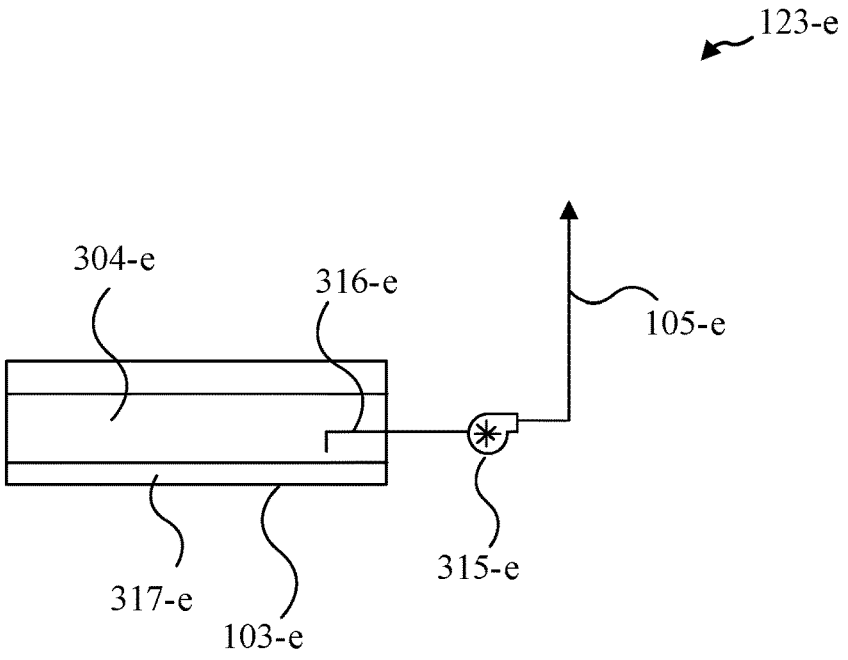
FIG. 4A shows aspects of a system and/or device in accordance with various embodiments.

Turning now to FIG. 4A, an emulsion tank configuration 123-*e* with an emulsion tank 103-*e* is provided in accordance with various embodiments. The tank 103-*e* may include two liquids: a light emulsion and/or water 304-*e* and a layer of free heavier-than-water oil 317-*e*. A pump 315-*e* may remove liquid from the tank 103-*e* via a suction header 316-*e* with a precise height of liquid separating it from the free oil 317-*e*; some embodiments utilize a wall port or other suction ports. This height may be chosen by selecting a port diameter, overall flow rate, height of separation from free oil, and/or flow geometry such that the port inlet velocity and port inlet's flow profile may bring in a mixture of free oil 317-*e* and light emulsion and/or water 304-*e* to create a heavy emulsion 105-*e*, which can be sent to an evaporator or other heat exchanger (such as heat exchangers 110 of FIG. 1A, FIG. 1B, FIG. 2A, and/or FIG. 2B).

Figure 4B:
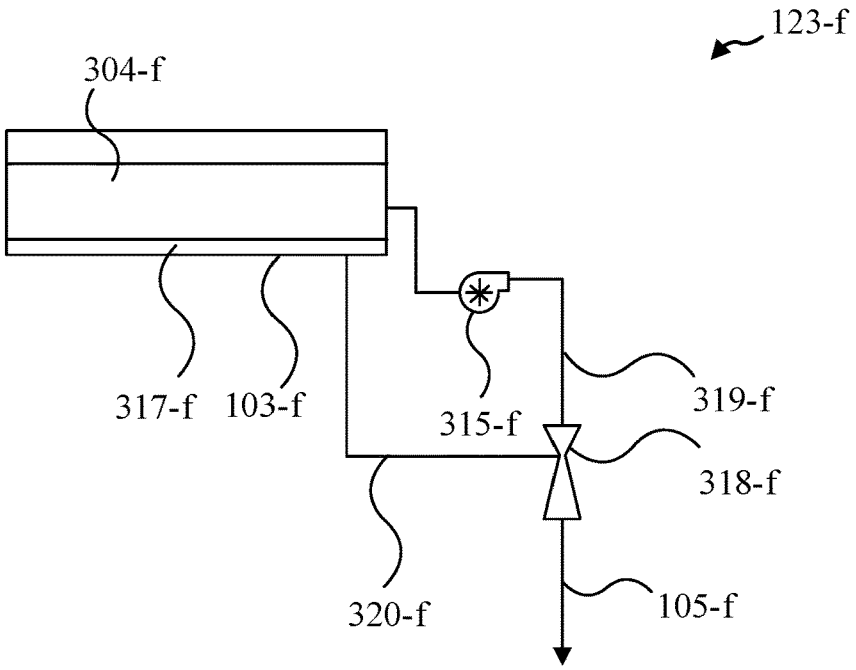
FIG. 4B shows aspects of a system and/or device in accordance with various embodiments.

FIG. 4B provides another emulsion tank configuration 123-*f* with an emulsion tank 103-*f* in accordance with various embodiments. The tank 103-*e* may include two liquids: a light emulsion and/or water 304-*f* and a layer of free heavier-than-water oil 317-*f*. A pump 315-*f* may remove liquid from the tank 103-*f* and may send it via line 319-*f* to an ejector 318-*f*, which may create suction on a line 320-*f* that may be connected to the tank 103-*f* at a height that may allow it to suck in a significant amount of free oil 317-*f*. Inside the ejector 318-*f*, the two lines may mix and a heavy emulsion 105-*f* may be formed, which can be sent to an evaporator or other heat exchanger (such as heat exchangers 110 of FIG. 1A, FIG. 1B, FIG. 2A, and/or FIG. 2B).

Figure 4C:
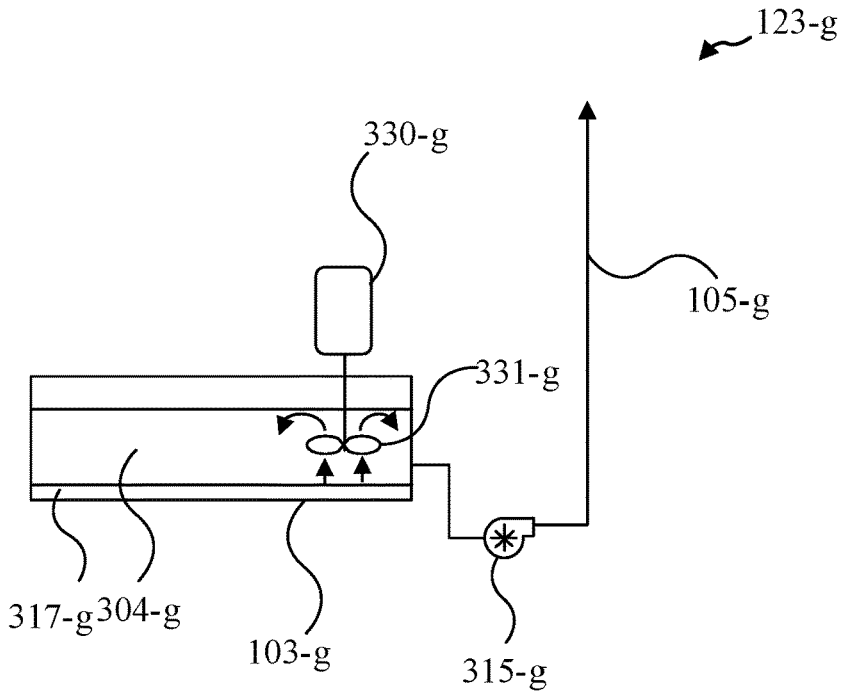
FIG. 4C shows aspects of a system and/or device in accordance with various embodiments.

FIG. 4C provides another emulsion tank configuration 123-*g* with an emulsion tank 103-*g* in accordance with various embodiments. The tank 103-*g* may include two liquids: a light emulsion and/or water 304-*g* and a layer of free heavier-than-water oil 317-*g*. A mechanical mixer 330-*g* with a paddle 331-*g*, which may pull liquid up from the free oil layer 317-*g*, may be positioned next to the suction line of a pump 315-*g*, which may remove liquid from the tank 103-*g*. The pump 315-*g* may suck both free oil 317-*g* and light emulsion and/or water 304-*g* and may form a heavy emulsion 105-*g*, which can be sent to an evaporator or other heat exchanger (such as heat exchangers 110 of FIG. 1A, FIG. 1B, FIG. 2A, and/or FIG. 2B).

Figure 4D:
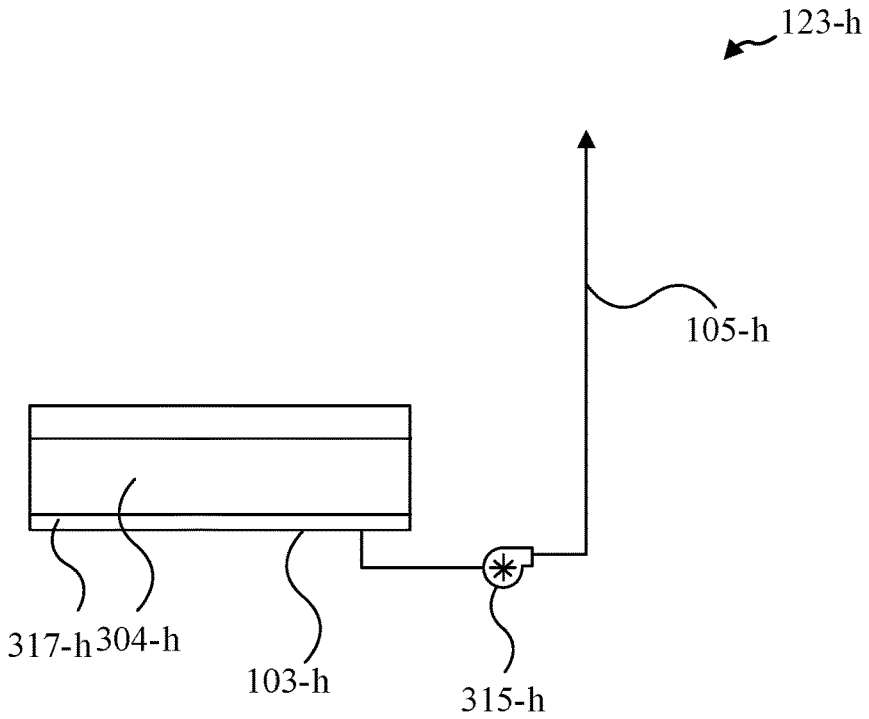
FIG. 4D shows aspects of a system and/or device in accordance with various embodiments.

FIG. 4D provides another emulsion tank configuration 123-*h* with an emulsion tank 103-*h* in accordance with various embodiments. The tank 103-*h* may include two liquids: a light emulsion and/or water 304-*h* and a layer of free heavier-than-water oil 317-*h*. A pump 315-*h* may remove liquid from the bottom of the tank 103-*h*. The oil layer 317-*h* may be of a thickness such that the pump 315-*h* pulls in both free oil 317-*h* and light emulsion and/or water 304-*h* and may form a heavy emulsion 105-*h*, which can be sent to an evaporator or other heat exchanger (such as heat exchangers 110 of FIG. 1A, FIG. 1B, FIG. 2A, and/or FIG. 2B).

In general, configurations 123-*e*, 123-*f*, 123-*g*, and/or 123-*h* may include a heavier-than-water oil, such as fluorocarbon oil. Configurations 123-*e*, 123-*f*, 123-*g*, and/or 123-*h* may be shown in an initial state with respect to the layers 304 and 317 shown, but may form a more mixed emulsion over time, such as emulsion 104 shown with respect to FIG. 1B, for example. Configurations 123-*e*, 123-*f*, 123-*g*, and/or 123-*h* may be examples of aspects of system 100 of FIG. 1A and/or system 100-*i* of FIG. 1B and may be integrated with systems such as system 100-*a* of FIG. 2A and/or FIG. 2B.

Figure 5:
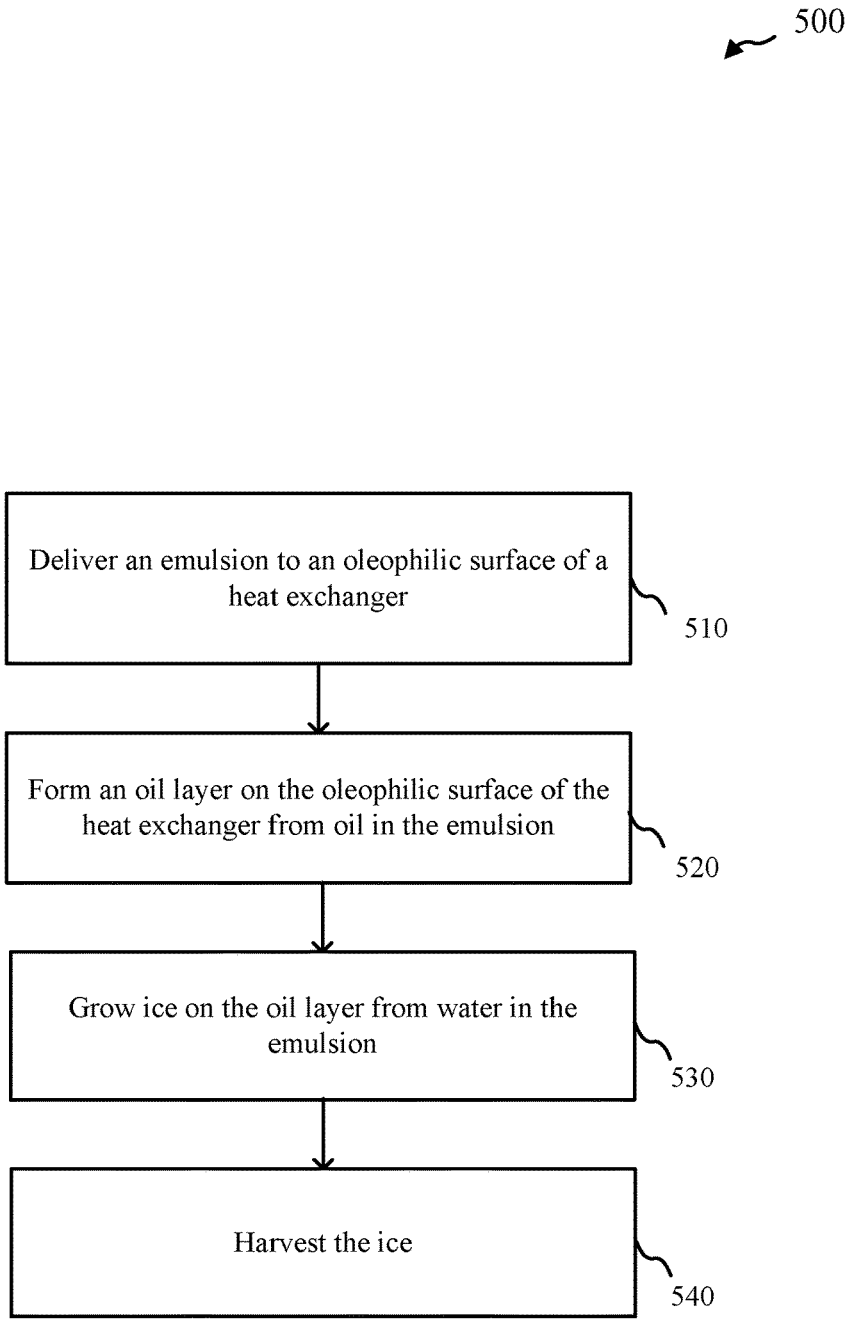
FIG. 5 shows a flow diagram of a method in accordance with various embodiments.

Turning now to FIG. 5 a flow diagram of a method 500 of ice making (or solid making more generally) is shown in accordance with various embodiments. Method 500 may be implemented utilizing a variety of systems and/or devices such as those shown and/or described with respect to FIG. 1A, FIG. 1B, FIG. 2A, FIG. 2B, FIG. 3A, FIG. 3B, FIG. 3C, FIG. 4A, FIG. 4B, FIG. 4C, and/or FIG. 4D.

At block 510, an emulsion may be delivered to an oleophilic surface of a heat exchanger. At block 520, an oil layer may be formed on the oleophilic surface of the heat exchanger from oil in the emulsion. At block 530, ice may be grown on the oil layer from water in the emulsion. At block 540, the ice may be harvested.

Some embodiments of method 500 include curtailing the delivering of the emulsion to the oleophilic surface of the heat exchanger. The ice on the oil layer may be subcooled (i.e., further cooled) after curtailing the delivering of the emulsion to the oleophilic surface of the heat exchanger; this may facilitate the harvesting of the ice.

In some embodiments of method 500, delivering the emulsion to the oleophilic surface of the heat exchanger includes flowing the emulsion down the oleophilic surface of the heat exchanger. In general, delivering the emulsion to the oleophilic surface of the heat exchanger can include flowing the emulsion across the oleophilic surface of the heat exchanger. This flowing may include spraying and/or cascading the emulsion across the oleophilic surface of the heat exchanger. In some embodiments, harvesting the ice utilizes gravity such that the ice falls away from the oleophilic surface of the heat exchanger.

Some embodiments of method 500 include pumping the emulsion from an emulsion tank to deliver the emulsion to the oleophilic surface of the heat exchanger. Some embodiments include returning a portion of the emulsion to the emulsion tank after delivering the emulsion to the oleophilic surface of the heat exchanger. Some embodiments include delivering additional water to the emulsion tank.

Some embodiments of method 500 include forming the emulsion through combining oil and water. In some embodiments, forming the emulsion through combining the oil and the water includes utilizing suction in an emulsion tank to bring the oil and the water together to form the emulsion. In some embodiments, forming the emulsion through combining the oil and the water includes pumping the water to an ejector that forms suction with respect to the oil to bring the oil and the water together to form the emulsion. In some embodiments, forming the emulsion through combining the oil and the water includes utilizing a mechanical mixer to combine the oil and the water.

In some embodiments of method 500, the oleophilic surface of the heat exchanger is vertically oriented such that the emulsion flows down the oleophilic surface of the heat exchanger. In some embodiments, the oleophilic surface of the heat exchanger includes at least PTFE, FEP, Polyethylene, Nylon, Acetal, PVDF, Silicone, or an oleophilic plastic. In some embodiments, the oil includes at least a hydrocarbon oil, a fluorocarbon oil, and a silicone oil.

A wide variety of different components and/or materials may be utilized with respect to the systems, devices, and methods described herein. Merely by way of example, an emulsion generally includes a non-solution mixture of two immiscible liquids. For example, an emulsion may include a mixture of immiscible liquids that may not be separated into two distinct contiguous phases. Instead, the two phases may be distributed throughout each other in some way. This may be in droplets that are on the order of nm up to cm or larger, for example. In general, the two liquids may be inter-mixed and may not be sitting in two contiguous phases. Examples of emulsions include, but are not limited to, water and hydrocarbon oil, water and silicone oil, water and fluorocarbon oil, and/or ethanol and silicone oil. Examples of free oil may include oil that may form a contiguous liquid body free of immiscible liquids like water. A light emulsion may include in general an emulsion that contains a small amount of oil, while a heavy emulsion may include in general an emulsion that contains a large amount of oil; for example, a light emulsion may have less oil in it than a heavy emulsion. Oleophilic surfaces generally include a surface and/or coating that attracts oils due to surface energy characteristics. Metal surfaces of heat exchangers generally include a surface composed of a metal, such as stainless steel, carbon steel, aluminum, copper, which may form a barrier of the heat exchanger. While embodiments provided refer to general heat exchangers, such as evaporators, other types of heat exchangers could be utilized, including, but not limited to, liquid cooled heat exchangers, brine cooled heat exchangers, glycol cooled heat exchangers, gas cooled heat exchangers, and/or air cooled heat exchangers.

Some embodiments also include a water header system that may provide for the application of a controlled film of liquid over a cold plate. The distribution and application of water onto the plate may create beneficial conditions to grow harvestable sheets of ice.

Ice grown on cold plates may be done using a batch-wise process. For example, water flow may be initiated, producing a film of water on the plate. Ice may be grown under a film of water. The water flow may be stopped. Some form of harvesting may be performed to release the ice from the plate.

Ice sheet harvestability is generally a function of the uniformity, consistency of the ice plate thickness across the plate, and/or the boundary conditions of the ice sheet. The boundary conditions of the ice sheet may be particularly important for ice sheet harvestability. If the boundaries do not have a uniform edge and consistent thickness, then the ice may not harvest uniformly as a cohesive sheet. Ice that may be left after harvesting may produce adverse effects for future batch-wise cycles.

The embodiments described herein generally include a manifold system (which may also be referred to as a header or distribution system) that may use hole size, shape, spacing, hydrostatic height, and/or radial position to achieve a non-uniform distribution of water that may result in a uniform and well-defined sheet of ice that may harvest consistently. In general, hole size may control the flow of water through each hole. A larger hole generally creates more flow; a smaller hole generally creates less flow. Hole shape may control the distribution of water onto the cold plate for each hole. Holes with elongated shapes may, for example, create greater distribution; holes with tighter shapes may create more defined flow paths. Hole spacing may control the amount of total flow on a section of plate. Hole hydrostatic height may control the amount of flow per hole relative to the other holes present in the distribution system and the contents of the water if any immiscible additives may be present. Radial position may control the angle that the water contacts the cold plate as well as the contents of the water if any immiscible additives may be present.

The combination of one or more of these features throughout the distribution system may make up for non-ideal natural effects of pressure drop throughout the system, refrigerant distribution in the cold plate, annealing of ice on colder parts of the cold plate, and/or water splatter.

Figure 6A:
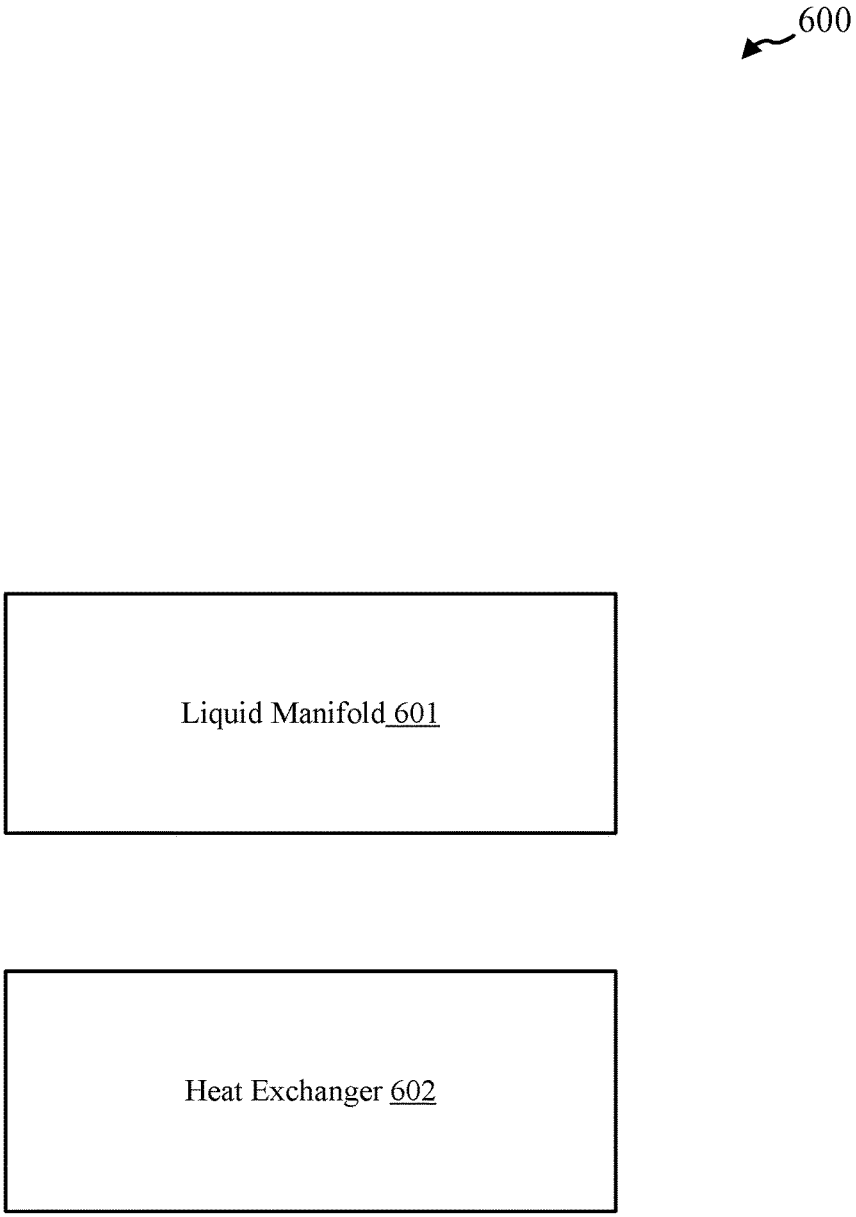
FIG. 6A shows aspects of a system and/or devices in accordance with various embodiments.

For example, FIG. 6A provides an example of a system 600 that may include: a heat exchanger 602 configured such that a refrigerant flows into and out of the heat exchanger to cool a surface of the heat exchanger 602; and a liquid manifold 601 that includes multiple apertures such that a liquid flows through the multiple apertures and down the surface of the heat exchanger 602 to form an ice sheet on the surface of the heat exchanger 602 from water in the liquid. In some embodiments, the liquid includes an emulsion. In some embodiments, the surface of the heat exchanger includes an oleophilic surface.

In some embodiments of the system 600, the multiple apertures of the liquid manifold 601 are configured with multiple sizes. The multiple sizes may increase along a length of the liquid manifold 601. The multiple sizes may decrease, change, and/or become non-uniform along the length of the manifold 601.

In some embodiments of the system 600, the multiple apertures of the liquid manifold 601 are configured with multiple shapes. The multiple shapes may include at least a vertically biased shape or a horizontally biased shape.

In some embodiments of the system 600, the multiple apertures of the liquid manifold 601 are configured with multiple spacings. The multiple spacings may include at least a first density and a second density such that the first density is less than the second density.

Some embodiments of the system 600 include an inlet coupled with the liquid manifold 601 such that the liquid flows at least along a first length of the liquid manifold 601 from the inlet and along a second length of the liquid manifold 601 from the inlet or from at least a first end of the liquid manifold 601 or a second end of the liquid manifold 601. The liquid manifold 601 may be configured such that at least one of the apertures from the multiple apertures along the first length of the liquid manifold 601 is at a lower height than at least one of the other apertures from the multiple apertures along the first length of the liquid manifold 601. In some embodiments, at least the first length of the liquid manifold 601 or the second length of the liquid manifold 601 is angled down away from the inlet such that a height of the liquid manifold 601 either increases or decreases along at least the first length of the liquid manifold 601 or the second length of the liquid manifold 601. In some embodiments, at least the first length of the liquid manifold 601 or the second length of the liquid manifold 601 is horizontally oriented away from the inlet.

In some embodiments of the system 600, the refrigerant goes through a phase change within the heat exchanger 602. In some embodiments, the refrigerant may include a primary refrigerant, which as a refrigerant that goes through a phase change; some embodiments include a secondary refrigerant, which may include a heat transfer fluid that is cooled by some other aspects of the system.

In some embodiments of system 600, the heat exchanger 602 is configured such that the refrigerant flows into and out of the heat exchanger 602 to cool another surface of the heat exchanger. The liquid manifold 601 that includes the multiple apertures such that the liquid flows through the multiple apertures and down the surface of the heat exchanger 602 to form the ice sheet on the surface of the heat exchanger 602 from water in the liquid may be further configured such that at least a portion of the liquid that flows through the multiple apertures flows down the other surface of the heat exchanger 602 to form an ice sheet on the other surface of the heat exchanger 602 from water in the liquid. Some embodiments include another liquid manifold 601 that includes multiple apertures such that a liquid flows through the multiple apertures of the other liquid manifold 601 and down the other surface of the heat exchanger 602 to form an ice sheet on the other surface of the heat exchanger 602 from water in the liquid.

Figure 6B:
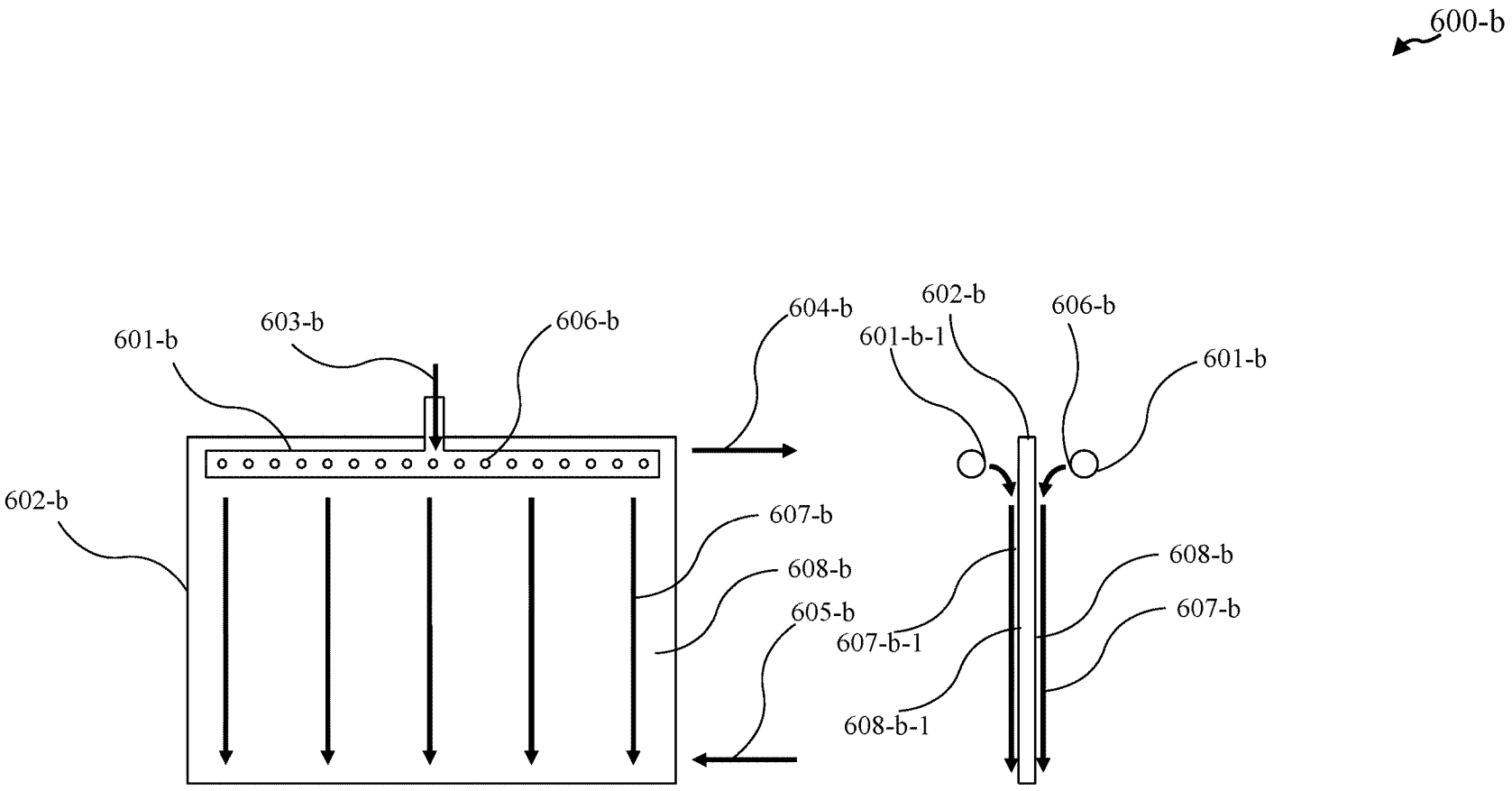
FIG. 6B shows aspects of a system and/or devices in accordance with various embodiments.

FIG. 6B provides an example of a system 600-*b* in accordance with various embodiments. System 600-*b* may be an example of system 600 of FIG. 6A, for example. A water distribution system 601-*b*, which may be referred to as a liquid manifold, may be placed at the top of a cold plate or heat exchanger 602-*b*. Water or liquid more generally 603-*b* may be introduced into the system and may exit through hole features or apertures 606-*b*, which may create a falling film of water 607-*b* on the plate 602-*b*. A refrigerant may flow into 605-*b* and out 604-*b* of the plate 602-*b*, which may keep the plate 602-*b* cold and may absorb the energy from the water film 607-*b* to form ice on the plate 602-*b*. The properties of the hole features 606-*b* may be controlled so that the film 607-*b* produces uneven flow across a surface 608-*b* of the plate 602-*b* and may produce a more uniform ice sheet that may harvest quicker and/or more reliably.

FIG. 6B also shows that another liquid manifold 601-*b*-1 may be utilized with respect to system 600-*b*, which may flow liquid 607-*b*-1 down another surface 608-*b*-1 of heat exchanger 602-*b*.

Figure 6C:
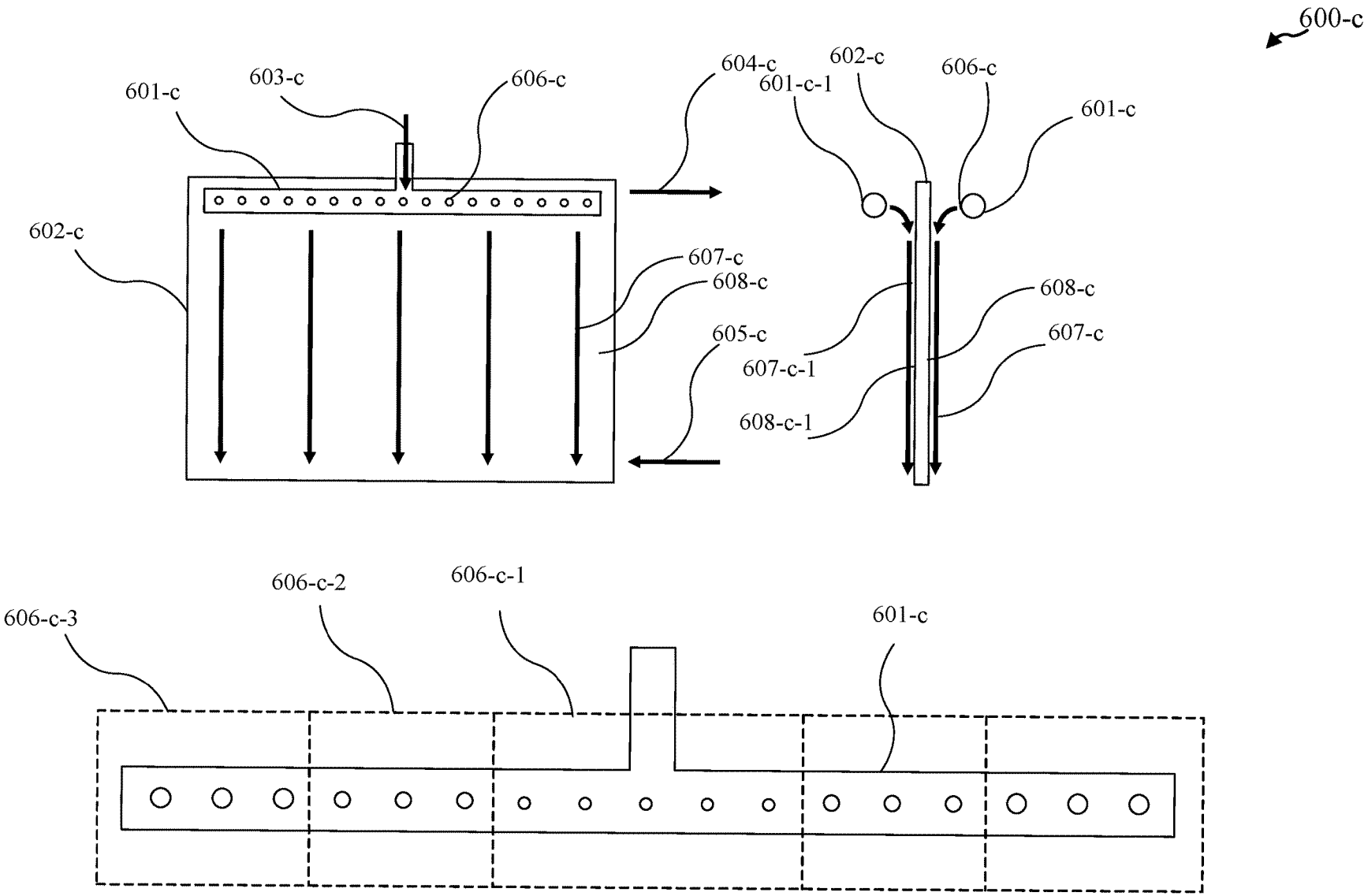
FIG. 6C shows aspects of a system and/or devices in accordance with various embodiments.

FIG. 6C shows a system 600-*c* in accordance with various embodiments. System 600-*c* may be an example of system 600 of FIG. 6A. System 600-*c* may rely on hole or aperture size. A water distribution system or liquid manifold 601-*c* may be placed at the top of a cold plate or heat exchanger 602-*c*. Water or liquid 603-*c* may be introduced into the system 600-*c* and may exit through hole features 606-*c*, which may create a falling film of water 607-*c* on a surface 608-*c* of the plate 602-*c*. Refrigerant may flow into 605-*c* and out 604-*c* of the plate 602-*c*, which may keep the plate 602-*c* cold and may absorb the energy from the water film 607-*c* to form ice on the plate 602-*c*. The hole features 606-*c* may be broken down into an area of small holes 606-*c*-1, large holes 606-*c*-3, and medium size holes 606-*c*-2; in general, holes 606-*c*-1 are smaller than holes 606-*c*-2, which are smaller than holes 606-*c*-3. The larger holes may create higher flow at the edges of the plate 602-*c*, which may produce a more defined boundary of ice that may have less chance of chipping during harvest and degrading reliability.

FIG. 6C also shows that another liquid manifold 601-*c*-1 may be utilized with respect to system 600-*c*, which may flow liquid 607-*c*-1 down another surface 608-*c*-1 of heat exchanger 602-*c*.

Figure 6D:
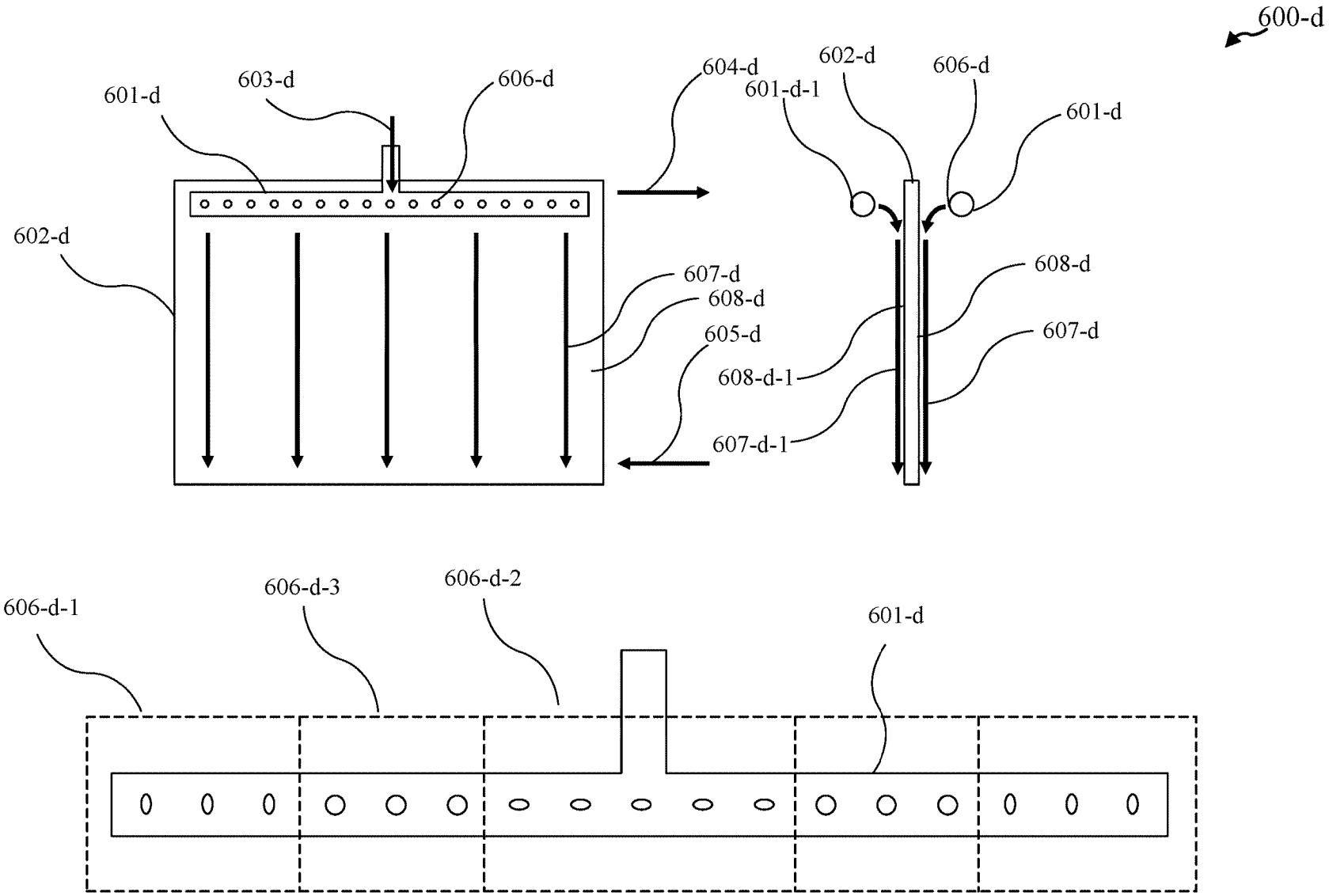
FIG. 6D shows aspects of a system and/or devices in accordance with various embodiments.

FIG. 6D shows a system 600-*d* in accordance with various embodiments. System 600-*d* may be an example of system 600 of FIG. 6A. System 600-*d* may rely on hole or aperture shape. A water distribution system or liquid manifold 601-*d* may be placed at the top of a cold plate or heat exchanger 602-*d*. Water or liquid in general 603-*d* may be introduced into the system and may exit through hole features or apertures 606-*d*, which may create a falling film of water 607-*d* on a surface 608-*d* of the plate 602-*d*. Refrigerant may flow into 605-*d* and out 604-*d* of the plate 602-*d*, which may keep the plate 602-*d* cold and may absorb the energy from the water film 607-*d* to form ice on the plate 602-*d*. The hole features 606-*d* may be broken down into an area of vertically biased holes 606-*d*-1, horizontally biased holes 606-*d*-2, and round holes 606-*d*-3. Vertically biased holes 606-*d*-1 may produce a narrower stream of water that may produce a crisper edge of ice toward the edges of the plate 602-*d*, whereas horizontally biased holes 606-*d*-2 may produce a more dispersed flow that may cover the center of the plate 602-*d* better. Round holes 606-*d*-3 may fall somewhere in-between. The combination of the different shape biases may produce a more uniform ice sheet with better defined edges.

FIG. 6D also shows that another liquid manifold 601-*d*-1 may be utilized with respect to system 600-*d*, which may flow liquid 607-*d*-1 down another surface 608-*d*-1 of heat exchanger 602-*d*.

Figure 6E:
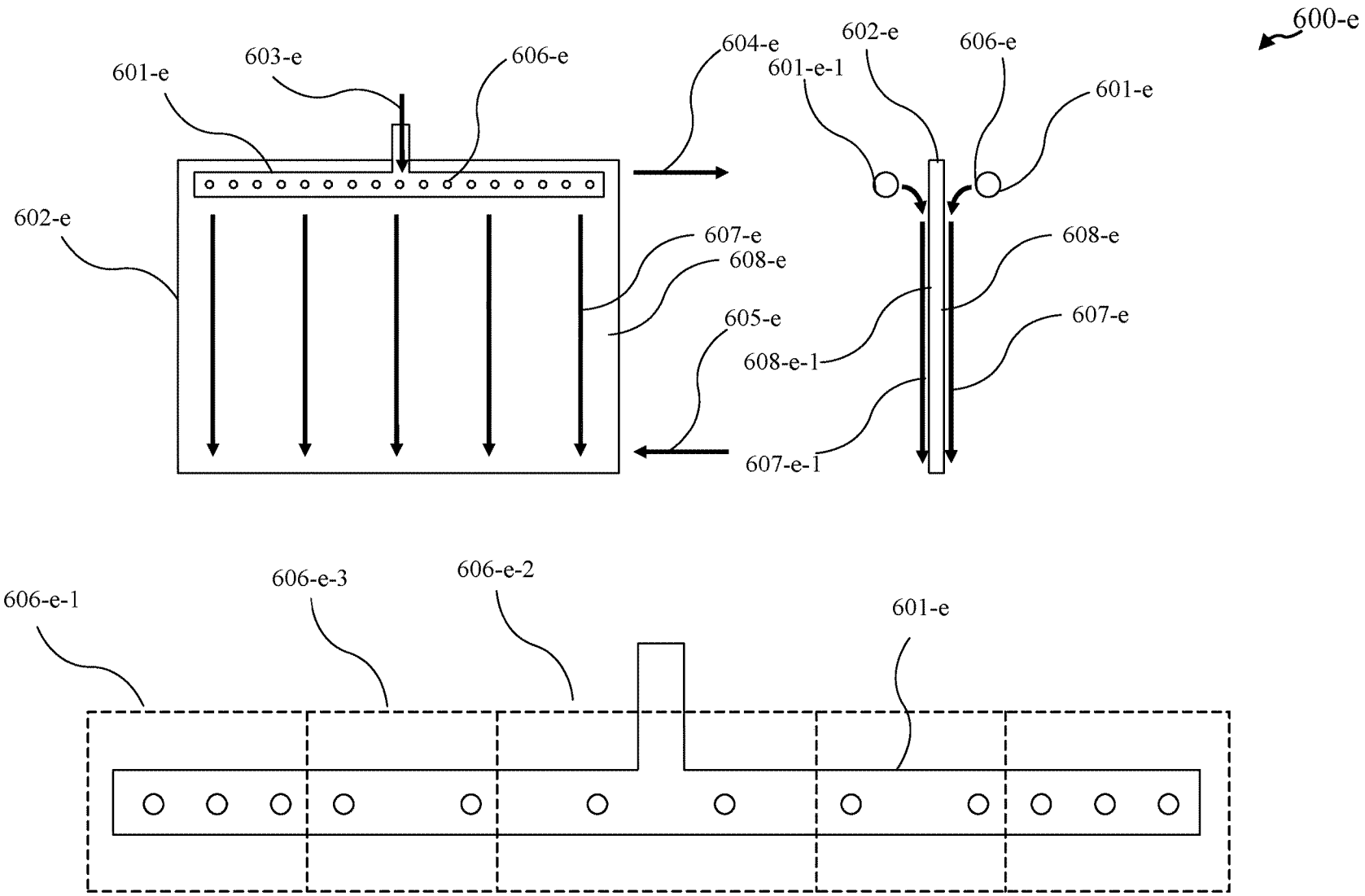
FIG. 6E shows aspects of a system and/or devices in accordance with various embodiments.

FIG. 6E shows a system 600-*e* in accordance with various embodiments. System 600-*e* may be an example of system 600 of FIG. 6A. System 600-*e* may rely on hole or aperture spacing. A water distribution system or liquid manifold 601-*e* may be placed at the top of a cold plate or heat exchanger 602-*e*. Water or liquid in general 603-*e* may be introduced into the system and may exit through hole features or apertures 606-*e*, which may create a falling film of water 607-*e* on a surface 608-*e* of the plate 602-*e*. Refrigerant may flow into 605-*e* and out 604-*e* of the plate 602-*e*, which may keep the plate 602-*e* cold and may absorb the energy from the water film 607-*e* to form ice on the plate 602-*e*. The hole features 606-*e* may be broken down into an area of densely spaced holes 606-*e*-1, sparsely spaced holes 606-*e*-2, and medium density holes 606-*e*-3. The dense holes may produce more flow in that area while the sparce holes may produce less flow. The higher flow at the edges may produce a more defined ice sheet that may harvest more reliably.

FIG. 6E also shows that another liquid manifold 601-*e*-1 may be utilized with respect to system 600-*e*, which may flow liquid 607-*e*-1 down another surface 608-*e*-1 of heat exchanger 602-*e*.

Figure 6F:
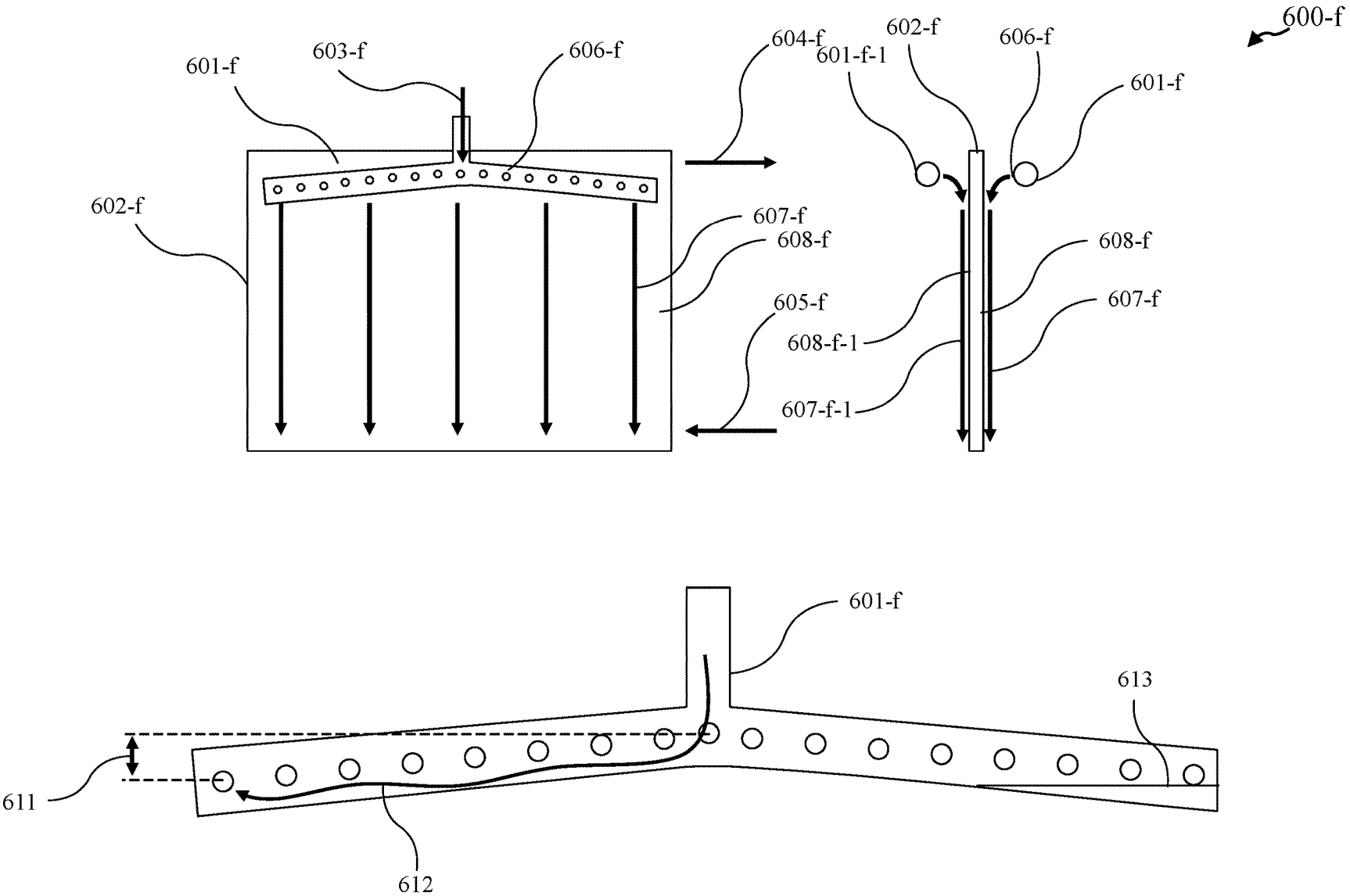
FIG. 6F shows aspects of a system and/or devices in accordance with various embodiments.

FIG. 6F shows a system 600-*f* in accordance with various embodiments. System 600-*f* may be an example of system 600 of FIG. 6A. System 600-*f* may rely on manifold shape and/or slope. A water distribution system or liquid manifold 601-*f* may be placed at the top of a cold plate or heat exchanger 602-*f*. Water or liquid in general 603-*f* may be introduced into the system and may exit through hole features or apertures 606-*f*, which may create a falling film of water 607-*f* on the plate 602-*f*. Refrigerant may flow into 605-*f* and out 604-*f* of the plate 602-*f*, which may keep the plate 602-*f* cold and may absorb the energy from the water film 607-*f* to form ice on the plate 602-*f*. In this case, an angle of the distribution system may produce a net hydrostatic head difference 611 between holes. Thus, the flow through each hole 606-*f* may increase near the edges of the plate 602-*f*. Furthermore, if the water may be doped with a immiscible heavy substance like a fluorinated oil, the holes near the edges may see a higher flow of this dopant in both free flowing 612 or pool forming 613 flow regimes. This may combine to create better defined and lubricated edge conditions for the ice sheet, which may result in better harvesting.

FIG. 6F also shows that another liquid manifold 601-*f*-1 may be utilized with respect to system 600-*f*, which may flow liquid 607-*f*-1 down another surface 608-*f*-1 of heat exchanger 602-*f*.

Figure 6G:
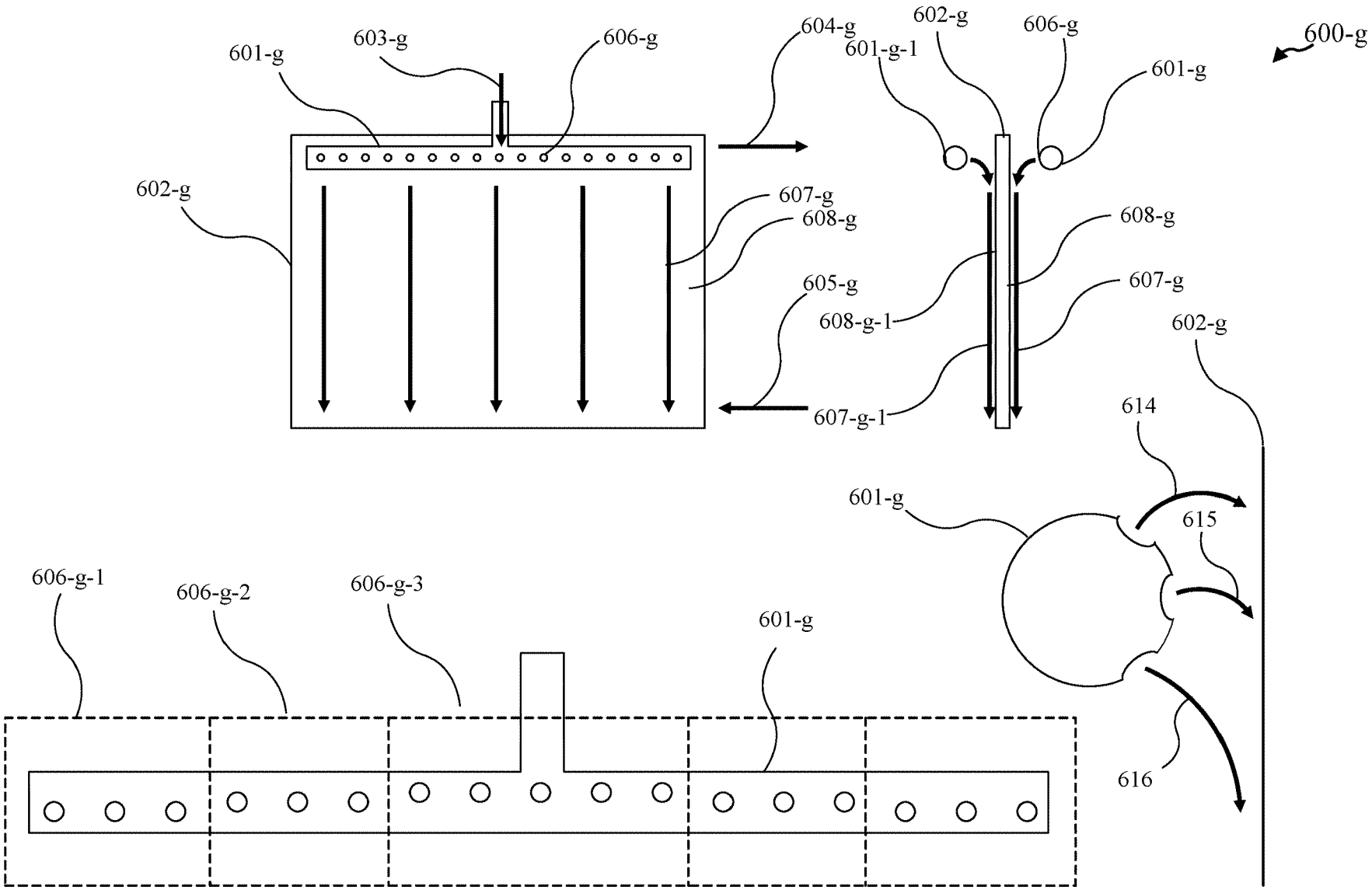
FIG. 6G shows aspects of a system and/or devices in accordance with various embodiments.

FIG. 6G shows a system 600-*g* in accordance with various embodiments. System 600-*g* may be an example of system 600 of FIG. 6A. System 600-*g* may rely on hole or aperture locations. A water distribution system or liquid manifold 601-*g* may be placed at the top of a cold plate or heat exchanger 602-*g*. Water or liquid in general 603-*g* may be introduced into the system and may exit through hole features or apertures 606-*g*, which may create a falling film of water 607-*g* on a surface 608-*g* of the plate 602-*g*. Refrigerant may flow into 605-*g* and out 604-*g* of the plate 602-*g*, which may keep the plate cold and may absorb energy from the water film 607-*g* to form ice on the plate 602-*g*. In this case, the holes 606-*g* in one area may be positioned in a lower radial location 606-*g*-1. In another area, they may be placed in an intermediate radial location 606-*g*-2. In another area, they may be placed in a higher radial location 606-*g*-3. The holes 606-*g* in the higher relative position may produce a high arch 614 of liquid that may have a lower flow and may hit the plate 602-*g* at a high angle, which may produce a low velocity and a spreading effect due to splatter. The holes 606-*g* at a low radial position may create a drooping flow 616 that may slowly approach the plate 602-*g* at a low shallow angle. This may create a high plate velocity and a low amount of spreading due to splatter. The intermediate holes may create an intermediate stream 615 with some properties of both.

FIG. 6G also shows that another liquid manifold 601-*g*-1 may be utilized with respect to system 600-*g*, which may flow liquid 607-*g*-1 down another surface 608-*g*-1 of heat exchanger 602-*g*.

Figure 6H:
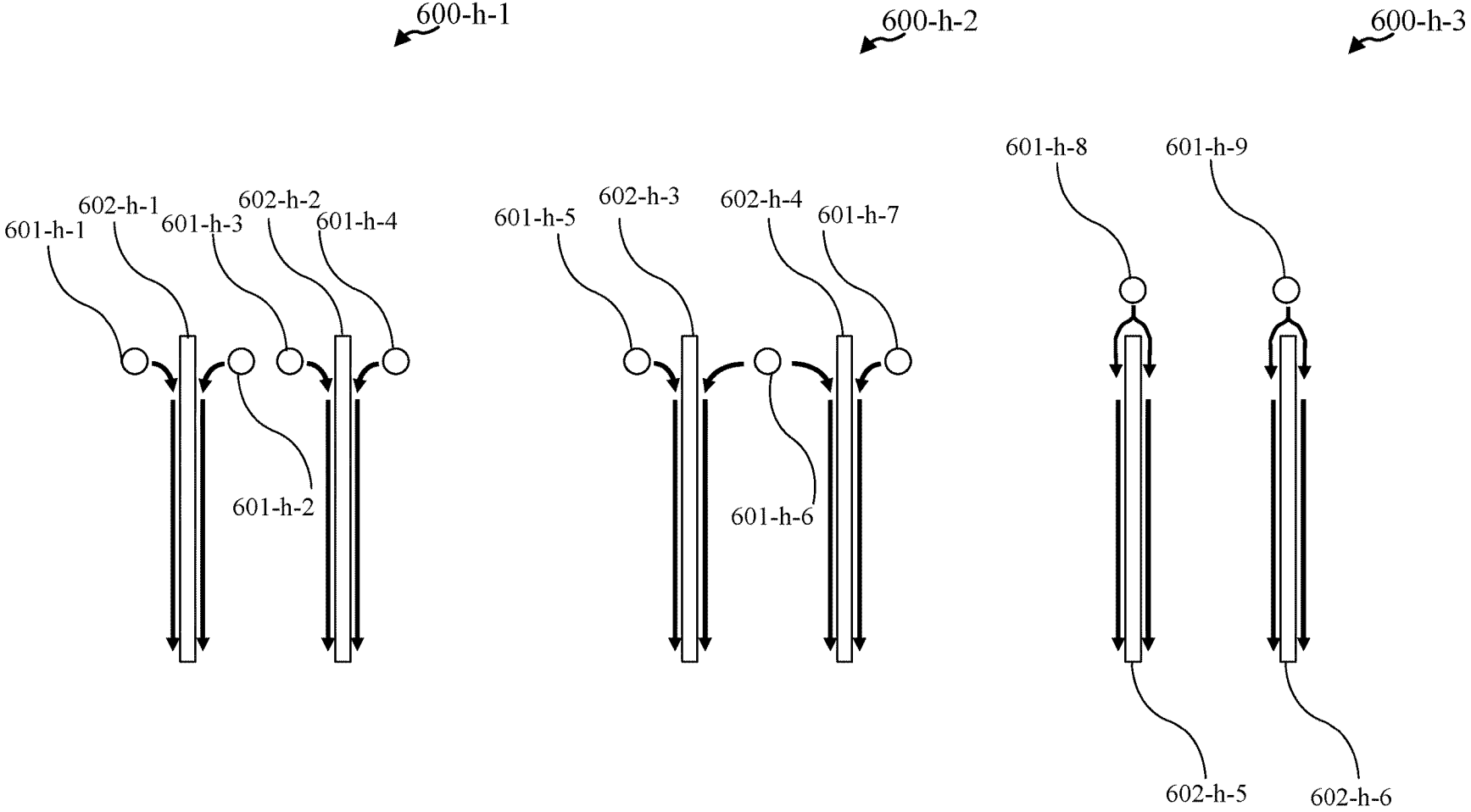
FIG. 6H shows aspects of systems and/or devices in accordance with various embodiments.

FIG. 6H shows several system variations 600-*h*-1, 600-*h*-2, and 600-*h*-3 in accordance with various embodiments. These variations may be applicable to the various disclosed systems 600 for FIG. 6A, FIG. 6B, FIG. 6C, FIG. 6D, FIG. 6E, FIG. 6F, and/or FIG. 6G. System 600-*h*-1 shows a configuration with two heat exchangers 602-*h*-1 and 602-*h*-2 and four liquid manifolds 601-*h*-1, 601-*h*-2, 601-*h*-3, and 601-*h*-4. Each respective liquid manifold may deliver fluid to a respective surface of one of the heat exchangers 602-*h*-1 or 602-*h*-2 as may be shown. System 600-*h*-2 shows a configuration with two heat exchangers 602-*h*-3 and 602-*h*-4 and three liquid manifolds 601-*h*-5, 601-*h*-6, and 601-*h*-7. In this example, at least one of the liquid manifolds (such as liquid manifold 601-*h*-6) may deliver liquid to a surface of heat exchanger 602-*h*-3 and also heat exchanger 602-*h*-4. System 600-*h*-3 shows a configuration with two heat exchangers 602-*h*-5 and 602-*h*-6 and two liquid manifolds 601-*h*-8 and 601-*h*-9. In this configuration, each liquid manifold delivers liquid to two surfaces of a respective heat exchanger, such as liquid manifold 601-*h*-8 delivering liquid to a first surface and a second surface of heat exchanger 602-*h*-5.

Figure 6I:
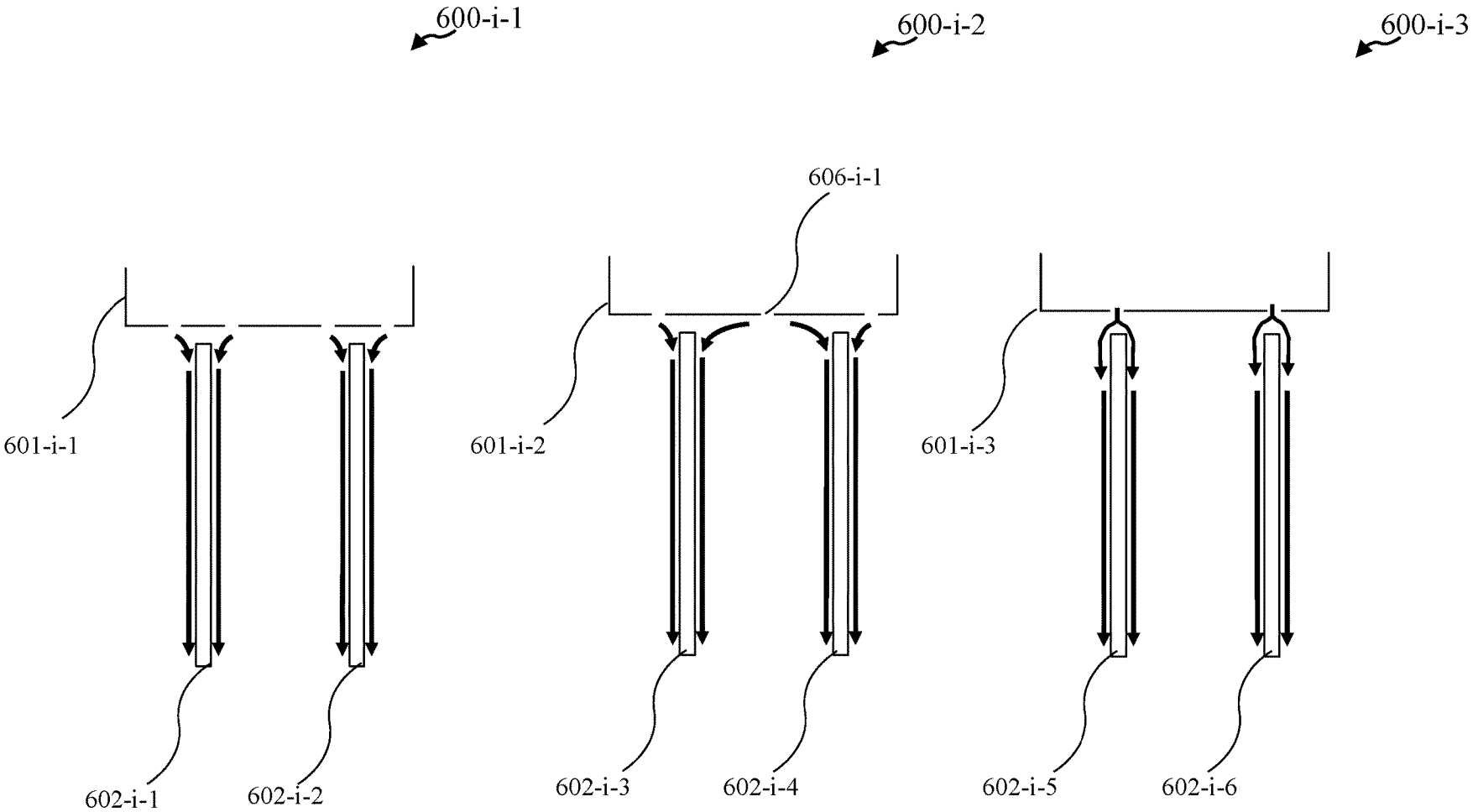
FIG. 6I shows aspects of systems and/or devices in accordance with various embodiments.

FIG. 6I shows several system variations 600-*i*-1, 600-*i*-2, and 600-*i*-3 in accordance with various embodiments. These variations may be applicable to the various disclosed systems 600 for FIG. 6A, FIG. 6B, FIG. 6C, FIG. 6D, FIG. 6E, FIG. 6F, and/or FIG. 6G. System 600-*i*-1 shows a configuration with two heat exchangers 602-*i*-1 and 602-*i*-2 and a liquid manifold 601-*i*-1 configured as a pan with multiple apertures, where each aperture delivers liquid to a respective surface of one of the heat exchangers 602-*i*-1 or 602-*i*-2 as may be shown in the figure. System 600-*i*-2 shows a configuration with two heat exchangers 602-*i*-3 and 602-*i*-4 and a liquid manifold 601-*i*-2 configured as a pan with multiple apertures. In this configuration, some of the apertures such as aperture 606-*i*-2 may be configured to deliver liquid to a surface of each of the heat exchangers 602-*i*-3 and 602-*i*-4 as may be shown in the figure. System 600-*i*-3 shows a configuration with two heat exchangers 602-*i*-5 and 602-*i*-6 and a liquid manifold 602-*i*-3 configured as a pan with multiple apertures. In this configuration, each aperture may be configured to deliver liquid to two surfaces of a respective heat exchanger as may be shown in the figure.

Various embodiments may be produced through combining one or more of these features that may completely control the ice sheet uniformity and edge definition. This may be accomplished by creating higher flow near the edges with low spreading and splatter and lower flow near the interior and high spreading and splatter. Immiscible doping management may also be handled, if present, by encouraging dopant flow to the edges of the sheet.

In general, aspects of systems 600 of FIG. 6A, FIG. 6B, FIG. 6C, FIG. 6D, FIG. 6E, FIG. 6F, FIG. 6G, FIG. 6H, and/or FIG. 6I may be integrated with the other systems, devices, and/or methods described with regard to those shown and/or described with respect to FIG. 1A, FIG. 1B, FIG. 2A, FIG. 2B, FIG. 3A, FIG. 3B, FIG. 3C, FIG. 4A, FIG. 4B, FIG. 4C, FIG. 4D, and/or FIG. 5. The liquids 603 and/or 607 may be an example of water 102 described above. The liquids 603 and/or 607 may also be an example of emulsions 104 as described above and may include one or more oil components, such as a hydrocarbon oil, a fluorocarbon oil, and/or a silicone oil. The noted ice sheets may be an example of an ice sheets 108 as described above. Heat exchangers 602 may be examples of the heat exchangers 110 described above; the heat exchangers 602 may include an oleophilic surface, such as oleophilic surfaces 113 described above. Aspects of systems 600 may be integrated with the other systems, devices, and/or methods described with regard to those shown and/or described with respect to FIG. 7A, FIG. 7B, FIG. 7C, FIG. 7D, FIG. 8A, FIG. 8B, FIG. 8C, FIG. 9A, FIG. 9B, and/or FIG. 9C. For example, heat exchangers 602 may be examples of heat exchangers 702 of FIG. 7A, FIG. 7B, and/or FIG. 7C. Heat exchangers 602 may be examples of heat exchangers 801 of FIG. 8A and/or FIG. 8B. Heat exchangers 602 may examples of heat exchanger 910 of FIG. 9A. The other components of systems 600 of FIG. 6A, FIG. 6B, FIG. 6C, FIG. 6D, FIG. 6E, FIG. 6F, FIG. 6G, FIG. 6H, and/or FIG. 6I may be integrated with the systems of FIG. 1A, FIG. 1B, FIG. 2A, FIG. 2B, FIG. 3A, FIG. 3B, FIG. 3C, FIG. 4A, FIG. 4B, FIG. 4C, FIG. 4D, FIG. 7A, FIG. 7B, FIG. 7C, FIG. 8A, FIG. 8B, and/or FIG. 9A.

Figure 6J:
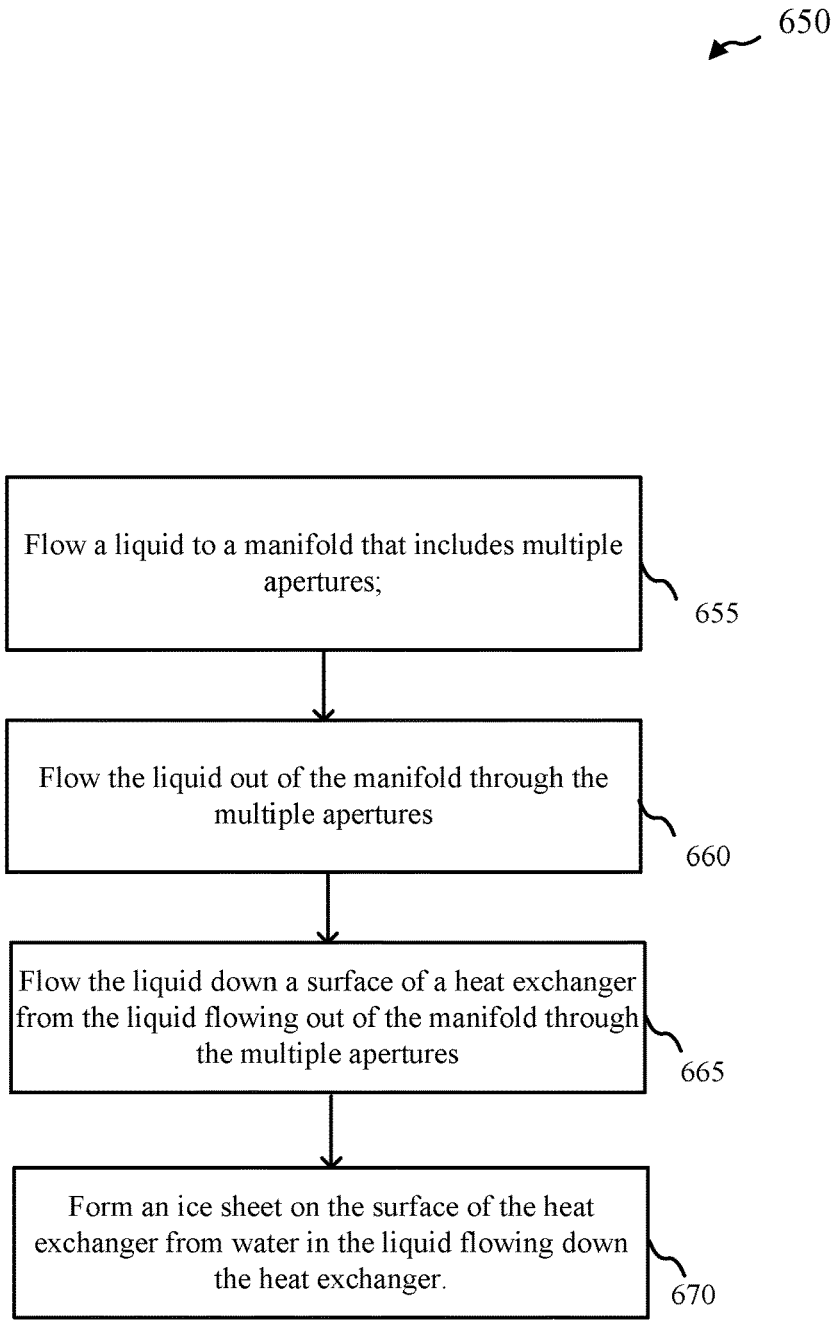
FIG. 6J shows a flow diagram of a method in accordance with various embodiments.

FIG. 6J provides an example of a method 650 that may be applicable to systems 600 of FIG. 6A, FIG. 6B, FIG. 6C, FIG. 6D, FIG. 6E, FIG. 6F, FIG. 6G, FIG. 6H, and/or FIG. 6I.

At block 655, a liquid may flow to a manifold that includes multiple apertures. At block 660, the liquid may flow out of the manifold through the multiple apertures. At block 665, the liquid may flow down a surface of a heat exchanger from the liquid flowing out of the manifold through the multiple apertures. At block 670, an ice sheet may form on the surface of the heat exchanger from water in the liquid flowing down the heat exchanger.

In some embodiments of method 650, flowing the liquid out of the manifold through the multiple apertures forms a non-uniform distribution of the liquid out of the manifold. In some embodiments, forming the ice sheet on the heat exchanger from water in the liquid flowing down the heat exchanger includes forming a uniform ice sheet on the surface of the heat exchanger.

In some embodiments of the method 650, the multiple apertures are configured with multiple sizes. The multiple sizes may increase along a length of the manifold.

In some embodiments of the method 650, the multiple apertures are configured with multiple shapes. The multiple shapes may include at least a vertically biased shape or a horizontally biased shape.

In some embodiments of the method 650, the multiple apertures are configured with multiple spacings. The multiple spacings may include at least a first density and a second density such that the first density is less than the second density.

Some embodiments of the method 650 include an inlet coupled with the manifold such that the liquid flows at least along a first length of the manifold from the inlet and along a second length of the manifold from the inlet or from at least a first end of the manifold or a second end of the manifold. The manifold may be configured such that at least one of the apertures from the multiple apertures along the first length of the manifold is at a lower height than at least one of the other apertures from the multiple apertures along the first length of the manifold. In some embodiments, at least the first length of the manifold or the second length of the manifold is angled down away from the inlet. In some embodiments, at least the first length of the manifold or the second length of the manifold is horizontally oriented away from the inlet.

In some embodiments of the method 650, flowing the liquid out of the manifold through the multiple apertures includes flowing at least a portion of the liquid out of the manifold through the multiple apertures down another surface of the heat exchanger to form another sheet of ice on the other surface of the heat exchanger.

Some embodiments of the method 650 include: flowing a liquid to another manifold that includes multiple apertures; flowing the liquid out of the other manifold through the multiple apertures; flowing the liquid down another surface of the heat exchanger from the liquid flowing out of the other manifold through the multiple apertures; and forming an ice sheet on the other surface of the heat exchanger from water in the liquid flowing down the other surface of the heat exchanger.

In some embodiments of the method 650, flowing the liquid down the surface of the heat exchanger forms a liquid film over the surface of the heat exchanger. Forming the ice sheet on the surface of the heat exchanger may include forming the ice sheet under the liquid film over the surface of the heat exchanger.

In some embodiments of the method 650, the liquid includes an emulsion. In some embodiments, the surface of the heat exchanger includes an oleophilic surface.

Some embodiments of the method 650 include: curtailing the flow of the liquid down the surface of the heat exchanger after forming the ice sheet on the surface of the heat exchanger; subcooling the ice sheet on the surface of the heat exchanger after curtailing the flow of the liquid down the surface of the heat exchanger; and harvesting the ice sheet through the ice sheet, which is subcooled on the surface of the heat exchanger, falling away from the surface of the heat exchanger.

Methods, systems, and devices for harvesting ice on cold surfaces are provided in accordance with various embodiments. Some embodiments pertain to the removal of ice from a cold surface with the assistance of a hydrodynamic force. For example, some embodiments are utilized with cold surfaces that may produce ice that peels or cleaves away from the surface to form a progressing gap between the ice and the surface. A fluid may then be applied into this gap to speed the process of ice removal. Integration, fluid selection, and system component layouts are discussed in more detail below.

Some embodiments include a fluid harvester for the rapid removal of ice from a cold surface with an oleophilic coating. This type of cold surface generally produces ice that cleaves or peels away from the surface as a cohesive plane of solid. This solid may create a gap between the surface and ice as it cleaves, creating an opportunity for fluid to be applied to assist the harvesting of the ice.

The fluid may be injected into the gap, transferring momentum to the ice and rapidly completing the cleaving process. This momentum transfer may also create a clearing action that may force the ice away from the cold plate so that it may fall more reliably, clearing the surface for another round of ice growth. The fluid may be a wide range of fluids both liquid or gas including, but not limited to, air, water, brine, oil, nitrogen, or a mixture thereof.

In some embodiments, the fluid is introduced uniformly along the top horizontal edge of the surface and/or tangentially to the surface in the vertical direction; this may create a film of fluid that moves down into the gap created by the cleaving ice. The device may be integrated into the plate, which may achieve a high level of tangentiality between the fluid and plate, or it may be integrated into a broader system independent of the plate for support.

To create the desired effect, a system of components may be involved, such as a fluid compressor or pump, a pressure tank, a control valve, a distribution manifold, and/or a nozzle. The fluid compressor, which may be a pump if the fluid is a liquid, generally generates pressurized fluid. That fluid may be stored in the pressure tank. When the ice is ready to be harvested, a control valve may be opened and the fluid may flow rapidly through the nozzle into the gap between the ice and cold surface.

Figure 7A:
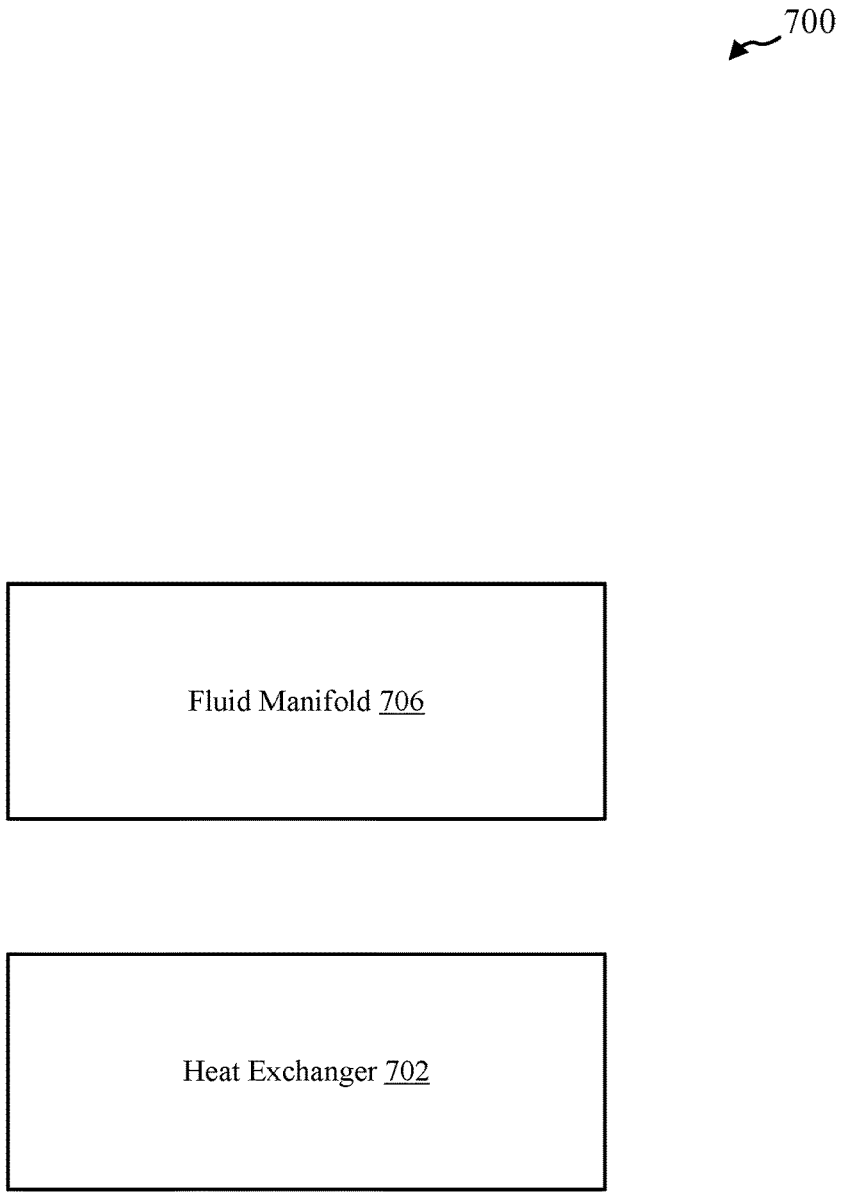
FIG. 7A shows aspects of a system and/or devices in accordance with various embodiments.

FIG. 7A provides an example of a system in accordance with various embodiments that may include: a heat exchanger 702 configured such that a refrigerant flows into and out of the heat exchanger 702 to cool a surface of the heat exchanger; and a fluid manifold 706 that includes multiple apertures that inject a fluid through the multiple apertures between a surface of the heat exchanger 702 and an ice sheet formed on the surface of the heat exchanger. Some embodiments include multiple nozzles through which the fluid flows to inject the fluid between the surface of the heat exchanger 702 and the ice sheet formed on the surface of the heat exchanger 702. Fluid manifold 706 may be referred to as an air manifold and/or air harvester.

In some embodiments of the system 700, the fluid manifold 706 injects the fluid along a top, horizontal edge of heat exchanger 702. In some embodiments, the fluid manifold 706 injects the fluid tangential to the surface of the heat exchanger 702. In some embodiments, the fluid manifold 706 is coupled with the top, horizontal edge of the heat exchanger 702. The multiple apertures may be formed as gaps between the fluid manifold 706 and the heat exchanger 702.

Some embodiments of the system 700 include an air compressor that pressurizes the fluid that the fluid manifold 706 injects through the multiple apertures between the surface of the heat exchanger 702 and the ice sheet formed on the surface of the heat exchanger 702.

Some embodiments of system 700 include a liquid manifold that includes multiple apertures such that a liquid flows through the multiple apertures and down the surface of the heat exchanger 702 to form the ice sheet on the heat exchanger 702 from water in the liquid.

In some embodiments of the system 700, the surface of the heat exchanger 702 includes an oleophilic surface. In some embodiments, the liquid includes an emulsion.

Figure 7B:
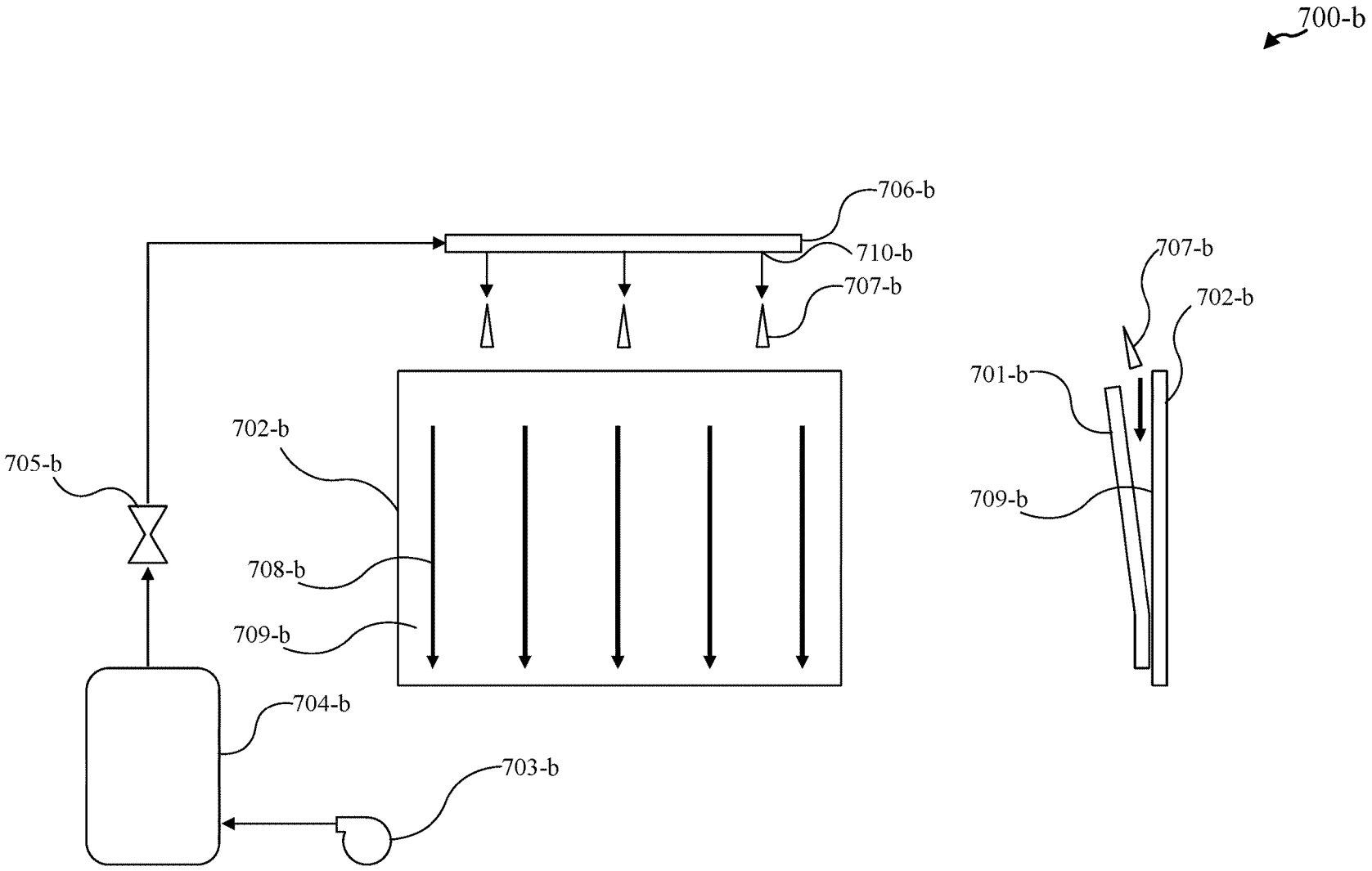
FIG. 7B shows aspects of a system and/or devices in accordance with various embodiments.

Turning now to FIG. 7B, a system 700-*b* is provided in accordance with various embodiments. System 700-*b* may be an example of system 700 of FIG. 7A. A pump or compressor 703-*b* may create a pressurized fluid that may be stored in a tank 704-*b*. A valve 705-*b* may open to create a flow of fluid. The fluid may be dispersed by a fluid manifold 706-*b* through multiple apertures 710-*b* and may flow into nozzles 707-*b* that may regulate the flow; the fluid manifold 706-*b* and/or nozzles 707-*b* may facilitate injecting the fluid with respect to the heat exchanger 702-*b* and ice sheet 701-*b*. Nozzle(s) 707-*b* may be coupled with fluid manifold 706-*b*. The fluid may flow down the cold surface 709-*b* of a heat exchanger 702-*b* in a tangential film 708-*b*. This flow 708-*b* may be in-between a sheet of ice 701-*b* and the surface 709-*b* of the heat exchanger 702-*b* that may be created when the ice 701-*b* begins to cleave off the surface 709-*b* naturally due to the oleophilic nature of the cold surface 709-*b* and water-oil mixture used to make the ice 701-*b*. This may help facilitate harvesting the ice 701-*b*. The fluid manifold 706-*b* and/or nozzles 707-*b* may facilitate injecting the fluid flow 708-*b* with respect to the heat exchanger 702-*b* and ice sheet 701-*b*.

Figure 7C:
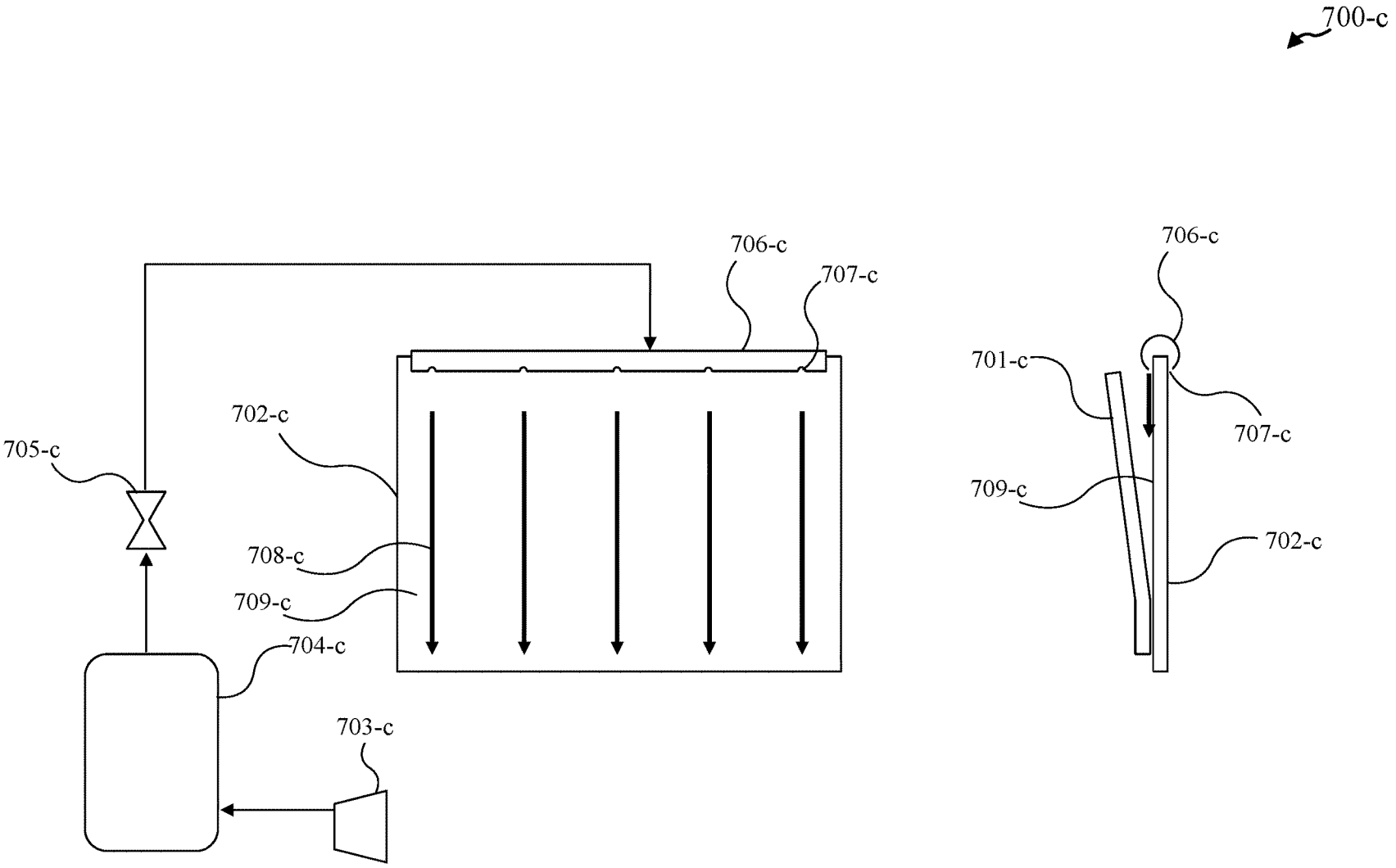
FIG. 7C shows aspects of a system and/or devices in accordance with various embodiments.

FIG. 7C shows a system 700-*c* in accordance with various embodiments. System 700-*c* may be an example of system 700. An air compressor 703-*c* may create pressurized air that may be stored in a tank 704-*c*. A valve 705-*c* may open to create a flow of compressed air. The fluid may be dispersed by a fluid manifold 706-*c* and flows into nozzle(s) 707-*c* that may regulate the flow. The manifold 706-*c* may be integrated directly into heat exchanger 702-*c* and the nozzle(s) 707-*c* may be formed by regular gaps between the manifold 706-*c* and the heat exchanger 702-*c*; the gaps may form multiple apertures with respect to the manifold 706-*c* and/or heat exchanger 702-*c*. The fluid may flow down a cold surface 709-*c* of heat exchanger 702-*c* in a tangential film 708-*c*. This flow may be in-between a sheet of ice 701-*c* and the cold surface 709-*c* that may be created when the ice 701-*c* begins to cleave off the cold surface 709-*c* naturally due to the oleophilic nature of the cold surface 709-*c* and the water-oil mixture used to make the ice 701-*c*. This may help facilitate harvesting the ice 701-*c*. The fluid manifold 706-*c* and/or nozzles 707-*c* may facilitate injecting the fluid flow 708-*c* with respect to the heat exchanger 702-*c* and ice sheet 701-*c*.

In general, aspects of systems 700 of FIG. 7A, FIG. 7B, and/or FIG. 7C may be integrated with the other systems, devices, and/or methods described with regard to those shown and/or described with respect to FIG. 1A, FIG. 1B, FIG. 2A, FIG. 2B, FIG. 3A, FIG. 3B, FIG. 3C, FIG. 4A, FIG. 4B, FIG. 4C, FIG. 4D, and/or FIG. 5. The noted liquids may be an example of water 102 described above. The noted liquids may also be an example of emulsions 104 as described above and may include one or more oil components, such as a hydrocarbon oil, a fluorocarbon oil, and/or a silicone oil. The noted ice sheets may be an example of an ice sheets 108 as described above. Heat exchangers 702 may be examples of the heat exchangers 110 described above; the heat exchangers 702 may include an oleophilic surface, such as oleophilic surfaces 113 described above. Aspects of systems 700 may be integrated with the other systems, devices, and/or methods described with regard to those shown and/or described with respect to FIG. 6A, FIG. 6B, FIG. 6C, FIG. 6D, FIG. 6E, FIG. 6F, FIG. 6G, FIG. 6H, FIG. 6I, FIG. 6J, FIG. 8A, FIG. 8B, FIG. 8C, FIG. 9A, FIG. 9B, and/or FIG. 9C. For example, heat exchangers 702 may be examples of heat exchangers 602 of FIG. 6A, FIG. 6B, FIG. 6C, FIG. 6D, FIG. 6E, FIG. 6F, FIG. 6G, FIG. 6H, and/or FIG. 6I. Heat exchangers 702 may be examples of heat exchangers 801 of FIG. 8A and/or FIG. 8B. Heat exchangers 702 may examples of heat exchanger 910 of FIG. 9A. The other components of systems 700 of FIG. 7A, FIG. 7B, and/or FIG. 7C may be integrated with the systems of FIG. 1A, FIG. 1B, FIG. 2A, FIG. 2B, FIG. 3A, FIG. 3B, FIG. 3C, FIG. 4A, FIG. 4B, FIG. 4C, FIG. 4D, FIG. 6A, FIG. 6B, FIG. 6C, FIG. 6D, FIG. 6E, FIG. 6F, FIG. 6G, FIG. 6H, FIG. 6I, FIG. 8A, FIG. 8B, and/or FIG. 9A.

Figure 7D:
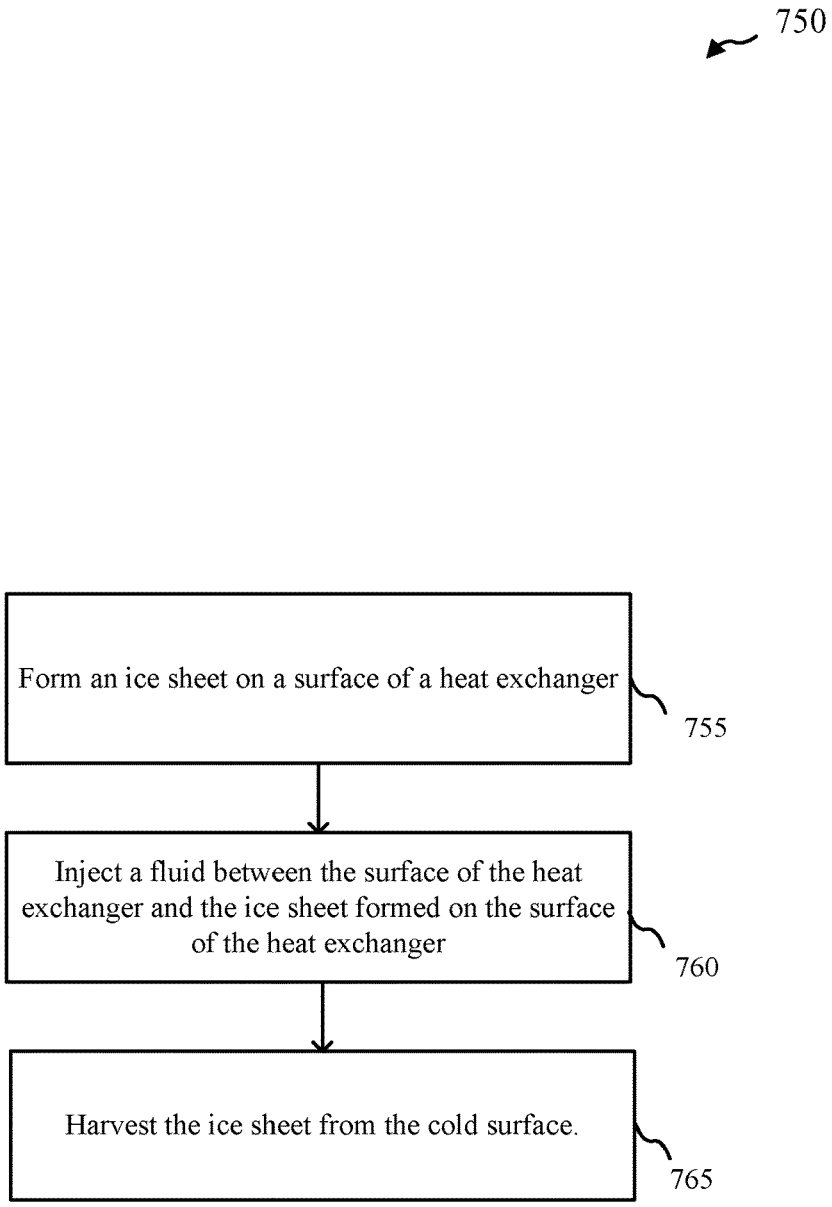
FIG. 7D shows a flow diagram of a method in accordance with various embodiments.

FIG. 7D provides an example of a method 750 for startup as may be applicable to system 700 of FIG. 7A, FIG. 7B, and/or FIG. 7C.

At block 755, an ice sheet may be formed on a surface of a heat exchanger. At block 760, a fluid may be injected between the surface of the heat exchanger and the ice sheet formed on the surface of the heat exchanger. At block 765, the ice sheet may be harvested from the cold surface.

In some embodiments of the method 750, injecting the fluid between the surface of the heat exchanger and the ice sheet formed on the heat exchanger includes using a fluid manifold with multiple apertures to inject the fluid between the surface of the heat exchanger and the ice sheet formed on the surface of the heat exchanger. In some embodiments, injecting the fluid between the surface of the heat exchanger and the ice sheet formed on the surface of the heat exchanger includes using one or more nozzles. In some embodiments, the fluid manifold is coupled with a top, horizontal edge of the heat exchanger. The multiple apertures of the fluid manifold may be formed as gaps between the fluid manifold and the heat exchanger.

In some embodiments of the method 750, injecting the fluid between the surface of the heat exchanger and the ice sheet formed on the surface of the heat exchanger includes injecting the fluid along a top, horizontal edge of the heat exchanger.

Some embodiments of the method 750 include utilizing an air compressor to pressurize the fluid injected between the surface of the heat exchanger and the ice sheet formed on the surface of the heat exchanger.

In some embodiments of the method 750, injecting the fluid between the surface of the heat exchanger and the ice sheet formed on the surface of the heat exchanger includes injecting the fluid tangential to the surface of the heat exchanger.

In some embodiments of the method 750, injecting the fluid between the surface of the heat exchanger and the ice sheet formed on the surface of the heat exchanger occurs with the ice sheet subcooled. In some embodiments, the subcooled ice sheet at least partially cleaves away from the heat exchanger prior to injecting the fluid between the surface of the heat exchanger and the ice sheet formed on the surface of the heat exchanger.

In some embodiments of the method 750, forming the ice sheet on the surface of the heat exchanger includes flowing a liquid down the surface of the heat exchanger. In some embodiments, the surface of the heat exchanger includes an oleophilic surface. In some embodiments, the liquid includes an emulsion. Some embodiments of the system include: curtailing the flow of the liquid down the surface of the heat exchanger; and subcooling the ice sheet formed on the surface of the heat exchanger with the flow of the liquid curtailed.

Methods, systems, and devices for cold oleophilic surfaces that produce harvestable ice are provided in accordance with various embodiments. Some embodiments pertain to the formation of ice plates on oleophilic surfaces with improved harvestability. The improved harvestability may be due to a higher degree of edge definition of the ice plate on the oleophilic surface. By controlling the features on the surface, the ice formed on the surface may be harvested more easily.

Some embodiments include a set of surface features that may allow a cold surface to generate ice that may be more easily shed when harvested. The surface, which generally has an oleophilic coating, may shed ice more easily when that ice has a well-defined boundary and may not be geometrically constrained by any features on the surface.

Some embodiments focus on the boundaries of the surface on the bottom and sides. These areas are generally subject to water splashing, falling, and/or wicking during ice making. Furthermore, since most ice makers generally have a high relative humidity, they may be subject to frost growth. All these forces may cause ice, over time, to grow around corners, and/or merge with refrigerant piping or other features of the ice maker, which may make the ice unharvestable.

The various embodiments address these issues by creating features on the surface that control the water flow over the plate and the ice growth so that it may not cause these issues.

Figure 8A:
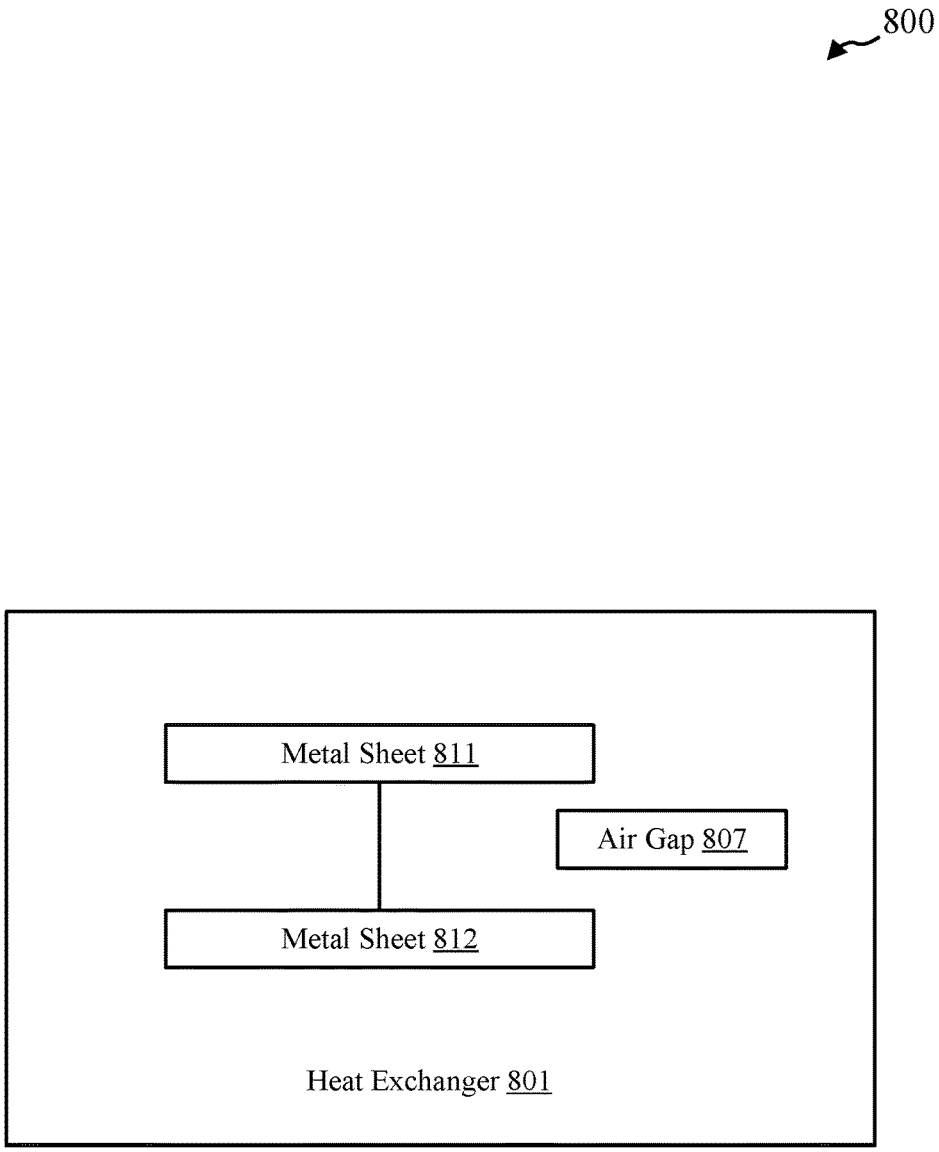
FIG. 8A shows aspects of a system and/or devices in accordance with various embodiments.

FIG. 8A provides an example of a system 800 in accordance with various embodiments that may include a first metal sheet 811 of a heat exchanger 801; a second metal sheet 812 of the heat exchanger 801; the first metal sheet 811 of the heat exchanger 801 is coupled with the second metal sheet 812 of the heat exchanger 801. One or more air gaps 807 may be formed between the first metal sheet 811 of the heat exchanger 801 and the second metal sheet 812 of the heat exchanger 801 that run along at least a length of a base of the heat exchanger 801 or a side of the heat exchanger 801. In some embodiments, the one or more air gaps 807 extend to one or more edges of the first metal sheet 811 of the heat exchanger 801 and the second metal sheet 812 of the heat exchanger 801 to create one or more exterior openings between the first metal sheet 811 of the heat exchanger 801 and the second metal sheet 812 of the heat exchanger 801. Some embodiments include one or more weld seals between the first metal sheet 811 of the heat exchanger 801 and the second metal sheet 812 of the heat exchanger 801; the one or more weld seals may form one or more boundaries of the one or more air gaps 807.

Some embodiments of the system 800 include multiple dimples formed with respect to the first metal sheet 811 of the heat exchanger 801 and the second metal sheet 812 of the heat exchanger 801. The multiple dimples formed with respect to the first metal sheet 811 of the heat exchanger 801 and the second metal sheet 812 of the heat exchanger 801 may include multiple weld points between the first metal sheet 811 of the heat exchanger 801 and the second metal sheet 812 of the heat exchanger 801. The one or more air gaps 807 formed between the first metal sheet 811 of the heat exchanger 801 and the second metal sheet 812 of the heat exchanger 801 may be devoid of dimples.

Some embodiments of the system 800 include an inlet port that delivers a refrigerant to the heat exchanger 801 and an outlet port that removes the refrigerant from the heat exchanger 801. Some embodiments include one or more shields coupled with at least the first metal sheet 811 of the heat exchanger 801 or the second metal sheet 812 of the heat exchanger 801 and positioned between at least the inlet port or the outlet port and the multiple dimples formed with respect to the first metal sheet 811 of the heat exchanger 801 and the second metal sheet 812 of the heat exchanger 801. The one or more shields may include one or more plates coupled with at least the first metal sheet 811 of the heat exchanger 801 or the second metal sheet 812 of the heat exchanger 801 to form a V-shaped shield with respect to at least the inlet port of the heat exchanger or the outlet port of the heat exchanger 801.

Figure 8B:
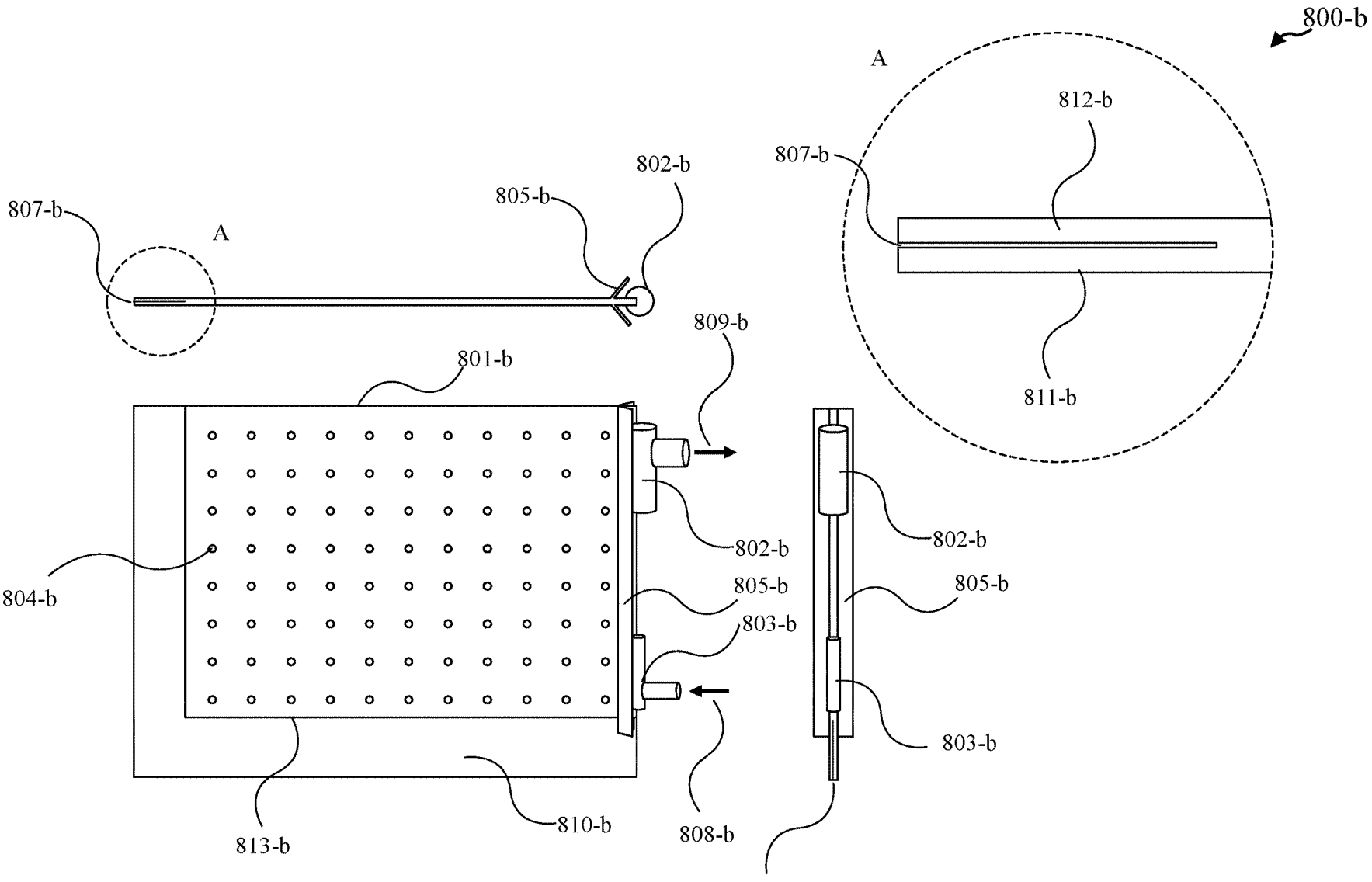
FIG. 8B shows aspects of a system and/or devices in accordance with various embodiments.

Turning now to FIG. 8B, a system 800-*b* is provided in accordance with various embodiments. System 800-*b* may be an example of system 800 of FIG. 8A. FIG. 8B shows a heat exchanger 801-*b* that may be constructed from dimpled plate(s). A dimpled plate may be made by welding two sheets 811-*b*/812-*b* of metal together by many dimples 804-*b*. The heat exchanger 801-*b* generally has a border area 810-*b* along the bottom and non-refrigerant side where no dimples may exist; weld seals or seams 813-*b* may form inner boundaries of the border area 810-*b* and facilitate keeping refrigerant between the dimpled portions of the heat exchanger 801-*b*. Instead, there may be a length of non-welded plate that may create an air gap 807-*b* as may be visible in view A. On the refrigerant side of the heat exchanger 801-*b*, refrigerant liquid 808-*b* may enter the dimpled area of the heat exchanger 801-*b* through a manifold 803-*b*. The gas-liquid refrigerant mixture 809-*b* may exit the heat exchanger 801-*b* through a second manifold 802-*b*. These manifolds may be protected from water by additional plates or shields 805-*b* that may be seal welded onto the heat exchanger 801-*b*. These plates 805-*b* may be constructed of metal and may be welded directly to the plate prior to a coating step, or may be non-metal material, which may include a plastic, and may be attached to metallic mounting features that may be welded to the heat exchanger 801-*b*. The plates 805-*b* may be attached at an obtuse or acute angle to better serve ice shedding. The shields 805-*b* include convex V-shaped shields, flat V-shaped shields, or concave V-shaped shields, for example.

In general, aspects of system 800 may be integrated with the other systems and/or devices described above with regard to those shown and/or described with respect to FIGS. 1-5. The heat exchanger 801 may be an example of the heat exchangers 110 described above; the heat exchanger 801 may include an oleophilic surface, such as oleophilic surfaces 113 described above.

In general, aspects of systems 800 of FIG. 8A and/or FIG. 8B may be integrated with the other systems, devices, and/or methods described with regard to those shown and/or described with respect to FIG. 1A, FIG. 1B, FIG. 2A, FIG. 2B, FIG. 3A, FIG. 3B, FIG. 3C, FIG. 4A, FIG. 4B, FIG. 4C, FIG. 4D, and/or FIG. 5. The noted liquids may be an example of water 102 described above. The noted liquids may also be an example of emulsions 104 as described above and may include one or more oil components, such as a hydrocarbon oil, a fluorocarbon oil, and/or a silicone oil.

The noted ice sheets may be an example of an ice sheets 108 as described above. Heat exchangers 801 may be examples of the heat exchangers 110 described above; the heat exchangers 801 may include an oleophilic surface, such as oleophilic surfaces 113 described above. Aspects of systems 800 may be integrated with the other systems, devices, and/or methods described with regard to those shown and/or described with respect to FIG. 6A, FIG. 6B, FIG. 6C, FIG. 6D, FIG. 6E, FIG. 6F, FIG. 6G, FIG. 6H, FIG. 6I, FIG. 6J, FIG. 7A, FIG. 7B, FIG. 7C, FIG. 7D, FIG. 9A, FIG. 9B, and/or FIG. 9C. For example, heat exchangers 801 may be examples of heat exchangers 602 of FIG. 6A, FIG. 6B, FIG. 6C, FIG. 6D, FIG. 6E, FIG. 6F, FIG. 6G, FIG. 6H, and/or FIG. 6I. Heat exchangers 801 may be examples of heat exchangers 702 of FIG. 7A, FIG. 7B, and/or FIG. 7C. Heat exchangers 801 may be examples of heat exchanger 910 of FIG. 9A. The other components of systems 800 of FIG. 8A and/or FIG. 8B may be integrated with the systems of FIG. 1A, FIG. 1B, FIG. 2A, FIG. 2B, FIG. 3A, FIG. 3B, FIG. 3C, FIG. 4A, FIG. 4B, FIG. 4C, FIG. 4D, FIG. 6A, FIG. 6B, FIG. 6C, FIG. 6D, FIG. 6E, FIG. 6F, FIG. 6G, FIG. 6H, FIG. 6I, FIG. 7A, FIG. 7B, FIG. 7C, and/or FIG. 9A.

Figure 8C:
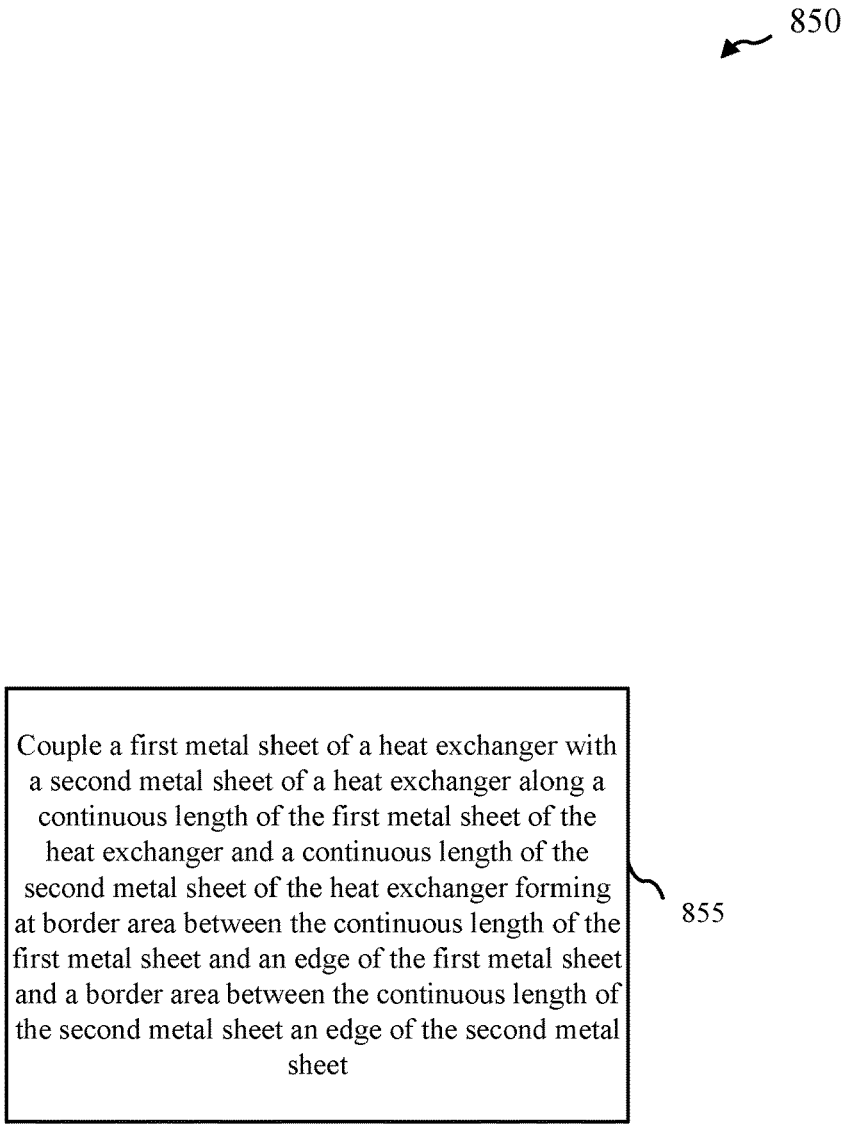
FIG. 8C shows a flow diagram of a method in accordance with various embodiments.

FIG. 8C provides an example of a method 850 for startup as may be applicable to systems 800 of FIG. 8A and/or FIG. 8B.

At block 855, a first metal sheet of a heat exchanger may be coupled with a second metal sheet of a heat exchanger along a continuous length of the first metal sheet of the heat exchanger and a continuous length of the second metal sheet of the heat exchanger forming at border area between the continuous length of the first metal sheet and an edge of the first metal sheet and a border area between the continuous length of the second metal sheet and an edge of the second metal sheet. In some embodiments, one or more air gaps are formed between the border area between the continuous length of the first metal sheet and the edge of the first metal sheet and the border area between the continuous length of the second metal sheet and the edge of the second metal sheet. The one or more air gaps may run along at least a length of a base of the heat exchanger or a side of the heat exchanger. Some embodiments include coupling the first metal sheet of the heat exchanger with the second metal sheet of the heat exchanger at multiple discrete locations to form multiple dimples with respect to the first metal sheet of the heat exchanger and the second metal sheet of the heat exchanger. In some embodiments, the one or more air gaps formed between the first metal sheet of the heat exchanger and the second metal sheet of the heat exchanger are devoid of dimples.

Some embodiments of the method 850 include coupling an inlet port with the heat exchanger that delivers a refrigerant to the heat exchanger and an outlet port that removes the refrigerant from the heat exchanger. Some embodiments include coupling one or more shields with at least the first metal sheet of the heat exchanger or the second metal sheet of the heat exchanger and positioned between at least the inlet port or the outlet port and the multiple dimples formed with respect to the first metal sheet of the heat exchanger and the second metal sheet of the heat exchanger. The one or more shields may include one or more plates coupled with at least the first metal sheet of the heat exchanger or the second metal sheet of the heat exchanger to form a V-shaped shield with respect to at least the inlet port of the heat exchanger or the outlet port of the heat exchanger.

Methods, systems, and devices for ice maker fault detection and recovery are provided in accordance with various embodiments. For example, some embodiments pertain to ice maker controls. Some embodiments relate to detecting faults in ice maker operation and recovering from those faults.

Some embodiments relate to systems of ice making using oleophilic cold surfaces, tanks storing a water-oil emulsion, a water pump, and a subcooling based harvest technique produced by stopping the water flow over the plate. The controls of these systems may involve the monitoring of a refrigerant pressure at the suction side of the plate and/or surge drum and/or the manipulation of a vapor compression-based refrigeration system based on those monitored values.

During normal operation, the growth-harvest cycle may be controlled by monitoring both batch duration and suction pressure. However, a fault state may occur if a harvest does not complete properly and some ice remains on the plate after harvest. Detecting this fault and recovering from it may be possible using the equipment of the system by: monitoring suction pressure at the onset of the growth phase; detecting a fault; closing the refrigerant feed and allowing all refrigerant to be evacuated from the system; running the water pumps for a period of time; optionally, adding heat and/or mass to the tank if available; and/or resuming normal operation.

Figure 9A:
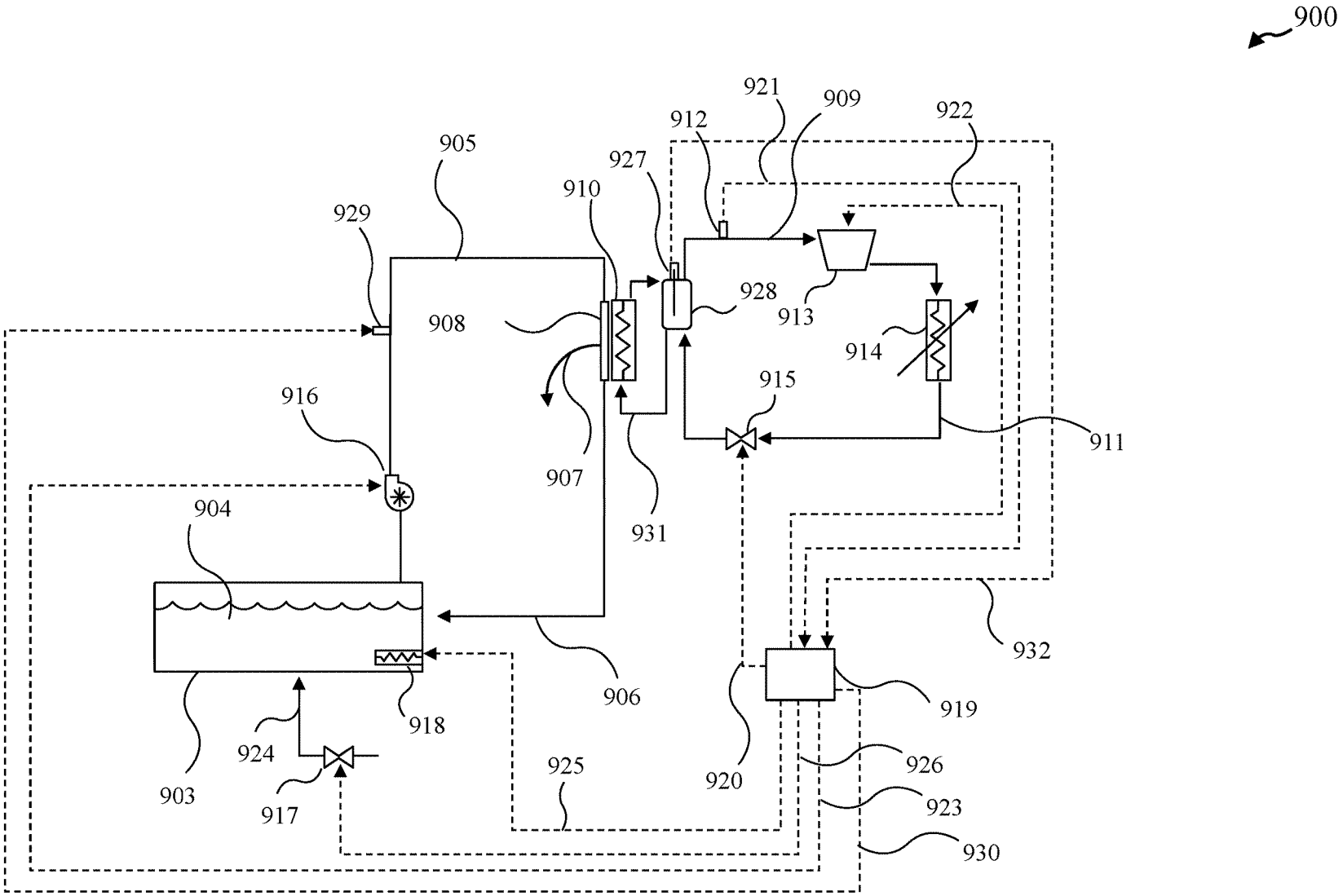
FIG. 9A shows aspects of a system and/or devices in accordance with various embodiments.

Turning now to FIG. 9A, a system 900 is provided in accordance with various embodiments. System 900 may be an example of an ice maker system with heat exchanger 910, which may include a cold oleophilic surface that may be fed with a liquid mixture 905, such as a water-oil mixture whose temperature may be measured with a temperature sensor 929, to form an ice 908, which may include an ice sheet, and return mixture 906 that may flow back to the tank 903; the heat exchanger 910 may be referred to in general as a cold surface or plate. The tank 903 may be equipped with a resistive heater 918 and/or a heater valve 917, which may be capable of adding hot mass 924 to the tank 903 via steam or hot water. The mixture 904 may be sent to the cold surface 910 via a pump 916. The ice 908 may be harvested from the cold surface 910 and may fall 907 when the ice 908 may be allowed to subcool. The cold surface 910 may be cooled by a circulating refrigerant 931 that may be fed from a surge drum 928. The surge drum 928 may have a level sensor 927, which may monitor its level of liquid refrigerant. The surge drum 928 may be fed by liquid refrigerant 911 that may be fed by a valve 915. The refrigerant that boils in the cold surface 910 may leave the surge drum 928 as a gas 909 whose pressure may be read by a pressure transducer 912 before the gas may reach a compressor 913. The pressure transducer 912 may be located anywhere along the suction path from the plate 910 to the compressor 913. The compressed gas may then be condescended in a condenser 914. A controller 919 capable of input and output electrical controls and internal processing logic may be connected to various parts of the system 900. It may read 921 the refrigerant suction pressure, for example, from pressure transducer 912. It may read 932 the liquid refrigerant level in the surge drum 928 from level sensor 927. It may read 930 the water temperature from temperature sensor 929. It may set 922 the refrigerant compressor 913 power via speed or piston unloading. It may control 920 the refrigerant feed rate through valve 915. It may control 925 the electric heater 918. It may control 926 the addition of hot mass 924. It may control 923 the water feed pump 916.

When the growth phase starts, the refrigerant suction pressure may be monitored by the pressure transducer 912 via an electronic signal 921. If the pressure does not meet a threshold during this phase, a fault may be detected by the controller 919. The normal cycle may be interrupted. The water pump 916 may be turned off via a control signal 923. The refrigerant feed valve 915 may be shut, and the compressor 913 may be instructed to run until the suction pressure, as read by the pressure transducer 912 is low, evacuating the refrigerant from the cold surface 910. The water pump 916 may be turned on and run for a sufficient amount of time. In some cases, heat is added to the tank 903 and the mixture therein 904 via the heater 918 and/or the heater valve 917. This may heat the content of the tank 903 and/or add hot mass to the tank 903. After the system 900 has reset, normal operation may begin again.

Figure 9B:
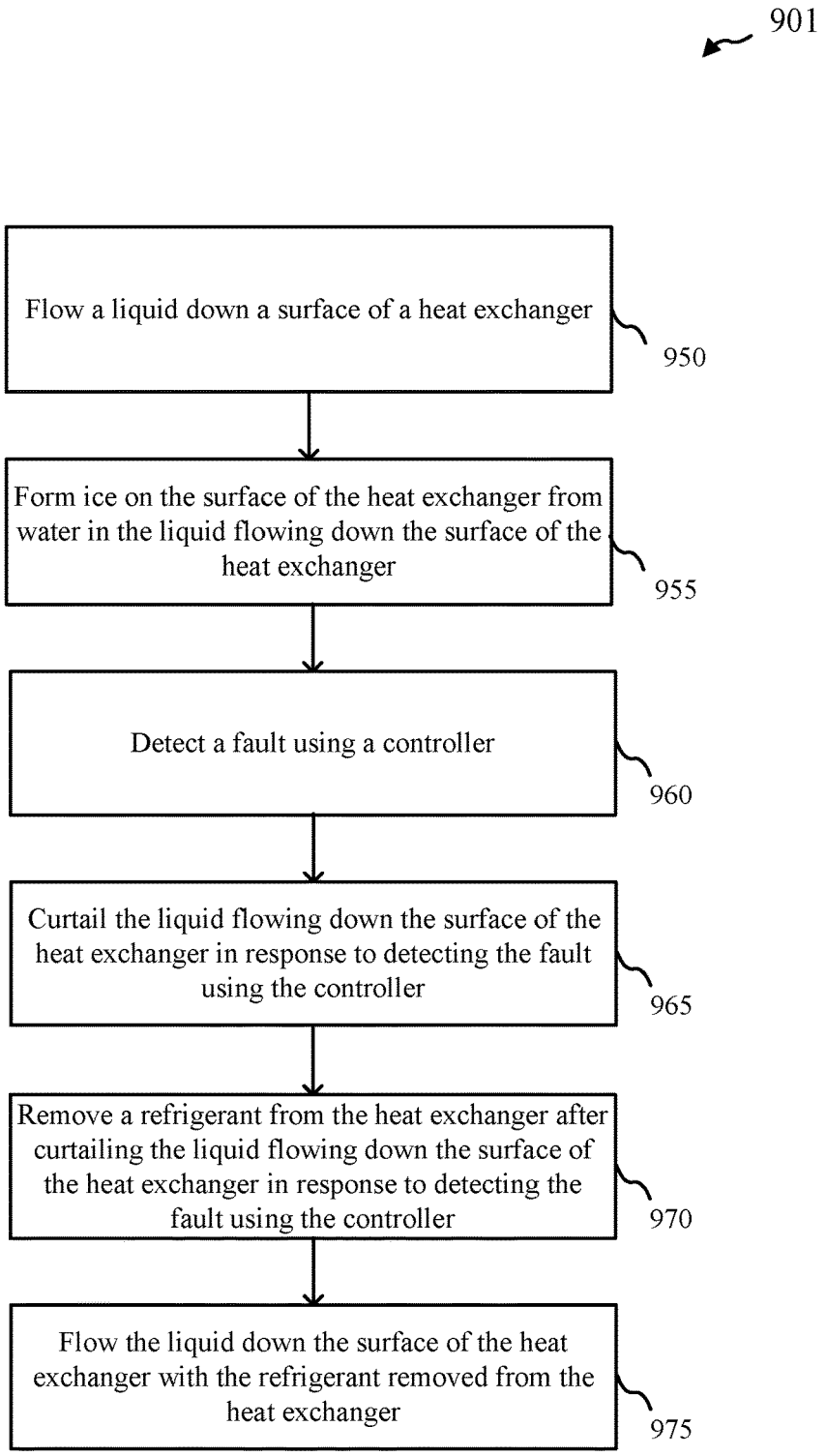
FIG. 9B shows a flow diagram of a method in accordance with various embodiments.

FIG. 9B provides an example of a method 901 for fault detection and/or recovery as may be applicable to system 900 of FIG. 9.

At block 950, a liquid may flow down a surface of a heat exchanger. At block 955, ice may form on the surface of the heat exchanger from water in the liquid flowing down the surface of the heat exchanger. At block 960, a fault may be detected using a controller. At block 965, the liquid flowing down the surface of the heat exchanger may be curtailed in response to detecting the fault using the controller. At block 970, a refrigerant may be removed from the heat exchanger after curtailing the liquid flowing down the surface of the heat exchanger in response to detecting the fault using the controller. At block 975, the liquid may flow down the surface of the heat exchanger with the refrigerant removed from the heat exchanger.

Some embodiments of the method 901 include heating the liquid that flows down the surface of the heat exchanger with the refrigerant removed from the heat exchanger. Heating the liquid that flows down the surface of the heat exchanger with the refrigerant removed from the heat exchanger may include heating the liquid in a tank from which a pump delivers the liquid to the surface of the heat exchanger. Some embodiments include heating the liquid that flows down the surface of the heat exchanger utilizing hot refrigerant inside the heat exchanger.

In some embodiments of the method 901, detecting the fault using the controller further includes measuring a suction pressure of the refrigerant from the heat exchanger, wherein the suction pressure indicates the fault.

Some embodiments of the method 901 include: flowing the refrigerant to the heat exchanger after flowing the liquid to the heat exchanger with the refrigerant removed from the heat exchanger; and resuming the flow of the liquid down the surface of the heat exchanger to form an ice sheet on the surface of the heat exchanger.

In some embodiments of the method 901, flowing the liquid down the surface of the heat exchanger forms a liquid film over the heat exchanger. Forming the ice on the surface of the heat exchanger may include forming the ice under the liquid film over the heat exchanger.

In some embodiments of the method 901, the liquid includes an emulsion. In some embodiments, the surface of the heat exchanger includes an oleophilic surface.

Some embodiments of the method 901 include: curtailing the flow of the liquid down the surface of the heat exchanger after forming the ice on the surface of the heat exchanger; subcooling the ice on the surface of the heat exchanger after curtailing the flow of the liquid down the surface of the heat exchanger; and harvesting the ice through the ice sheet, which is subcooled on the surface of the heat exchanger, falling away from the surface of the heat exchanger.

Methods, systems, and devices for ice maker startup are also provided in accordance with various embodiments. Some embodiments provide ice maker controls. For example, some embodiments relate to the startup of an ice maker that uses an oleophilic cold surface from a warm state through normal operation.

Starting up such systems generally presents several challenges that may be overcome through appropriate path function through various states. These challenges may include ice sticking to the cold surface, ice falling off the cold surface non-uniformly, and/or the water/ice forming a mush at some point, for example.

Some embodiments include the following procedures. The refrigerant loop may be turned on and the compressor power may be set such that the suction pressure in the cold surface may be above freezing. The water pump may be turned on to circulate water over the cold surface cooling it to near freezing without forming ice. The water pump may be turned off. The compressor power may be set such that the suction pressure in the cold surface is below freezing. The plates may be cooled, and the refrigerant level may be maintained. The water pump may be turned on and normal ice growth may begin.

Turning again to FIG. 9A, system 900 may provide an example of a system in accordance with various embodiments with respect to ice maker startup. System 900 provides an example of an ice maker system with the heat exchanger 910, which may also be referred to as a cold oleophilic surface or plate, that may be fed with water-oil mixture 905, whose temperature may be read by temperature sensor 929, to form ice 908, which may include an ice sheet, and return mixture 906 that may flow back to the tank 903. The mixture 905 may be sent to the cold surface 910 via pump 916. The ice 908 may be harvested from the cold surface 910 and may fall 907 when the ice is allowed to subcool. The cold surface 910 may be cooled by circulating refrigerant 931 that may be fed from surge drum 928. The surge drum 928 may include level sensor 927, which may monitor its level. The surge drum 928 may be fed by liquid refrigerant 911 whose flow rate may be set by valve 915. The refrigerant that boils in the cold surface 910 may leave the surge drum 928 as gas 909 whose pressure may be read by pressure transducer 912 before the gas reaches compressor 913. The pressure transducer 912 may realistically be located at any point from the plate 910 to the compressor 913 where it may effectively read the pressure of the suction side or low pressure side of the system. The compressed gas may then be condescended in condenser 914. Controller 919 capable of input and output electrical controls and internal processing logic may be connected to various parts of the system 900. It can read the refrigerant suction pressure 921, for example, from pressure transducer 912. It may read the liquid refrigerant level 932 in the surge drum 928 from level sensor 927. It may read the water temperature 930 from temperature sensor 929. It may set the refrigerant compressor 913 power via speed or piston unloading signal 922. It may control the refrigerant feed through valve 915 position signal 920. It may control the water feed pump 916 through the control signal 923.

When the startup controls are initiated, the controller 919 may open the refrigerant feed valve 915 to fill the surge drum 928. This level may be monitored by the level sensor 927. The controller 919 may set the power of the compressor 913 by a speed or unloader signal 922 such that the suction pressure read at the pressure sensor 912 via its signal 921 may be slightly above the pressure associated with that of freezing water for the refrigerant in use. During this time, the level sensor 927 may be used to measure the liquid level of the refrigerant in the surge drum 928 and the valve 915 may be opened as needed to maintain the level.

The water pump 916 may be turned on via its control signal 923 and the temperature of the water may be read by the temperature sensor 929 and may be sent to the controller 919 via its signal 930. The system 900 may stay in this configuration until the water temperature is near zero.

Once the water is chilled, the water pump 916 may be turned off and the compressor signal 922 may be changed such that the pressure read at the pressure sensor 912 may now be well below the pressure associated with the freezing point of water for the refrigerant used. As an example, the pressure may be held at the pressure that corresponds to a saturation temperature of −10° C. This period may be held long enough for the plates 910 to get cold and for any water still on the cold surface to freeze. During this time, the level sensor 927 may be used to measure the liquid level of the refrigerant in the drum 928 and the valve 915 may be opened as needed to maintain the level. Once the plates 910 are sufficiently cold, the pump 916 may be turned on and normal ice maker operation may commence.

Tank 903 may be an example of tank 103 with respect of FIGS. 1-5.

In general, aspects of system 900 of FIG. FIG. 9A may be integrated with the other systems, devices, and/or methods described with regard to those shown and/or described with respect to FIG. 1A, FIG. 1B, FIG. 2A, FIG. 2B, FIG. 3A, FIG. 3B, FIG. 3C, FIG. 4A, FIG. 4B, FIG. 4C, FIG. 4D, and/or FIG. 5. The mixtures 904 and/or 905 may be an example of water 102 described above. Mixtures 905 and/or 905 may also be an example of emulsions 104 as described above and may include one or more oil components, such as a hydrocarbon oil, a fluorocarbon oil, and/or a silicone oil. Ice 908 may be an example of ice sheets 108 as described above. Heat exchanger 910 may be examples of the heat exchangers 110 described above; the heat exchangers 910 may include an oleophilic surface, such as oleophilic surfaces 113 described above. Aspects of system 900 may be integrated with the other systems, devices, and/or methods described with regard to those shown and/or described with respect to FIG. 6A, FIG. 6B, FIG. 6C, FIG. 6D, FIG. 6E, FIG. 6F, FIG. 6G, FIG. 6H, FIG. 6I, FIG. 6J, FIG. 7A, FIG. 7B, FIG. 7C, FIG. 7D, FIG. 8A, FIG. 8B, and/or FIG. 8C. For example, heat exchange 910 may be an example of heat exchangers 602 of FIG. 6A, FIG. 6B, FIG. 6C, FIG. 6D, FIG. 6E, FIG. 6F, FIG. 6G, FIG. 6H, and/or FIG. 6I. Heat exchanger 910 may be an example of heat exchangers 702 of FIG. 7A, FIG. 7B, and/or FIG. 7C. Heat exchanger 910 may be an example of heat exchangers 801 of FIG. 8A and/or FIG. 8B. The other components of system 900 of FIG. 9A may be integrated with the systems of FIG. 1A, FIG. 1B, FIG. 2A, FIG. 2B, FIG. 3A, FIG. 3B, FIG. 3C, FIG. 4A, FIG. 4B, FIG. 4C, FIG. 4D, FIG. 6A, FIG. 6B, FIG. 6C, FIG. 6D, FIG. 6E, FIG. 6F, FIG. 6G, FIG. 6H, FIG. 6I FIG. 7A, FIG. 7B, FIG. 7C, FIG. 8A, and/or FIG. 8B.

Figure 9C:
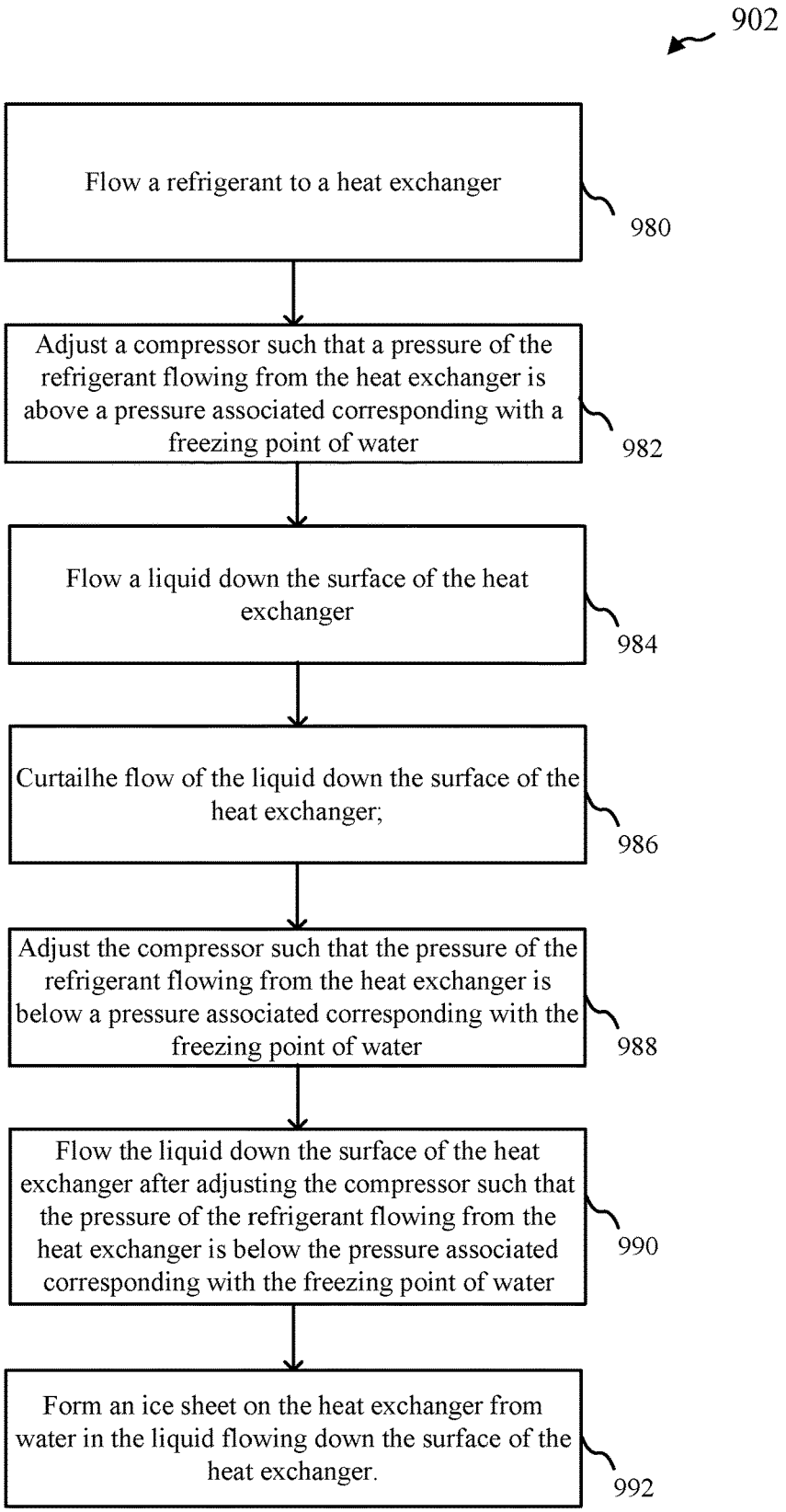
FIG. 9C shows a flow diagram of a method in accordance with various embodiments.

FIG. 9C provides an example of a method 902 for startup as may be applicable to system 900.

At block 980, a refrigerant may flow to a heat exchanger. At block 982, a compressor may be adjusted such that a pressure of the refrigerant flowing from the heat exchanger is above a pressure corresponding with a freezing point of water. At block 984, a liquid may flow down the surface of the heat exchanger. At block 986, the flow of the liquid down the surface of the heat exchanger may be curtailed. At block 988, the compressor may be adjusted such that the pressure of the refrigerant flowing from the heat exchanger is below a pressure corresponding with the freezing point of water. At block 990, the liquid may flow down the surface of the heat exchanger after adjusting the compressor such that the pressure of the refrigerant flowing from the heat exchanger is below the pressure corresponding with the freezing point of water. At block 992, an ice sheet may form on the heat exchanger from water in the liquid flowing down the surface of the heat exchanger.

Some embodiments of the method 902 include: measuring a temperature of the liquid; and where curtailing the flow of the liquid down the surface of the heat exchanger is based on the measured temperature of the liquid. Some embodiments include: flowing the refrigerant through a surge drum to reach the heat exchanger; and flowing the refrigerant from the heat exchanger back to the surge drum. Some embodiments utilize a thermosyphon effect where the flow of refrigerant is naturally formed by boiling of the refrigerant and may not involve a pump.

In some embodiments of the method 902, flowing the liquid down the surface of the heat exchanger forms a liquid film over the surface of the heat exchanger. In some embodiments, forming the ice sheet on the surface of the heat exchanger includes forming the ice sheet under the liquid film over the surface of the heat exchange. In some embodiments, curtailing the flow of the liquid down the surface of the heat exchanger utilizes a timer or other mechanism to curtail the flow.

In some embodiments of the method 902, the liquid includes an emulsion. In some embodiments, the surface of the heat exchanger includes an oleophilic surface. Some embodiments of the method include: curtailing the flow of the liquid down the surface of the heat exchanger after forming the ice sheet on the surface of the heat exchanger; subcooling the ice sheet on the surface of the heat exchanger after curtailing the flow of the liquid down the surface of heat exchanger; and harvesting the ice sheet through the ice sheet, which is subcooled on the surface of the heat exchanger, falling away from the surface of the heat exchanger.

These embodiments may not capture the full extent of combinations and permutations of materials and process equipment. However, they may demonstrate the range of applicability of the methods, devices, and/or systems. The different embodiments may utilize more or less stages than those described.

It should be noted that the methods, systems, and devices discussed above are intended merely to be examples. It must be stressed that various embodiments may omit, substitute, or add various procedures or components as appropriate. For instance, it should be appreciated that, in alternative embodiments, the methods may be performed in an order different from that described, and that various stages may be added, omitted, or combined. Also, features described with respect to certain embodiments may be combined in various other embodiments. Different aspects and elements of the embodiments may be combined in a similar manner. Also, it should be emphasized that technology evolves and, thus, many of the elements are exemplary in nature and should not be interpreted to limit the scope of the embodiments.

Specific details are given in the description to provide a thorough understanding of the embodiments. However, it will be understood by one of ordinary skill in the art that the embodiments may be practiced without these specific details. For example, well-known circuits, processes, algorithms, structures, and techniques have been shown without unnecessary detail in order to avoid obscuring the embodiments.

Also, it is noted that the embodiments may be described as a process which may be depicted as a flow diagram or block diagram or as stages. Although each may describe the operations as a sequential process, many of the operations can be performed in parallel or concurrently. In addition, the order of the operations may be rearranged. A process may have additional stages not included in the figure.

Having described several embodiments, it will be recognized by those of skill in the art that various modifications, alternative constructions, and equivalents may be used without departing from the spirit of the different embodiments. For example, the above elements may merely be a component of a larger system, wherein other rules may take precedence over or otherwise modify the application of the different embodiments. Also, a number of stages may be undertaken before, during, or after the above elements are considered. Accordingly, the above description should not be taken as limiting the scope of the different embodiments.

What is claimed is:

1. A method comprising:

flowing a liquid down a surface of a heat exchanger;

forming ice on the surface of the heat exchanger from water in the liquid flowing down the surface of the heat exchanger;

detecting a fault using a controller;

curtailing the liquid flowing down the surface of the heat exchanger in response to detecting the fault using the controller;

removing a refrigerant from the heat exchanger after curtailing the liquid flowing down the surface of the heat exchanger in response to detecting the fault using the controller; and flowing the liquid down the surface of the heat exchanger with the refrigerant removed from the heat exchanger.

2. The method of claim 1, further comprising:

heating the liquid that flows down the surface of the heat exchanger with the refrigerant removed from the heat exchanger.

3. The method of claim 2, wherein heating the liquid that flows down the surface of the heat exchanger with the refrigerant removed from the heat exchanger includes heating the liquid in a tank from which a pump delivers the liquid to the surface of the heat exchanger.

4. The method of claim 1, further comprising heating the liquid that flows down the surface of the heat exchanger utilizing the refrigerant inside the heat exchanger.

5. The method of claim 1, wherein detecting the fault using the controller further includes measuring a suction pressure of the refrigerant from the heat exchanger, wherein the suction pressure indicates the fault.

6. The method of claim 1, further comprising flowing the refrigerant to the heat exchanger after flowing the liquid to the heat exchanger with the refrigerant removed from the heat exchanger; and resuming the flow of the liquid down the surface of the heat exchanger to form an ice sheet on the surface of the heat exchanger.

7. The method of claim 1, wherein flowing the liquid down the surface of the heat exchanger forms a liquid film over the heat exchanger.

8. The method of claim 7, wherein forming the ice on the surface of the heat exchanger includes forming the ice under the liquid film over the heat exchanger.

9. The method of claim 1, wherein the liquid includes an emulsion.

10. The method of claim 1, wherein the surface of the heat exchanger includes an oleophilic surface.

11. The method of claim 1, further comprising:

curtailing the flow of the liquid down the surface of the heat exchanger after forming the ice on the surface of the heat exchanger;

subcooling the ice on the surface of the heat exchanger after curtailing the flow of the liquid down the surface of the heat exchanger; and harvesting the ice through the ice sheet, which is subcooled on the surface of the heat exchanger, falling away from the surface of the heat exchanger.

12. A method comprising:

flowing a refrigerant to a heat exchanger;

adjusting a compressor such that a pressure of the refrigerant flowing from the heat exchanger is above a pressure corresponding with a freezing point of water;

flowing a liquid down the surface of the heat exchanger;

curtailing the flow of the liquid down the surface of the heat exchanger;

adjusting the compressor such that the pressure of the refrigerant flowing from the heat exchanger is below a pressure corresponding with the freezing point of water;

flowing the liquid down the surface of the heat exchanger after adjusting the compressor such that the pressure of the refrigerant flowing from the heat exchanger is below the pressure corresponding with the freezing point of water; and forming an ice sheet on the heat exchanger from water in the liquid flowing down the surface of the heat exchanger.

13. The method of claim 12, further comprising:

measuring a temperature of the liquid; and wherein curtailing the flow of the liquid down the surface of the heat exchanger is based on the measured temperature of the liquid.

14. The method of claim 12, further comprising:

flowing the refrigerant through a surge drum to reach the heat exchanger; and flowing the refrigerant from the heat exchanger back to the surge drum.

15. The method of claim 12, wherein flowing the liquid down the surface of the heat exchanger forms a liquid film over the surface of the heat exchanger.

16. The method of claim 15, wherein forming the ice sheet on the surface of the heat exchanger includes forming the ice sheet under the liquid film over the surface of the heat exchanger.

17. The method of claim 12, wherein the liquid includes an emulsion.

18. The method of claim 12, wherein the surface of the heat exchanger includes an oleophilic surface.

19. The method of claim 12, further comprising:

curtailing the flow of the liquid down the surface of the heat exchanger after forming the ice sheet on the surface of the heat exchanger;

subcooling the ice sheet on the surface of the heat exchanger after curtailing the flow of the liquid down the surface of the heat exchanger; and harvesting the ice sheet through the ice sheet, which is subcooled on the surface of the heat exchanger, falling away from the surface of the heat exchanger.

* * * * *